US007801452B2

(12) United States Patent
Okamoto et al.

(10) Patent No.: US 7,801,452 B2
(45) Date of Patent: Sep. 21, 2010

(54) IMAGE FORMING SYSTEM, MAINTENANCE METHOD APPLIED THERETO, AND PROGRAM FOR CAUSING A COMPUTER TO IMPLEMENT THE MAINTENANCE METHOD

(75) Inventors: Kiyoshi Okamoto, Moriya (JP); Kiyoshi Watanabe, Kashiwa (JP); Tomokazu Nakamura, Matsudo (JP); Hitoshi Kato, Toride (JP); Takayuki Fujii, Toshima-ku (JP); Norifumi Miyake, Kashiwa (JP)

(73) Assignee: Canon Kabushiki Kaisha (JP)

( * ) Notice: Subject to any disclaimer, the term of this patent is extended or adjusted under 35 U.S.C. 154(b) by 595 days.

(21) Appl. No.: 11/146,395

(22) Filed: Jun. 6, 2005

(65) Prior Publication Data

US 2005/0271400 A1 Dec. 8, 2005

(30) Foreign Application Priority Data

Jun. 7, 2004 (JP) ..... 2004-169152

(51) Int. Cl.
*G03G 15/00* (2006.01)

(52) U.S. Cl. ..... 399/21; 399/11; 399/18; 399/407

(58) Field of Classification Search ..... 399/21, 399/407, 11

See application file for complete search history.

(56) References Cited

U.S. PATENT DOCUMENTS 4,176,941 A 12/1979 Breitenkam et al.
4,503,407 A * 3/1985 Ogura ..... 399/21
4,954,848 A * 9/1990 Arima ..... 399/19
5,539,499 A * 7/1996 Fujisawa ..... 399/9
5,568,246 A * 10/1996 Keller et al. ..... 399/382
5,583,617 A * 12/1996 Altrieth et al. ..... 399/81
5,602,625 A * 2/1997 Okamoto et al. ..... 399/21
5,970,274 A 10/1999 Rath
5,987,279 A * 11/1999 Ebata ..... 399/113
6,011,936 A * 1/2000 Kaneko ..... 399/21
6,371,471 B1 * 4/2002 Fukazu et al. ..... 270/58.09

(Continued)

FOREIGN PATENT DOCUMENTS

CN 1499316 6/2007

(Continued)

OTHER PUBLICATIONS

Relevant portion of Search Report, issued on Oct. 18, 2005, in a corresponding European application.

(Continued)

*Primary Examiner*—Ren Yan
*Assistant Examiner*—Matthew G Marini
(74) *Attorney, Agent, or Firm*—Rossi, Kimms & McDowell LLP

(57) ABSTRACT

An image forming system that makes it possible to open or remove an external cover of an apparatus to perform maintenance on the apparatus even while the system is operating. Out of a plurality of conveying paths, at least one conveying path for which at least one part related to the conveying path can be subjected to maintenance is determined, in accordance with a type of the image forming process being executed. The conveying path for which it has been determined that the part related to the conveying path can be subjected to maintenance is displayed on a display device.

10 Claims, 38 Drawing Sheets

U.S. PATENT DOCUMENTS

| | | | | |
|---|---|---|---|---|
| 6,433,880 | B1 | 8/2002 | Nishikata et al. | |
| 6,747,751 | B2 | 6/2004 | Nishikata et al. | |
| 7,206,083 | B2 | 4/2007 | Shimada | |
| 2002/0009302 | A1* | 1/2002 | Kodama et al. | 399/18 |
| 2002/0067496 | A1 | 6/2002 | Nishikata et al. | |
| 2002/0126309 | A1 | 9/2002 | Shimada | |
| 2002/0149788 | A1 | 10/2002 | Nishikata et al. | |
| 2002/0171681 | A1 | 11/2002 | Nomura et al. | |
| 2003/0215256 | A1* | 11/2003 | Osada | 399/81 |
| 2004/0022548 | A1* | 2/2004 | Nagaoka | 399/16 |
| 2004/0136732 | A1 | 7/2004 | Okamoto et al. | |
| 2007/0147855 | A1 | 6/2007 | Shimada | |

FOREIGN PATENT DOCUMENTS

| | | | |
|---|---|---|---|
| JP | 62-255967 | A | 11/1987 |
| JP | 2-52834 | A | 2/1990 |
| JP | 7-244452 | A | 9/1995 |
| JP | 8-245062 | A | 9/1996 |
| JP | 11-52813 | A | 2/1999 |
| JP | 11-184324 | A | 7/1999 |
| JP | 11-212406 | A | 8/1999 |
| JP | 11-231729 | A | 8/1999 |
| JP | 2002-187332 | A | 7/2002 |
| JP | 2002-318509 | A | 10/2002 |
| JP | 2002-344682 | A | 11/2002 |
| JP | 2003-005734 | A | 1/2003 |
| JP | 2004-145083 | A | 5/2004 |
| JP | 2004-147173 | A | 5/2004 |

OTHER PUBLICATIONS

Examination issued in corresponding European patent application No. 05012149.0-1240, dated Nov. 26, 2007.

* cited by examiner

*FIG. 20*

SELECTION OF MAINTENANCE ITEM FOR FOLDING APPARATUS

ADJUST STOPPER POSITION

ADJUST FOLDING ROLLER PRESSURE

BACK OK

*FIG. 21*

| | SET VALUE | (RANGE) |
|---|---|---|
| FOLDING ROLLER PRESSURE | 5 | (1-20) |

BACK OK

FIG. 24

UNDER MAINTENANCE (PARTS BEING REPLACED)

• • • PLEASE PRESS COMPLETE WHEN
REPLACEMENT IS COMPLETE • • •

COMPLETE CANCEL

SWITCH TO MAIN SCREEN

FIG. 25

SUB-MAINTENANCE ADJUSTMENT

| | SET VALUE | (RANGE) |
|---|---|---|
| FOLDING ROLLER PRESSURE | 5 | (1-20) |

BACK OK

FIG. 28

| MODULE NAME | ITEM | MAINTENANCE ITEM | SUB-MAINTENANCE ITEM |
|---|---|---|---|
| FOLDING APPARATUS | REPLACEMENT | REPLACE FOLDING ROLLER | ADJUST FOLDING ROLLER PRESSURE |
| FOLDING APPARATUS | REPLACEMENT | REPLACE FOLDING CONVEYING ROLLER | |
| FOLDING APPARATUS | REPLACEMENT | REPLACE FIRST FOLDING STOPPER | ADJUST FIRST FOLDING POSITION |
| FOLDING APPARATUS | REPLACEMENT | REPLACE SECOND FOLDING STOPPER | ADJUST SECOND FOLDING POSITION |
| FOLDING APPARATUS | REPLACEMENT | REPLACE FOLDING CONVEYING SENSOR 1 | ADJUST FOLDING CONVEYING SENSOR 1 LIGHT AMOUNT |
| FOLDING APPARATUS | REPLACEMENT | REPLACE FOLDING CONVEYING SENSOR 2 | ADJUST FOLDING CONVEYING SENSOR 2 LIGHT AMOUNT |
| FOLDING APPARATUS | ADJUSTMENT | ADJUST FOLDING CONVEYING SENSOR 1 LIGHT AMOUNT | |
| FOLDING APPARATUS | ADJUSTMENT | ADJUST FOLDING CONVEYING SENSOR 2 LIGHT AMOUNT | |
| FOLDING APPARATUS | ADJUSTMENT | ADJUST FOLDING ROLLER PRESSURE | |
| FOLDING APPARATUS | ADJUSTMENT | ADJUST FIRST FOLDING POSITION | |
| FOLDING APPARATUS | ADJUSTMENT | ADJUST SECOND FOLDING POSITION | |
| FOLDING APPARATUS | CLEANING | CLEAN FOLDING ROLLER | |
| FOLDING APPARATUS | CLEANING | CLEAN FOLDING CONVEYING ROLLER | |
| FOLDING APPARATUS | CLEANING | CLEAN FIRST FOLDING STOPPER | |
| FOLDING APPARATUS | CLEANING | CLEAN SECOND FOLDING STOPPER | |
| FOLDING APPARATUS | CLEANING | CLEAN FOLDING CONVEYING SENSOR 1 | ADJUST FOLDING CONVEYING SENSOR 1 LIGHT AMOUNT |
| FOLDING APPARATUS | CLEANING | CLEAN FOLDING CONVEYING SENSOR 2 | ADJUST FOLDING CONVEYING SENSOR 2 LIGHT AMOUNT |

IMAGE FORMING SYSTEM, MAINTENANCE METHOD APPLIED THERETO, AND PROGRAM FOR CAUSING A COMPUTER TO IMPLEMENT THE MAINTENANCE METHOD

BACKGROUND OF THE INVENTION

1. Field of the Invention

The present invention relates to an image forming system where maintenance can be partially executed during execution of an image forming process, a maintenance method applied thereto, and a program for ca using a computer to implement the maintenance method.

2. Description of the Related Art

Conventionally, there has been provided an image forming system in which the main unit of an image forming apparatus, such as a copier, is connected to a post-processing apparatus, such as a finisher, to thereby realize a variety of post-processing required by users, such as a bundle discharging process, a stitching process, a folding process, or a binding process. The post processing apparatus normally executes a single type of post processing, with the post-processing apparatus required by the user being selected from a variety of types of post processing apparatuses and connected to an image forming apparatus.

With this kind of image forming system, external covers respectively provided on the image forming apparatus and the post-processing apparatus are opened or removed when a user clears a jam or a serviceman carries out maintenance such as replacement of parts, adjustments, or cleaning.

The external cover of the image forming apparatus completely covers a conveying path provided for a process that forms an image on a sheet fed from any of sheet cassettes, a conveying path provided for a process that discharges the sheet on which the image has been formed outside the apparatus, and a conveying path provided for a process where in double-sided recording mode, a sheet that has been reversed after single-sided image formation is conveyed to an image forming section once again. Accordingly, by merely opening or removing the external cover, it is possible to access all of the positions required for clearing a jam or carrying out maintenance. In the post-processing apparatus as well, the external cover is provided so as to cover all of the conveying paths inside the apparatus.

The external covers provided on the image forming apparatus and the post-processing apparatus are not opened or removed during a normal image forming operation, and should be opened or removed during a non-operational state in which a normal image forming operation is not carried out, such as maintenance or when a jam is cleared.

For this reason, as disclosed in Japanese Laid-Open Patent Publications (Kokai) No. H11-052813 and No. H07-244452, for example, when either of the external covers has been opened or removed during a normal image forming operation, it is assumed that an abnormal state has occurred and all operations of the image forming apparatus and the post-processing apparatus are stopped.

Meanwhile, to enable a single image forming system to execute a plurality of types of post-processing required by users, such as the bundle discharging process, the stitching process, the folding process, and the binding process, a plurality of post-processing apparatuses that are dedicated to the respective types of post-processing are connected in series to an image forming apparatus.

On the other hand, in the image forming apparatus and the post-processing apparatus, it is necessary to perform maintenance such as replacement of parts, adjustments, and cleaning whenever a predetermined number of sheets have been processed. However, in this kind of image forming system, all sheets do not pass the same conveying path. That is, the conveying path on which sheets are conveyed differs in accordance with user settings. In the case of the image forming apparatus main unit, for example, the conveying path on which sheets pass differs between single-sided recording mode and double-sided recording mode, and in the case of a plurality of post-processing apparatuses connected in series, the number of conveyed sheets that pass the conveying paths of the respective post-processing apparatuses differs between stitching mode, folding mode, and binding mode. For this reason, the timing of maintenance differs between the respective conveying paths of the image forming apparatus and the respective post-processing apparatuses in the image forming system. Also, out of the types of maintenance, in the case of replacement of parts for example, since the parts composing the conveying paths themselves wear out after respectively different numbers of sheets have passed, even if the same number of sheets have passed each of the conveying paths, the timing at which the parts on such conveying path are replaced differs.

However, the conventional image forming systems described above are designed so that if one of the external covers is opened or removed to perform maintenance, the operation of the entire image forming system is halted. Also, when a plurality of post-processing apparatuses are connected in series, to perform maintenance without stopping the operation of the entire image forming system, it is necessary to detach the post-processing apparatus to be subjected to maintenance from the image forming system and to repeat an initialization operation for causing a controller that controls the entire image forming system to recognize the connection state of the post-processing apparatuses after the detachment.

SUMMARY OF THE INVENTION

It is an object of the present invention to provide an image forming system and a maintenance method applied thereto, that make it possible to open or remove an external cover of an apparatus to perform maintenance on the apparatus even while the system is operating, and a program for causing a computer to implement the maintenance method.

To attain the above object, in a first aspect of the present invention, there is provided an image forming system that includes an image forming apparatus, a post-processing apparatus, and a display device, where maintenance can be partially executed during execution of an image forming process and post-processing, comprising a plurality of conveying paths provided inside the image forming apparatus and the post-processing apparatus, for conveying a sheet, a determining device that determines, out of the plurality of conveying paths, at least one conveying path which can be subjected to maintenance of at least part related to the conveying path, in accordance with types of the image forming process and the post-processing being executed, and a display control device that displays the conveying path for which the determining device has determined that the part related to the conveying path can be subjected to maintenance, on the display device.

Preferably, the image forming system comprises a plurality of external covers covering respective ones of the plurality of conveying paths, the plurality of external covers are independently controlled as to whether opening and closing thereof is to be permitted.

Preferably, when maintenance is being executed on the part related to the conveying path for which the determining device has determined that the part related to the conveying path can be subjected to maintenance, the display control device displays a screen showing that the maintenance is being executed on the display device.

More preferably, the image forming system comprises a plurality of jam detecting sensors provided on respective ones of the plurality of conveying paths.

More preferably, when a jam has been detected by any of the jam detecting sensors, the display control device displays a screen notifying the detected jam on the display device in place of the screen showing that the maintenance is being executed.

Alternatively, when a jam has been detected by any of the jam detecting sensors, the display control device displays information showing that the jam has occurred in the screen showing that the maintenance is being executed.

More preferably, in addition to displaying information showing that the jam has occurred in the screen showing that the maintenance is being executed, the display control device displays, in the screen showing that the maintenance is being executed, an operation key for switching the screen showing that the maintenance is being executed to a screen showing a content of the detected jam.

Preferably, the display control device displays, in the screen showing that the maintenance is being executed, an operation key for switching the screen showing that the maintenance is being executed to a screen showing a processing content of the image forming process or the post-processing.

More preferably, the display control device displays, in the screen showing the processing content of the image forming process or the post-processing, an operation key for switching the screen showing that the maintenance is being executed to a screen showing a processing content of the maintenance.

Preferably, the image forming system further comprises a second determining device operable when execution of a new image forming job has been requested while maintenance is being executed on the part related to the conveying path for which the determining device has determined that the part related to the conveying path can be subjected to maintenance, to determine whether the part related to the conveying path being subjected to maintenance presently being executed is to be used when the new image forming job is executed, and an inhibiting device operable when the second determining device has determined that the part related to the conveying path is to be used, to inhibit the execution of the new image forming job.

More preferably, the display control device displays an indication that the execution of the new image forming job is not possible when the judging device has determined that the part related to the conveying path is to be.

Preferably, the image forming system comprises a second determining device operable when execution of a new image forming job has been requested while maintenance is being executed on the part related to the conveying path for which the determining device has determined that the part related to the conveying path can be subjected to maintenance, to determine whether the part related to the conveying path being subjected to maintenance presently being executed is to be used when the new image forming job is executed, and an inhibiting device operable when the second determining device has determined that the part related to the conveying path is to be used, to inhibit use of the part related to the conveying path determined to be used by the second determining device, out of a plurality of parts related to conveying paths used by at least one of the image forming process and the post-processing.

Preferably, the image forming system comprises an inhibiting device operable when maintenance is being executed on the part related to the conveying path for which the determining device has determined that the part related to the conveying path can be subjected to maintenance, to inhibit use of the part related to the conveying path on which maintenance is being executed.

To attain the above object, in a second aspect of the present invention, there is provided a maintenance method applied to an image forming system that includes an image forming apparatus, and a post-processing apparatus, the image forming apparatus and the post-processing apparatus including a plurality of conveying paths that convey a sheet, and a display device, where maintenance can be partially executed during execution of an image forming process and post-processing, comprising a determining step of determining, out of the plurality of conveying paths, at least one conveying path which can be subjected to maintenance of at least part related to the conveying path, in accordance with types of the image forming process and the post-processing being executed, and a displaying step of displaying the conveying path for which it is determined in the determining step that the part related to the conveying path can be subjected to maintenance, on the display device.

Preferably, the image forming system includes a plurality of external covers covering respective ones of the plurality of conveying paths, the plurality of external covers are independently controlled as to whether opening and closing thereof is to be permitted.

Preferably, the maintenance method comprises a second displaying step of displaying a screen showing that maintenance is being executed on the display device when the maintenance is being executed on the part related to the conveying path for which it is determined in the determining step that the part related to the conveying path can be subjected to maintenance.

More preferably, the maintenance method comprises a first jam displaying step of displaying a screen notifying a detected jam on the display device in place of the screen displayed in the second displaying step when the jam has been detected by any of a plurality of jam detecting sensors provided on respective ones of the plurality of conveying paths.

Preferably, the maintenance method comprises a second determining step of determining whether the part related to the conveying path being subjected to maintenance presently being executed is to be used when a new image forming job is executed, when execution of the new image forming job has been requested while maintenance is being executed on the part related to the conveying path for which it is determined in the determining step that the part related to the conveying path can be subjected to maintenance, and an inhibiting step of inhibiting the execution of the new image forming job when it is determined the second determining step that the part related to the conveying path is to be used.

Alternatively, the maintenance method comprises a second determining step of determining whether the part related to the conveying path being subjected to maintenance presently being executed is to be used when a new image forming job is executed, when execution of the new image forming job has been requested while maintenance is being executed on the part related to the conveying path for which it is determined in the determining step that the part related to the conveying path can be subjected to maintenance, and an inhibiting step of inhibiting use of the part related to the conveying path determined to be used in the second determining step, out of a plurality of parts related to conveying paths used by at least one of the image forming process and the post-processing, when it is determined in the second determining step h that the part related to the conveying path is to be used.

To attain the above object, in a third aspect of the present invention, there is provided a program for causing a computer to execute a maintenance method applied to an image forming system that includes an image forming apparatus, and a post-processing apparatus, the image forming apparatus and the post-processing apparatus including a plurality of conveying paths that convey a sheet, and a display device, where maintenance can be partially executed during execution of an image forming process and post-processing, comprising a determining step of determining, out of the plurality of conveying paths, at least one a conveying path which can be subjected to maintenance of at least part related to the conveying path, in accordance with types of the image forming process and the post-processing being executed, and a displaying step of displaying the conveying path for which it is determined in the determining step that the part related to the conveying path can be subjected to maintenance, on the display device.

The above and other objects, features, and advantages of the invention will become more apparent from the following detailed description taken in conjunction with the accompanying drawings.

BRIEF DESCRIPTION OF THE DRAWINGS

FIG. 20 is a view showing a selection screen for detailed maintenance items displayed on the liquid crystal display section when "ADJUSTMENT" has been selected by the user in the selection screen for maintenance items shown in FIG. 19;

FIG. 21 is a view showing one example of a setting/execution screen displayed on the liquid crystal display section when the user has selected "ADJUST FOLDING ROLLER PRESSURE" in the selection screen for detailed maintenance items shown in FIG. 20;

FIG. 24 is a view showing a maintenance in-execution screen displayed on the liquid crystal display section when the user needs to input an indication that the selected maintenance is complete;

FIG. 25 is a view showing one example of a sub-maintenance setting/execution screen displayed on the liquid crystal display section when an "EXECUTE NEXT" key has been selected in the sub-maintenance continuation selection screen shown in FIG. 23;

FIG. 28 is a diagram showing one example of the relationship between maintenance items and sub-maintenance items in the folding apparatus;

DETAILED DESCRIPTION OF THE PREFERRED EMBODIMENTS

The present invention will now be described in detail below with reference to the drawings showing preferred embodiments thereof.

Figure 1:
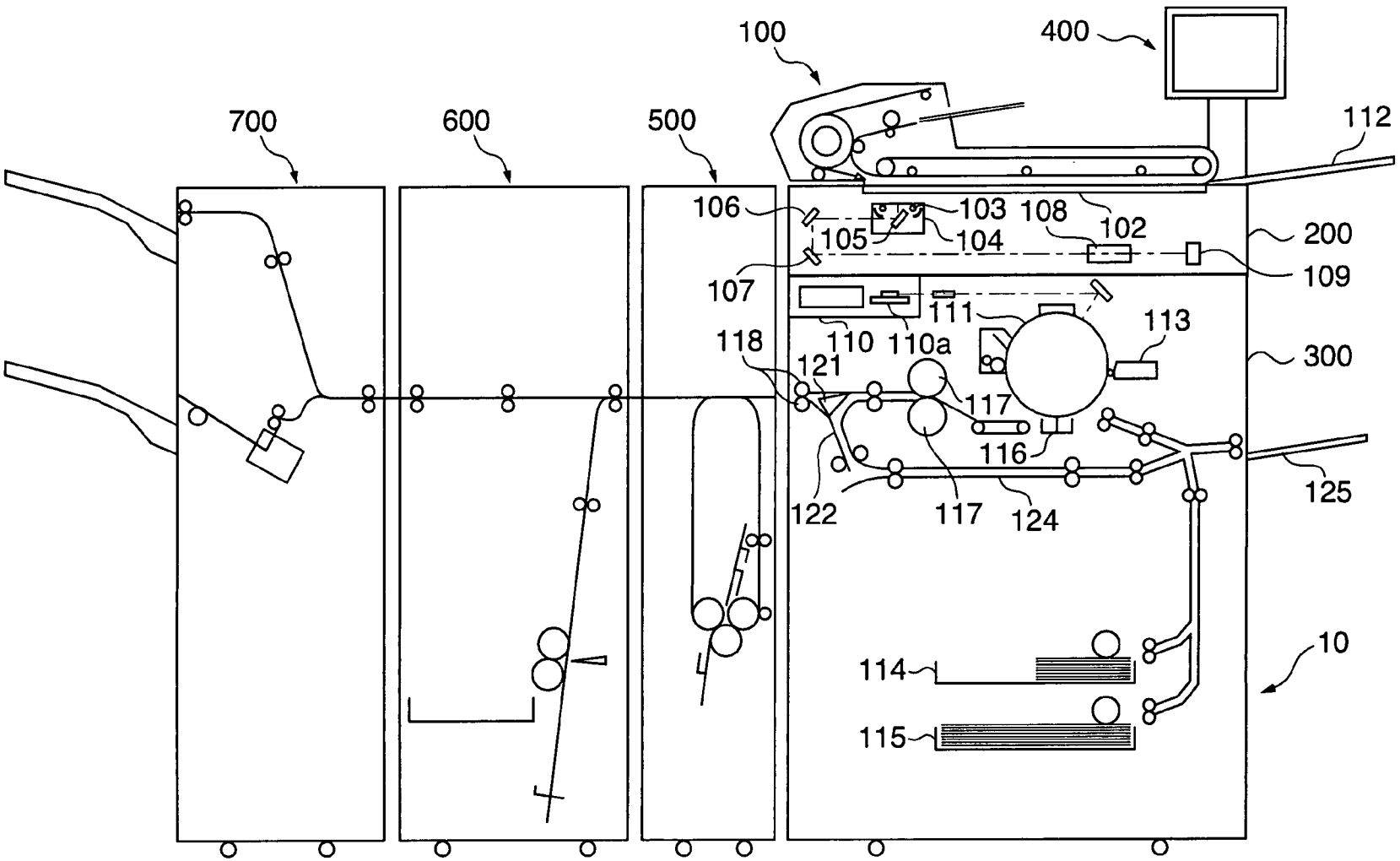
FIG. 1 is a longitudinal cross-sectional view showing the construction of principal parts of an image forming system according to a first embodiment of the present invention.

FIG. 1 is a longitudinal cross-sectional view showing the construction of principal parts of the image forming system according to a first embodiment of the present invention.

As shown in FIG. 1, the image forming system is comprised of an image forming apparatus main unit 10, a folding apparatus 500, a binding apparatus 600, and a finisher 700, with the image forming apparatus main unit 10 including an image reader 200 that reads an image of an original, and a printer 300. The folding apparatus 500, the binding apparatus 600, and the finisher 700 are post-processing apparatuses, and are connected in series to the image forming apparatus main unit 10.

An original feeding device 100 is mounted on the image reader 200. The original feeding device 100 feeds originals set face up on an original tray leftward as viewed in FIG. 1, one sheet at a time starting from a top page. Each original is conveyed via a curved path onto a platen glass 102 from the left and then conveyed to the right via a moving reading position. After this, the original is discharged to an external discharge tray 112. When each original passes the moving reading position on the platen glass 102 from the left to the right, an image of the original is read by a scanner unit 104 held at a position corresponding to the moving reading position. This reading method is generally referred to as a "moving original reading method". More specifically, when an original passes the moving reading position, light from the lamp 103 of the scanner unit 104 is irradiated onto a reading surface of the original and light reflected from the original is guided via mirrors 105, 106, and 107 to a lens 108. The light that has passed through the lens 108 forms an image on an image pickup plane of an image sensor 109.

In this way, by conveying an original from left to right at the moving reading position, the original is scanned (read) with a direction perpendicular to the conveying direction of the original as the main scanning direction and the conveying direction as the sub-scanning direction. That is, when the original passes the moving reading position, the image of the original is read in the main scanning direction by the image sensor 109 to generate one line of image data and by conveying the original in the sub-scanning direction, another line of image data is generated, thereby reading the entire original image. The image data outputted from the image sensor 109 is subjected to predetermined processing by an image signal controller 202, described later, and is inputted as a video signal to an exposure controller 110 of the printer 300.

Note that it is also possible to read the original by conveying the original with the original feeding device 100 onto the platen glass 102, stopping the original at a predetermined position, and causing the scanner unit 104 to move from left to right with the original in this state. This scanning method is called a "stationary original reading method".

When reading an original without using the original feeding device 100, first the user lifts up the original feeding device 100 and places the original on the platen glass 102. After this, the scanner unit 104 is caused to move from left to right to read the original. That is, when the original is read without using the original feeding device 100, the stationary original reading method is executed.

Next, in the printer 300, the exposure controller 110 outputs laser light modulated based on the inputted video signal with the laser light being incident on a photosensitive drum 111 while being deflected by a polygon mirror 110*a*. An electrostatic latent image is formed on the photosensitive drum 111 in accordance with the incident laser light. Here, as described later, when the stationary original reading method is used, the exposure controller 110 outputs laser light to form a normal image (an image that is not a mirror image).

The electrostatic latent image on the photosensitive drum 111 is developed as a developer image using a developer (toner) supplied by a developing device 113. In addition, in timing synchronized with the start of emission of laser light, a sheet is fed from one of cassettes 114, 115, a manual feeding section 125, and a double-sided conveying path 124, and is conveyed between the photosensitive drum 111 and a transfer section 116. The developer image formed on the photosensitive drum 111 is transferred by the transfer section 116 onto the fed sheet.

The sheet onto which the developer image has been transferred is conveyed to a fixing section 117 and the fixing section 117 fixes the developer image onto the sheet by applying heat and pressure to the sheet. The sheet that has passed the fixing section 117 is discharged via a flapper 121 and discharge rollers 118 from the printer 300 to the outside (to the folding apparatus 500).

When the sheet is discharged in a state where the surface on which the image has been formed faces down, after passing the fixing section 117, the sheet is guided to an inverting path 122 by a switching operation of the flapper 121, and when a trailing end of the sheet has passed the flapper 121, the sheet is switched back and is discharged from the printer 300 by the discharge rollers 118. Hereinafter, this discharge state will be referred to as "inverted discharge". Inverted discharge can be effectively used when performing image formation in order from a first page, such as when images are formed after reading a multiple page original using the original feeding device 100 or when image formation is performed based on a plurality of pages of image data outputted from a computer, and discharging sheets without inversion would otherwise result in the page order of a plurality of sheets being inversed.

When a stiff sheet such as an OHP sheet is fed from the manual feeding section 125 and an image is formed on the sheet, the sheet is not guided to the inverting path 122 and is discharged by the discharge rollers 118 in a state where the surface on which an image has been formed faces up.

In addition, when double-sided recording mode where image formation is performed on both surfaces of a sheet is set, control is carried out so that after a sheet has been guided to the inverting path 122 by a switching operation of the flapper 121, the sheet is conveyed to the double-sided conveying path 124, and the sheet that has been guided to the double-sided conveying path 124 is fed again between the photosensitive drum 111 and the transfer section 116 in the timing mentioned above.

The sheet discharged from the printer 300 is sent to the folding apparatus 500. The folding apparatus 500 performs a process that folds the sheet in a Z shape. For example, when a folding process has been designated for a sheet that is A3 or B4 size, the sheet is subjected to the folding process by the folding apparatus 500, while in other cases, the sheet discharged from the printer 300 passes through the folding apparatus 500 and is sent to the binding apparatus 600 and then to the finisher 700.

The binding apparatus 600 folds sheets in half and performs a binding process. In the finisher 700, processes such as a stitching process are performed.

An operation display device 400 includes a plurality of keys that set various functions relating to image formation, a display section for displaying information showing a setting state, and so forth.

Next, the construction of a controller that controls the entire image forming system will be described with reference to FIG. 2.

Figure 2:
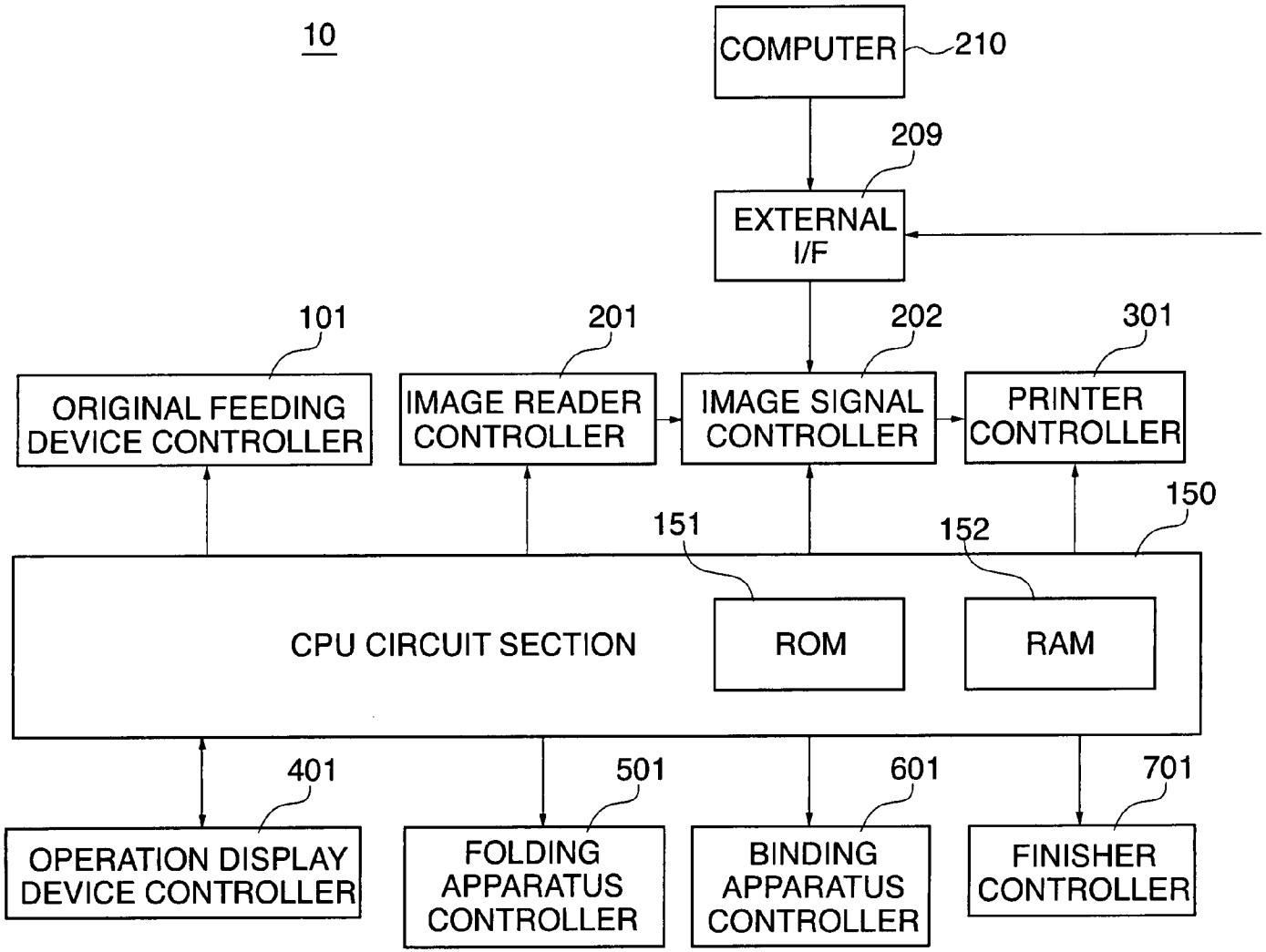
FIG. 2 is a block diagram showing the construction of a controller that controls the image forming system shown in FIG. 1.

FIG. 2 is a block diagram showing the construction of the controller that controls the image forming system shown in FIG. 1.

As shown in FIG. 2, the controller includes a CPU circuit section 150 in which a CPU (not shown), a ROM 151, and a RAM 152 are incorporated, and collectively controls respective blocks 101, 201, 202, 209, 301, 401, 501, 601, and 701 according to control programs stored in the ROM 151. The RAM 152 temporarily stores control data and is used as a work area for computational processing that accompanies control operations.

An original feeding device controller 101 performs drive control of the original feeding device 100 based on instructions from the CPU circuit section 150. An image reader controller 201 performs drive control of the scanner unit 104, the image sensor 109, and others, and transfers an analog image signal outputted from the image sensor 109 to the image signal controller 202.

The image signal controller 202 converts the analog image signal from the image sensor 109 to a digital signal, then executes various kinds of image processing, converts the digital signal to a video signal, and outputs the video signal to a printer controller 301. The image signal controller 202 also executes various kinds of image processing on a digital signal inputted from a computer 210 via an external I/F 209, converts the digital signal to a video signal, and outputs the video signal to the printer controller 301. Processing operations by the image signal controller 202 are controlled by the CPU circuit section 150. The printer controller 301 drives the exposure controller 110 based on the inputted video signal.

An operation display device controller 401 exchanges information between the operation display device 400 and the CPU circuit section 150. The operation display device 400 outputs key signals corresponding to respective operations of the plurality of keys to the CPU circuit section 150, and displays corresponding information based on signals from the CPU circuit section 150 on the display section.

A folding apparatus controller 501 is installed in the folding apparatus 500 and performs drive control of the entire folding apparatus 500 by exchanging information with the CPU circuit section 150.

A binding apparatus controller 601 is installed in the binding apparatus 600 and performs drive control of the entire binding apparatus 600 by exchanging information with the CPU circuit section 150.

A finisher controller 701 is installed in the finisher 700, and performs drive control of the entire finisher 700 by exchanging information with the CPU circuit section 150. Such control will be described later.

Next, the respective internal constructions of the folding apparatus 500, the binding apparatus 600, and the finisher 700 will be described with reference to FIG. 3.

Figure 3:
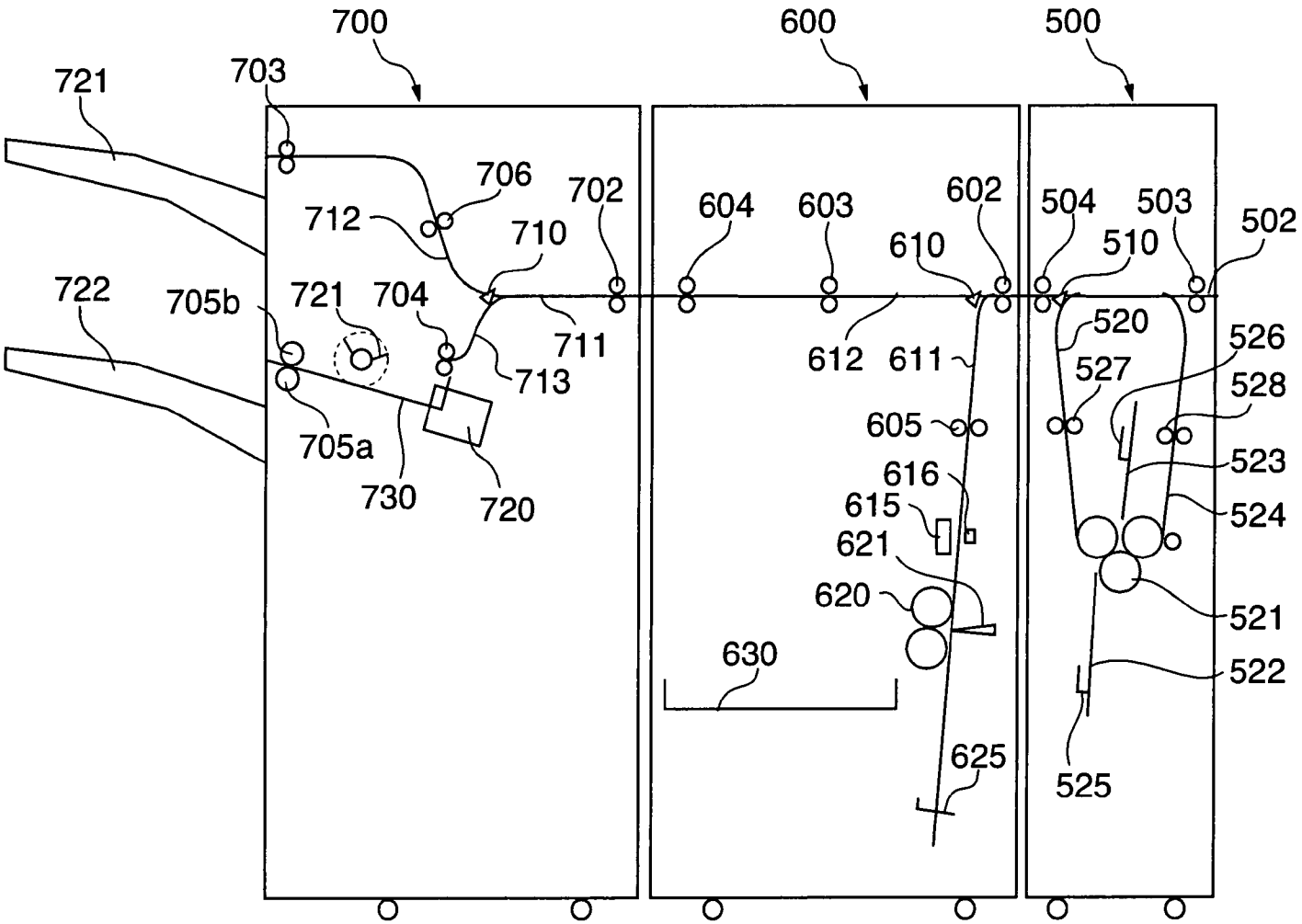
FIG. 3 is a longitudinal cross-sectional view showing the internal constructions of a folding apparatus, a binding apparatus, and a finisher appearing in FIG. 1.

FIG. 3 is a longitudinal cross-sectional view showing the internal constructions of the folding apparatus 500, the binding apparatus 600, and the finisher 700 appearing in FIG. 1.

As shown in FIG. 3, the folding apparatus 500 has a folding conveying horizontal path 502 for receiving a sheet discharged from the printer 300 (see FIG. 1) and guiding the sheet toward the binding apparatus 600. A pair of conveying rollers 503 and a pair of conveying rollers 504 are provided on the folding conveying horizontal path 502. A folding path selection flapper 510 is also provided at an exit end (the binding apparatus 600 side) of the folding conveying horizontal path 502. The folding path selection flapper 510 performs a switching operation for guiding a sheet on the folding conveying horizontal path 502 to a folding path 520 or to the binding apparatus 600.

Here, when a folding process is performed, the folding path selection flapper 510 is turned on and the sheet is guided to the folding path 520. The sheet guided to the folding path 520 is guided to a folding path 522 and the sheet is conveyed until a leading end thereof reaches the first folding stopper 522. After this, the sheet is guided to a folding path 523 by a folding roller 521 and simultaneously is folded at one-quarter of the sheet from the trailing en, with the sheet being then conveyed until the leading end reaches a second folding stopper 526. In addition, the folding roller 521 guides the sheet to a folding path 524 and simultaneously is folded at a central part thereof in a Z shape. On the other hand, when the folding process is not performed, the folding path selection flapper 510 is turned off and the sheet is sent from the printer 300 directly to the binding apparatus 600 via the folding conveying horizontal path 502.

The binding apparatus 600 has a binding horizontal path 612 for receiving a sheet discharged via the folding apparatus 500 and guiding the sheet toward the finisher 700. Pairs of conveying rollers 602, 603, and 604 are provided on the binding horizontal path 612. In addition, a binding path selection flapper 610 is provided at an inlet end (the folding apparatus 500 side) of the binding horizontal path 612. The binding path selection flapper 610 performs a switching operation for guiding the sheet on the binding horizontal path 612 to a binding path 611 or to the finisher 700.

Here, when a binding process is performed, the binding path selection flapper 610 is turned on and sheets are guided to the binding path 611. The sheets guided to the binding path 611 are conveyed by a pair of conveying rollers 605 until the leading ends of the sheets contact a sheet positioning member 625 that is movable. Two pairs of staplers 615 are provided at intermediate positions on the binding path 611, and the staplers 615 are disposed to operate in cooperation with anvils 616 that face the staplers 615 to bind the sheets at a center thereof into a sheet bundle.

A pair of folding rollers 620 is provided at a position downstream of the staplers 615. A projecting member 621 is provided at a position facing the folding rollers 620. By pressing out the projecting member 621 toward the sheet bundle stored on the binding path 611, the sheet bundle is pushed out between the folding rollers 620 and is discharged to a binding discharge tray 630 after being folded over by the folding rollers 620.

When the sheet bundle bound by the staplers 615 is folded, the sheet positioning member 625 is lowered by a predetermined distance so that the stapled position of the sheet bundle after the stapling process is complete coincides with a central part of the folding rollers 620.

When the binding process is not performed, the binding path selection flapper 610 is turned off and sheets are sent from the folding apparatus 500 to the finisher 700 via the binding horizontal path 612.

The finisher 700 receives sheets discharged via the folding apparatus 500 and the binding apparatus 600 in order and performs various kinds of sheet post-processing, such as a bundling process that aligns a received plurality of sheets into a single bundle, a stapling process that stitches a rear end of the produced sheet bundle using staples, a sort process, and a non-sort process.

As shown in FIG. 3, the finisher 700 includes a pair of input rollers 702 that guide sheets discharged from the printer 300 via the folding apparatus 500 and the binding apparatus 600 into the finisher 700. The sheets conveyed by the input rollers 702 are guided to a finisher path 711. A switching flapper 710 is disposed downstream of the finisher path 711. The switching flapper 710 guides the sheets to a non-sort path 712 or a sort path 713.

When the non-sort process is performed, the switching flapper 710 is turned on so that the sheets are guided to the non-sort path 712 and are discharged onto a sample tray 721 via a pair of conveying rollers 706 and non-sort discharge rollers 703 provided on the non-sort path 712.

On the other hand, when the stapling process or the sort process is performed, the switching flapper 710 is turned off and the sheets are guided to the sort path 713. The sheets guided to the sort path 713 are stacked on an intermediate tray 730 via sort discharge rollers 704.

The sheets stacked in a bundle on the intermediate tray 730 are subjected as necessary to an aligning process, the stapling process, and the like, and are then discharged onto a stack tray 722 by discharge rollers 705*a*, 705*b*. A stapler 720 is used for the stapling process that stitches the sheets stacked in a bundle on the intermediate tray 730. The operation of the stapler 720 will be described later. The stack tray 722 is capable of moving up and down.

Next, the construction of the folding apparatus controller 501 that performs drive control of the folding apparatus 500 will be described with reference to FIG. 4.

Figure 4:
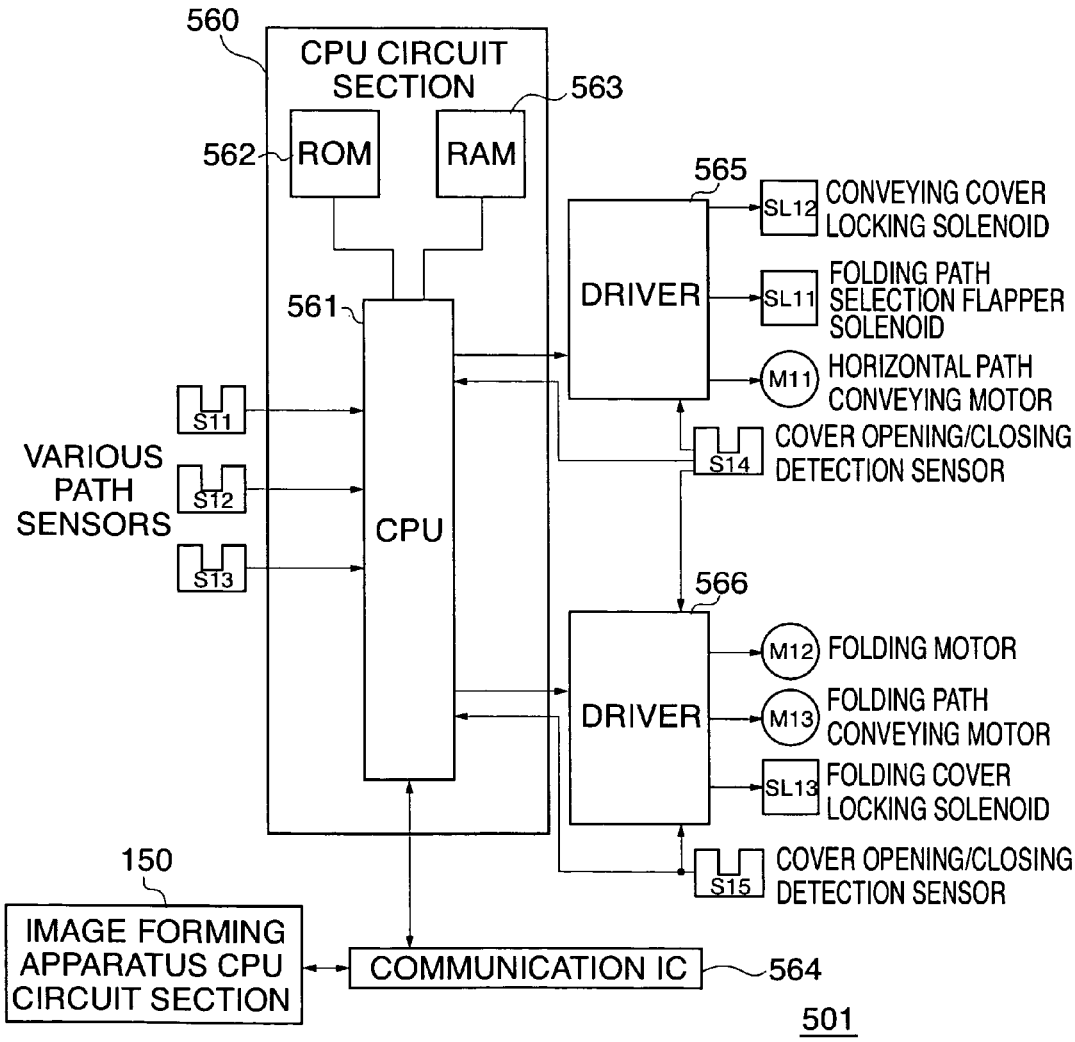
FIG. 4 is a block diagram showing the internal construction of a folding apparatus controller appearing in FIG. 2.

FIG. 4 is a block diagram showing the internal construction of the folding apparatus controller 501 appearing in FIG. 2.

As shown in FIG. 4, the folding apparatus controller 501 includes a CPU circuit section 560 comprised of a CPU 561, a ROM 562, and a RAM 563. The CPU circuit section 560 communicates and exchanges data via a communication IC 564 with the CPU circuit section 150 provided in the image forming apparatus main unit 10 and performs drive control of the folding apparatus 500 by executing various programs stored in the ROM 562 based on instructions from the CPU circuit section 150.

When the folding apparatus 500 is drivingly controlled, detection signals from various path sensors S11 to S13 and cover opening/closing detection sensors S14, S15 are inputted to the CPU circuit section 560. Drivers 565, 566 are connected to the CPU circuit section 560, with the driver 565 driving a motor and solenoid, described later, of a conveying function module based on a signal from the CPU circuit section 560 and the driver 566 driving a motor, described later, of a folding function module based on a signal from the CPU circuit section 560.

Here, a horizontal path conveying motor M11, which is a driving source for the conveying rollers 503, 504, and a solenoid SL11, which switches the folding path selection flapper 510, compose the conveying function module.

A folding motor M12, which is a driving source for the folding roller 521, and a folding path conveying motor M13, which is a driving source for the conveying rollers 527, 528, compose the folding function module.

The various path sensors S11 to S13 detect delays and jams of sheets being conveyed.

The cover opening/closing detection sensor S14 detects whether a cover 551 (described later with reference to FIG. 7) is open or closed. When detecting according to a detection signal from the sensor S14 that the cover 551 is open, the CPU circuit section 560 turns off power supply to the driver 565 to forcibly stop the driving of the conveying function module. At the same time, the CPU circuit section 560 also turns off power supply to the driver 566 to forcibly stop the driving of the folding function module.

The cover opening/closing detection sensor S15 detects whether a cover 552 (described later with reference to FIG. 7) is open or closed. When detecting according to a detection signal from the sensor S15 that the cover 552 is open, the CPU circuit section 560 turns off power supply to the driver 566 to forcibly stop the driving of the folding function module.

A conveying cover locking solenoid SL12 and a folding cover locking solenoid SL13 are provided to restrict opening and closing of the respective covers 551 and 552.

Next, the internal construction of the binding apparatus controller 601 that performs drive control of the binding apparatus 600 will be described with reference to FIG. 5.

Figure 5:
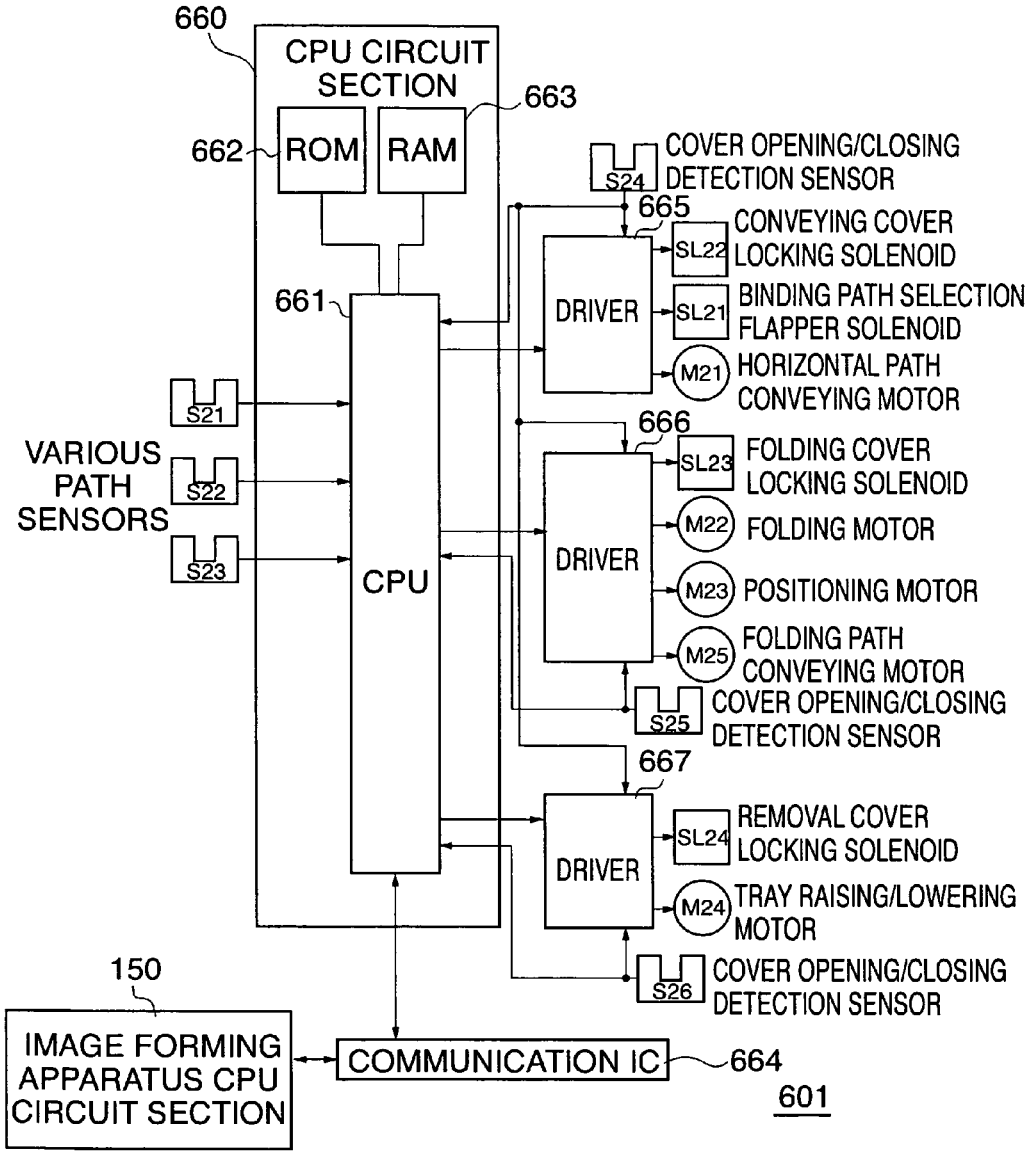
FIG. 5 is a block diagram showing the internal construction of a binding apparatus controller appearing in FIG. 2.

FIG. 5 is a block diagram showing the internal construction of the binding apparatus controller 601 appearing in FIG. 2.

As shown in FIG. 5, the binding apparatus controller 601 includes a CPU circuit section 660 comprised of a CPU 661, a ROM 662, and a RAM 663. The CPU circuit section 660 communicates and exchanges data via a communication IC 664 with the CPU circuit section 150 provided in the image forming apparatus main unit 10 and performs drive control of the binding apparatus 600 by executing various programs stored in the ROM 662 based on instructions from the CPU circuit section 150.

When the binding apparatus 600 is drivingly controlled, detection signals from various path sensors S21 to S23 and cover opening/closing detection sensors S24 to S26 are inputted to the CPU circuit section 660. Drivers 665, 666, and 667 are connected to the CPU circuit section 660, with the driver 665 driving a motor and solenoid, described later, of a conveying function module based on a signal from the CPU circuit section 660, the driver 666 driving a motor, described later, of a binding function module based on a signal from the CPU circuit section 660, and the driver 667 driving a motor, described later, of a stacking function module based on a signal from the CPU circuit section 660.

Here, a horizontal path conveying motor M21, which is a driving source for the conveying rollers 602, 603, and 604, and a solenoid SL21 that switches the binding path selection flapper 610 compose the conveying function module.

A folding motor M22, which is a driving source for the folding rollers 620, a folding path conveying motor M25, which is a driving source for the conveying rollers 605, and a positioning motor M23, which is a driving source for the sheet positioning member 625 compose the binding function module.

A tray raising/lowering motor M24 that is a driving source for the binding discharge tray 630 composes the stacking function module.

The various path sensors S21 to S23 detect delays and jams for sheets being conveyed.

The cover opening/closing detection sensor S24 detects whether a cover 651 (described later with reference to FIG. 7) is open or closed. According to a detection signal from the sensor S24, the CPU circuit section 660 turns off power supply to the driver 665 to forcibly stop the driving of the conveying function module. At the same time, the CPU circuit section 660 turns off power supply to the drivers 666 and 667 to forcibly stop all driving of the binding apparatus 600.

The cover opening/closing detection sensor S25 detects whether a cover 652 (described later with reference to FIG. 7) is open or closed. According to a detection signal from the sensor S25, the CPU circuit section 660 turns off power supply to the driver 666 to forcibly stop the driving of the binding function module.

The cover opening/closing detection sensor S26 detects whether a cover 653 (described later with reference to FIG. 7) is open or closed. According to a detection signal from the sensor S26, the CPU circuit section 660 turns off power supply to the driver 667 to forcibly stop the driving of the stacking function module.

A conveying cover locking solenoid SL22, a folding cover locking solenoid SL23, and a removal cover locking solenoid SL24 are provided to restrict opening and closing of the respective covers 651, 652, and 653.

Next, the internal construction of the finisher controller 701 that performs drive control of the finisher 700 will be described with reference to FIG. 6.

Figure 6:
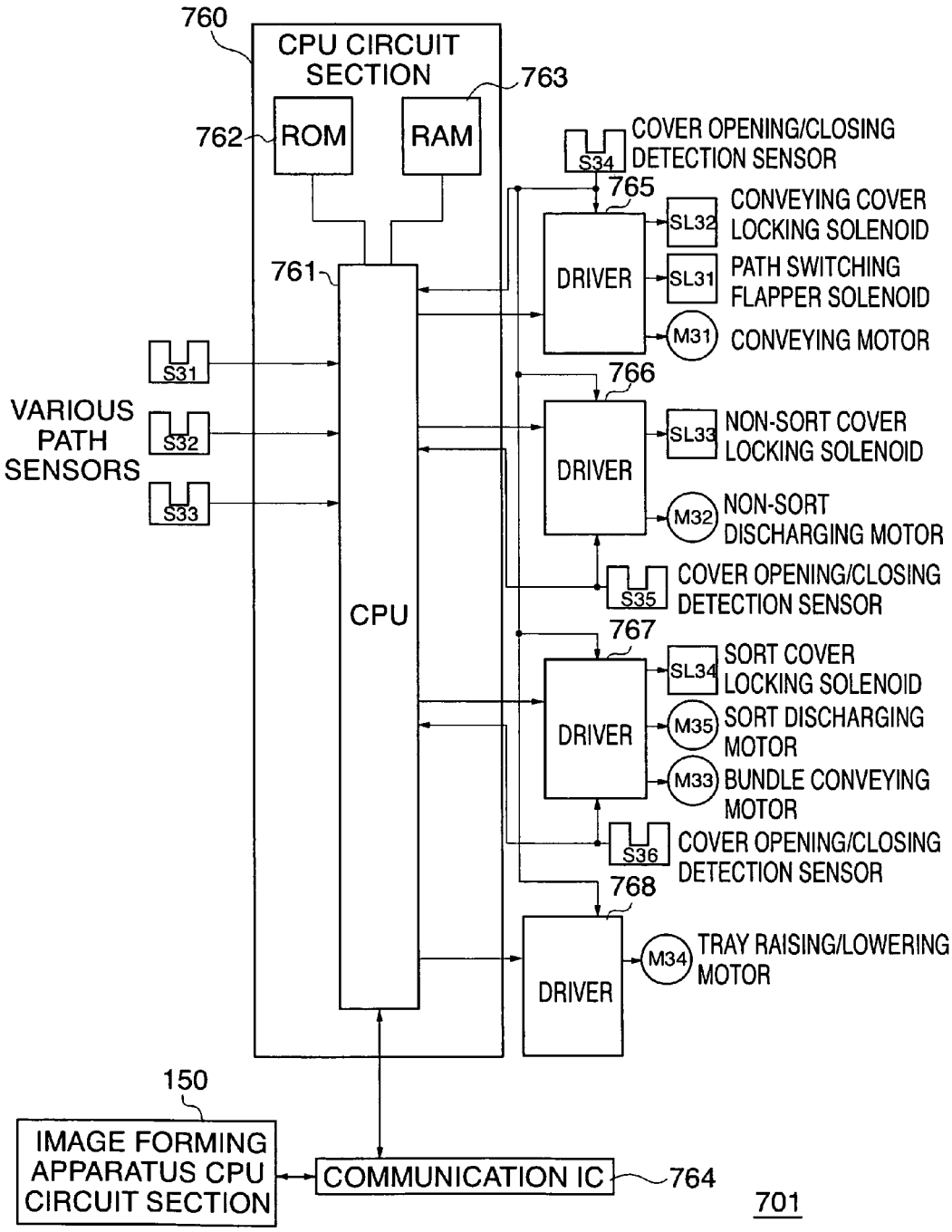
FIG. 6 is a block diagram showing the internal construction of a finisher controller appearing in FIG. 2.

FIG. 6 is a block diagram showing the internal construction of the finisher controller 701 appearing in FIG. 2.

As shown in FIG. 6, the finisher controller 701 includes a CPU circuit section 760 comprised of a CPU 761, a ROM 762, and a RAM 763. The CPU circuit section 760 communicates and exchanges data via a communication IC 764 with the CPU circuit section 150 provided in the image forming apparatus main unit 10 and performs drive control of the finisher 700 by executing various programs stored in the ROM 762 based on instructions from the CPU circuit section 150.

When the finisher 700 is drivingly controlled, detection signals from various path sensors S31 to S33 and cover opening/closing detection sensors S34 to S36 are inputted to the CPU circuit section 760. Drivers 765, 766, 767 and 768 are connected to the CPU circuit section 760, with the driver 765 driving a motor and solenoid, described later, of a conveying function module based on a signal from the CPU circuit section 760, the driver 766 driving a motor, described later, of a non-sort discharging function module based on a signal from the CPU circuit section 760, the driver 767 driving a motor, described later, of a sort discharging function module based on a signal from the CPU circuit section 760, and the driver 768 driving a motor, described later, of a stacking function module based on a signal from the CPU circuit section 760.

Here, a conveying motor M31, which is a driving source for the input rollers 702, and a solenoid SL31 that switches the path switching flapper 710 compose the conveying function module.

A discharging motor M32 that is a driving source for the conveying rollers 706 and the non-sort discharge rollers 703 composes the non-sort discharging function module.

A sort discharging motor M35, which is a driving source for the sort discharge roller 704, and a bundle conveying motor M33, which is a driving source for the bundle discharge rollers 705*a*, 705*b* compose the sort discharging function module.

A tray raising/lowering motor M34 that is a driving source for the stack tray 722 composes the stacking function module.

The conveying motor M31, the non-sort discharging motor M32, and the sort discharging motor M35 are composed of stepping motors, and by controlling the excitation pulse rate, the rollers driven by the respective motors can be driven at equal speed or at independent speeds. The bundle conveying motor M33 is composed of a DC motor.

The cover opening/closing detection sensor S34 detects whether a cover 751 (described later with reference to FIG. 7) is open or closed. When detecting according to a detection signal from the sensor S34 that the cover 751 is open, the CPU circuit section 760 turns off power supply to the driver 765 to forcibly stop the driving of the conveying function module. At the same time, the CPU circuit section 760 turns off power supply to the drivers 766, 767, and 768 to forcibly stop all driving of the finisher 700.

The cover opening/closing detection sensor S35 detects whether a cover 752 (described later with reference to FIG. 7) is open or closed. When detecting according to a detection signal from the sensor S35 that the cover 752 is open, the CPU circuit section 760 turns off power supply to the driver 766 to forcibly stop the driving of only the non-sort discharging function module.

The cover opening/closing detection sensor S36 detects whether a cover 753 (described later with reference to FIG. 7)

is open or closed. When detecting according to a detection signal from the sensor S36 that the cover 753 is open, the CPU circuit section 760 turns off power supply to the driver 767 to forcibly stop the driving of only the sort discharging function module.

A conveying cover locking solenoid SL32, a non-sort cover locking solenoid SL33, and a sort cover locking solenoid SL34 are provided to restrict opening and closing of the respective covers 751, 752, and 753.

Figure 7:
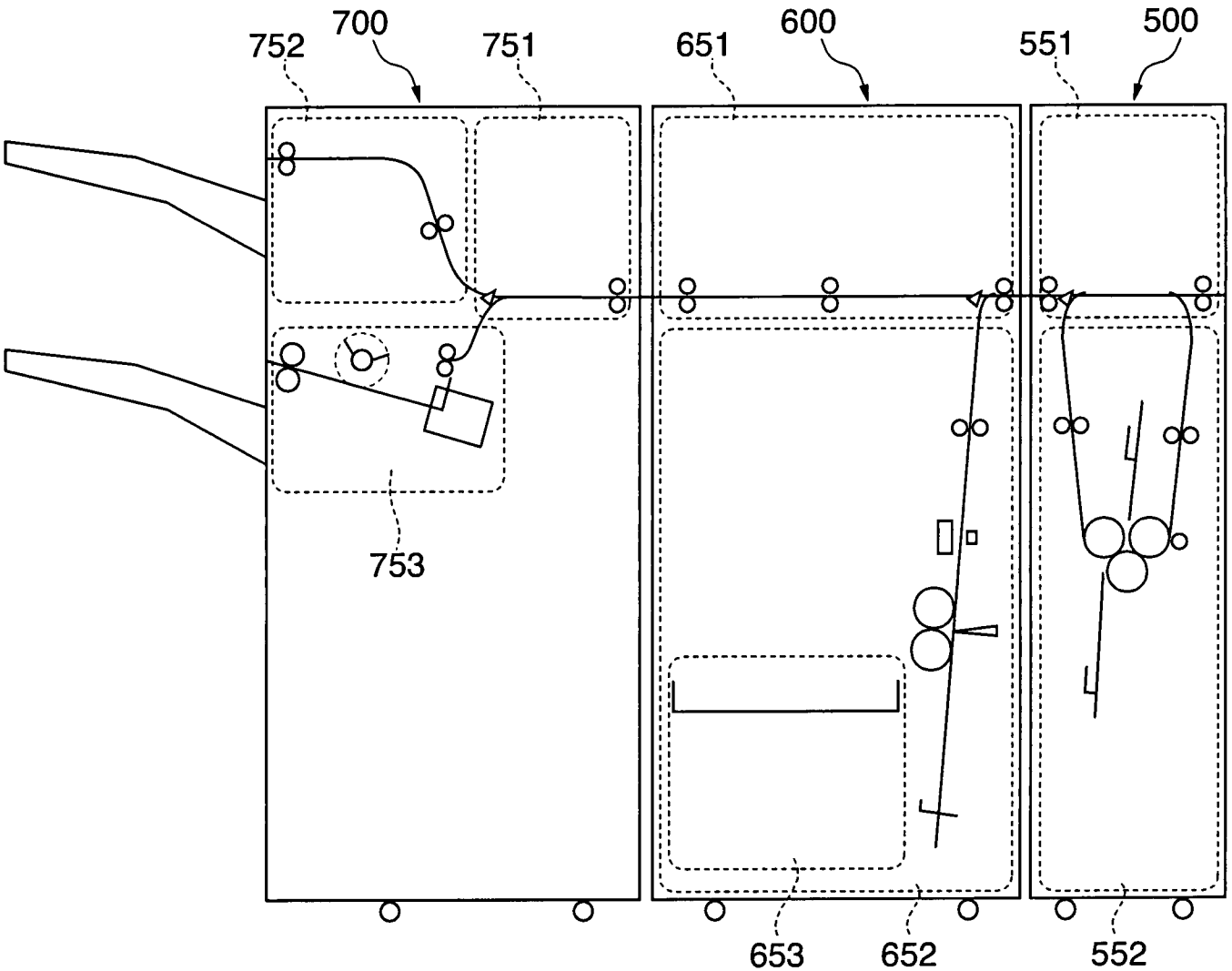
FIG. 7 is a view showing how external covers of the folding apparatus, the binding apparatus, and the finisher are disposed.

FIG. 7 is a view showing how the external covers of the folding apparatus 500, the binding apparatus 600, and the finisher 700 are disposed.

The binding apparatus 600 includes the cover 651 that covers a binding horizontal path section including the binding horizontal path 612 (see FIG. 3) and the cover 652 that covers a binding processing section 640 (see FIG. 9) including the binding path 611 (see FIG. 3). The cover 651 and the cover 652 can be independently opened and closed. The covers 651 and 652 are opened and closed when clearing a jam or during maintenance such as replacement of parts, cleaning, or adjustment.

Figures 8A, 8B:
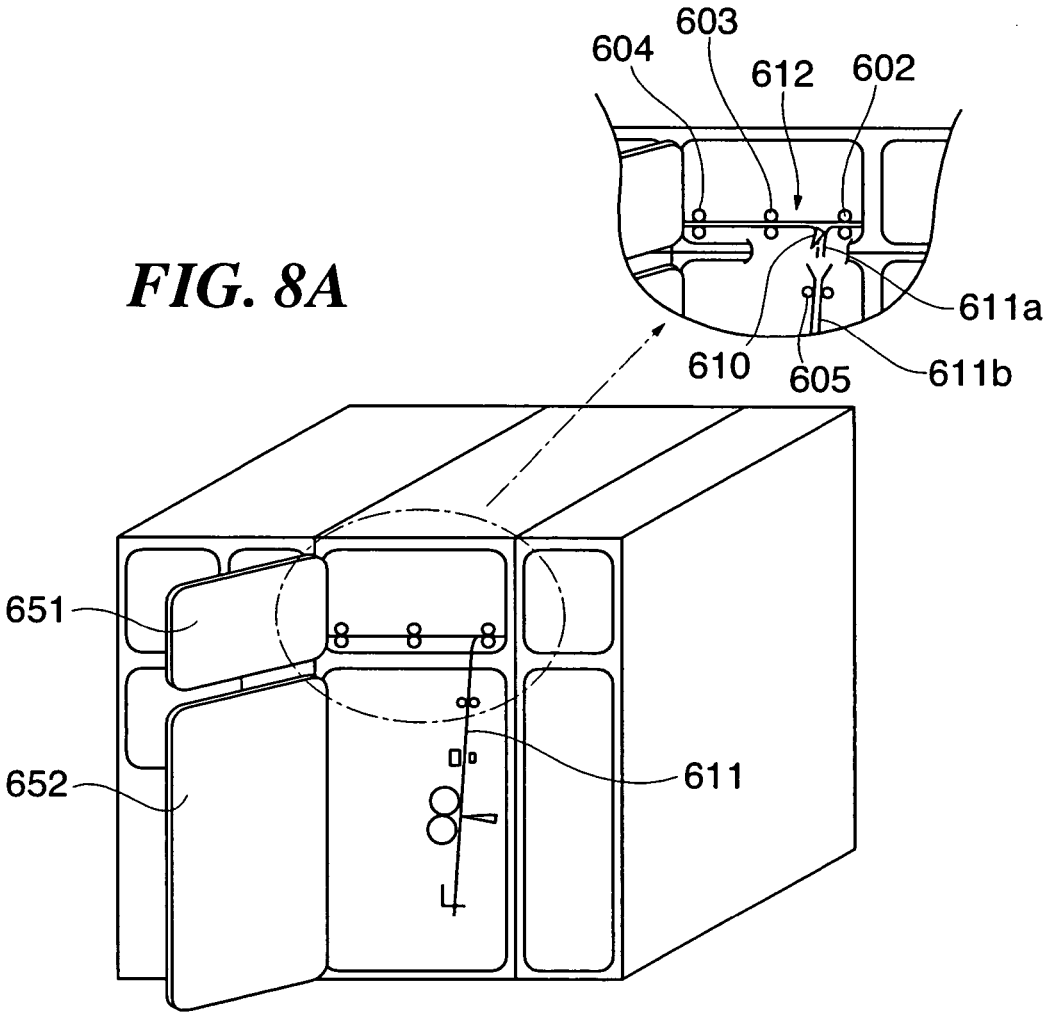
FIGS. 8A and 8B are perspective views showing a part where a binding horizontal section and a binding processing section in the binding apparatus meet.

FIGS. 8A and 8B are perspective views showing a part where the binding horizontal section and the binding processing section 640 in the binding apparatus 600 meet.

The binding path 611 is divided into an upper part 611*a* provided on the binding horizontal section side and a lower part 611*b* provided on the binding processing section 640 side. The binding path selection flapper 610 is provided on the binding horizontal section.

Figure 9:
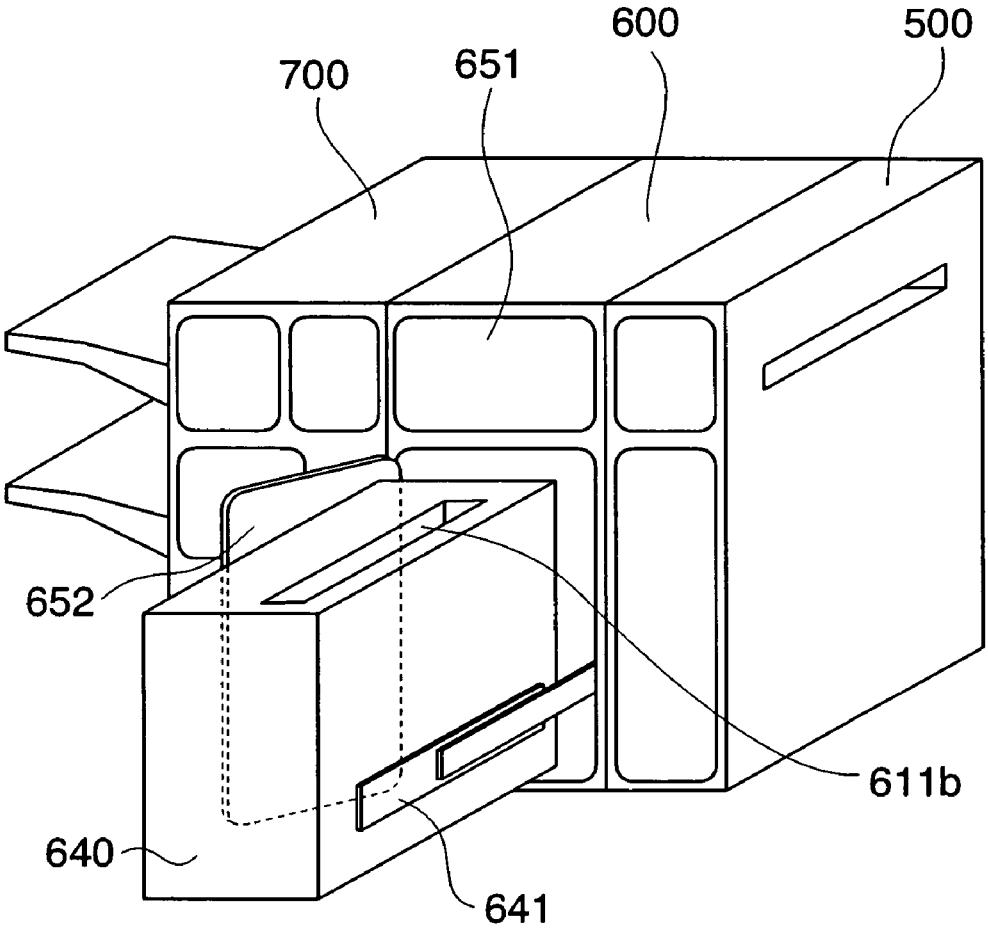
FIG. 9 is a perspective view showing a state where the cover of the binding apparatus has been opened and a binding processing section has been drawn from a body of the binding apparatus.

FIG. 9 is a perspective view showing a state where the cover 652 of the binding apparatus 600 has been opened and the binding processing section 640 has been drawn from a body of the binding apparatus 600.

The binding processing section 640 is connected to the body of the binding apparatus 600 by two slide rails 641 on the left and right and is removable by drawing. When the binding processing section 640 is drawn out, the binding path lower part 611*b* and the pair of conveying rollers 605, the staplers 615, and the folding rollers 620 (see FIG. 3) disposed downstream of the lower part 611*b* are all exposed to the outside for access.

Figure 10:
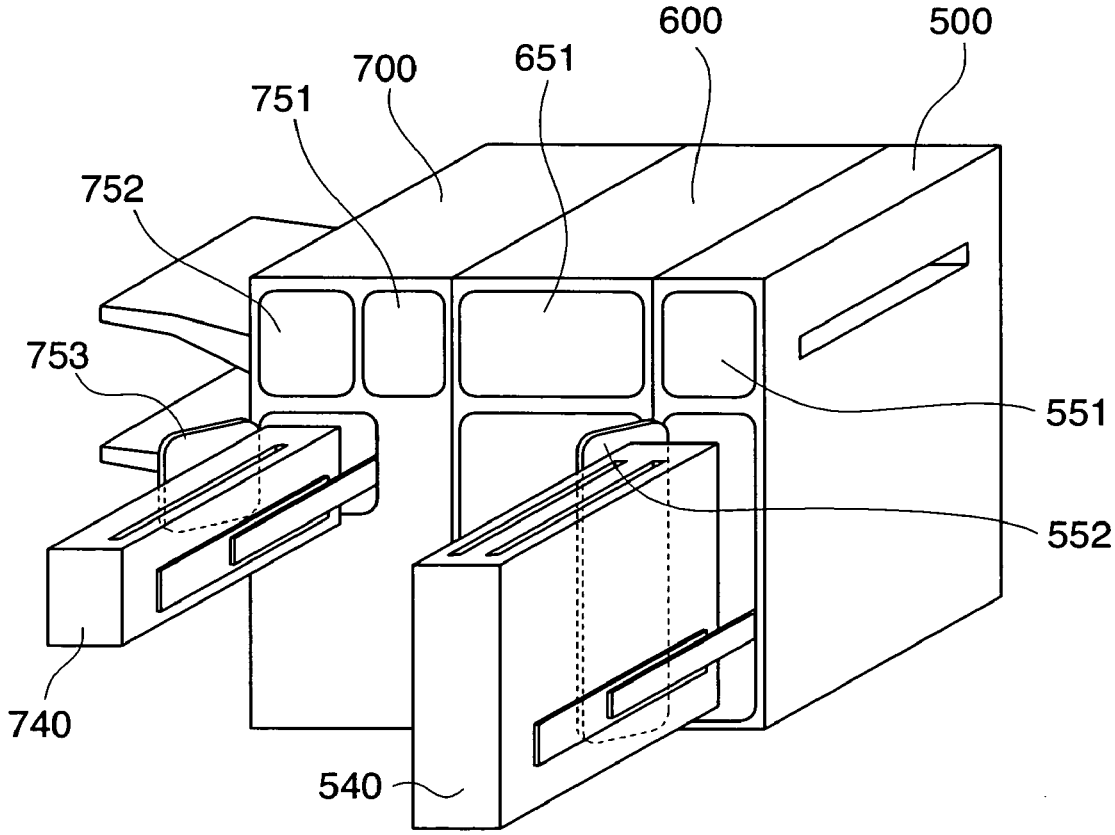
FIG. 10 is a perspective view showing a state where a folding processing section of the folding apparatus and a sort processing section of the finisher have been drawn from bodies of the respective apparatuses.

FIG. 10 is a perspective view showing a state where a folding processing section 540 of the folding apparatus 500 and a sort processing section 740 of the finisher 700 have been drawn from main bodies of the respective apparatuses.

Like the binding processing section 640 appearing in FIG. 9, the folding processing section 540 and the sort processing section 740 can be drawn out by opening the respective covers 552 and 753.

The respective covers are provided with lock mechanisms, described later, and when maintenance is possible, the respective locks are released so that it becomes possible to open and close the covers. When maintenance is not possible, the covers are locked so that the covers cannot be opened.

Since the constructions of the lock mechanisms of the covers 551, 552, 651, 652, 751, 752, and 753 are substantially the same, the locking mechanisms will be described with the cover 552 provided on the folding processing section 540 of the folding apparatus 500 as a representative example.

Figure 11:
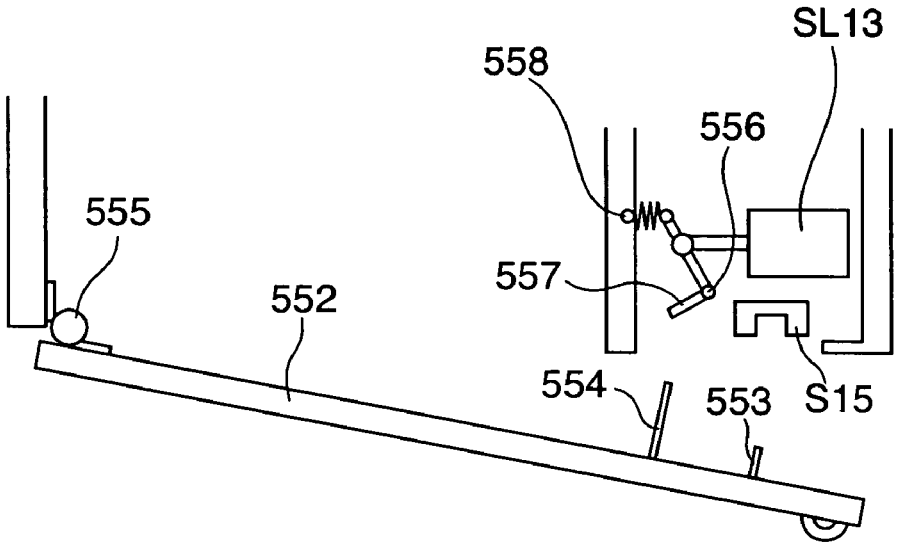
FIG. 11 is a view showing an opening/closing detection mechanism and a door lock mechanism of the cover provided on the folding apparatus in a state where a door can be opened and closed.
Figure 12:
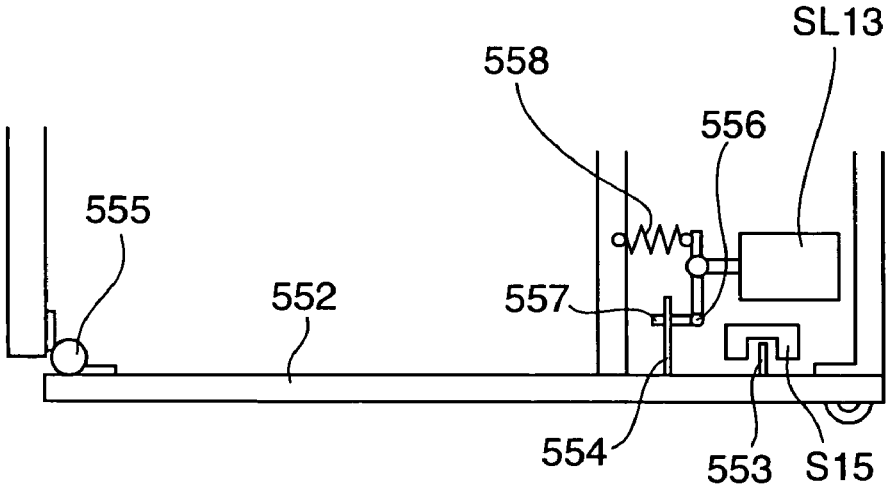
FIG. 12 is a view showing the opening/closing detection mechanism and the door lock mechanism of the cover provided on the folding apparatus in a state where the door cannot be opened and closed.

FIGS. 11 and 12 are views showing an opening/closing detection mechanism and a door lock mechanism of the cover 552 provided on the folding apparatus 500, with FIG. 11 showing a state where the door can be opened and closed and FIG. 12 showing a state where the door cannot be opened and closed.

The cover 552 is rotatably supported by a hinge 555 on a support or the like of the folding apparatus 500. An opening/closing detection sensor flag 553 is provided on the cover 552, and by closing the cover 552, the cover opening/closing detection sensor S15 is shaded from light by the opening/closing detection sensor flag 553, resulting in it being detected that the cover 552 is closed. Accordingly, when the opening/closing detecting sensor S15 is not shaded from light by the opening/closing detection sensor flag 553, it is detected that the cover 552 is open.

Next, the lock mechanism will be described.

A hook 557 is linked to an end of the folding cover locking solenoid SL13 that is an electromagnetic solenoid, with the hook 557 being held so as to be rotatable about a shaft 556 fixed to the folding apparatus 500 and being constantly energized in a counterclockwise direction as viewed in FIG. 12, about the shaft 556 by an extension spring 558. A plate 554 with a keyhole that engages the hook 557 is provided on the cover 552. When the cover locking solenoid SL13 is turned on, the end of the cover locking solenoid SL13 moves rightward as viewed in FIG. 12 against the energizing force of the extension spring 558 so that the hook 557 rotates clockwise about the shaft 556. If the cover 552 is closed at this time, the hook 557 catches in the keyhole of the plate 554 to lock the cover 552, resulting in a state where the cover 552 cannot be opened. When the cover locking solenoid SL13 is turned off, the hook 557 is rotated in the counterclockwise direction about the shaft 556 by the energizing force of the extension spring 558 to release the engagement of the hook 557 and the keyhole, thereby unlocking the cover 552.

Figure 13:
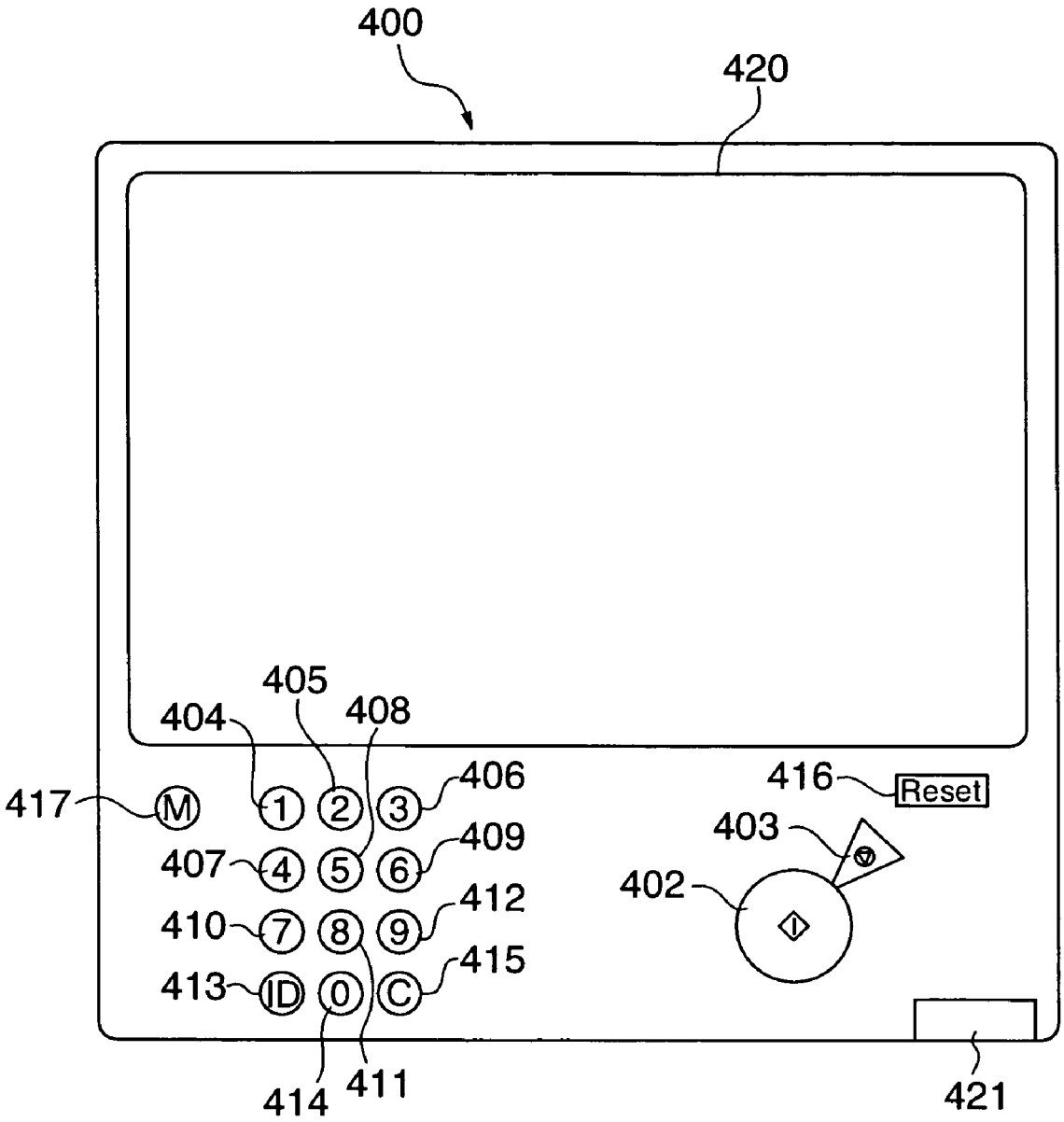
FIG. 13 is a view showing the front face layout of an operation display device appearing in FIG. 1.

FIG. 13 is a view showing the front face layout of the operation display device 400 appearing in FIG. 1.

The operation display device 400 has an operation input section on which are disposed a start key 402 for starting an image forming operation, a stop key 403 for interrupting the image forming operation, a ten key 404 to 412 and 414 for numeric setting, an ID key 413, a clear key 415, a reset key 416, a maintenance key 417, and other keys. In addition, a liquid crystal display section 420, an upper part of which is composed of a touch panel, is disposed as the display section of the operation display device 400, with it being possible to display soft keys on a screen of the liquid crystal display section 420.

Figure 14:
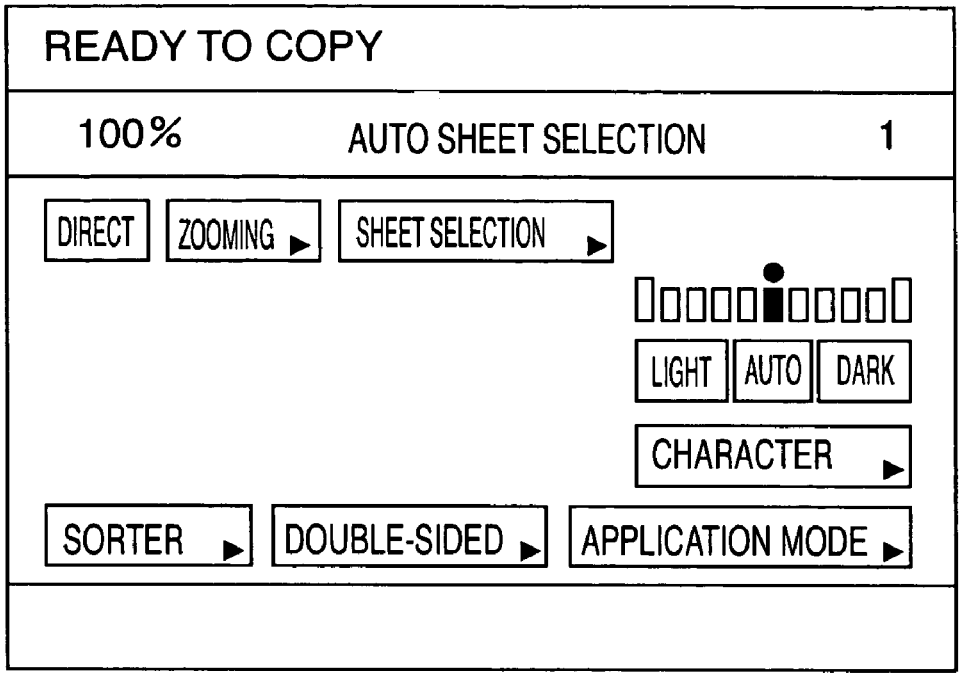
FIG. 14 is a view showing a main screen (initial screen) displayed on a liquid crystal display section.
Figure 15:
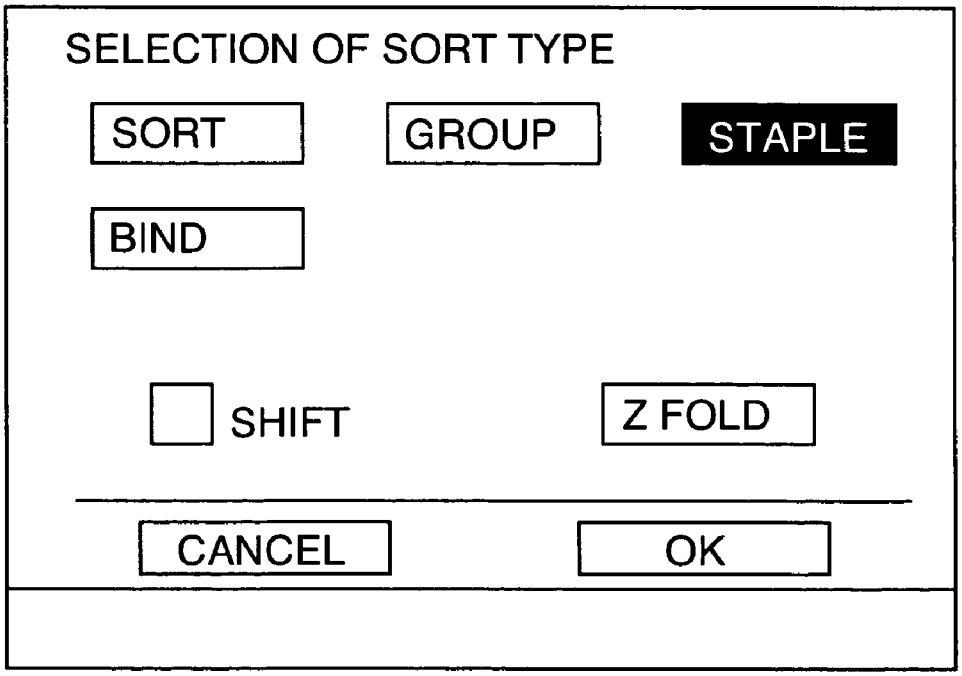
FIG. 15 is a view showing a menu selection screen displayed on the liquid crystal display section when a "SORTER" key in the main screen appearing in FIG. 14 and displayed on the liquid crystal display section has been selected.

The present image forming system has modes such as a non-sort (group) mode, a sort mode, a staple-sort mode (stitching mode), and a binding mode as post-processing modes. The setting of such processing modes is performed by an input operation from the operation display device 400. For example, when setting a post-processing mode, if a "SORTER" key is selected in a main screen (initial screen) displayed on the liquid crystal display section 420 as shown in FIG. 14, a menu selection screen shown in FIG. 15 is displayed on the liquid crystal display section 420 and the setting of a processing mode is performed using the menu selection screen.

Figure 16:
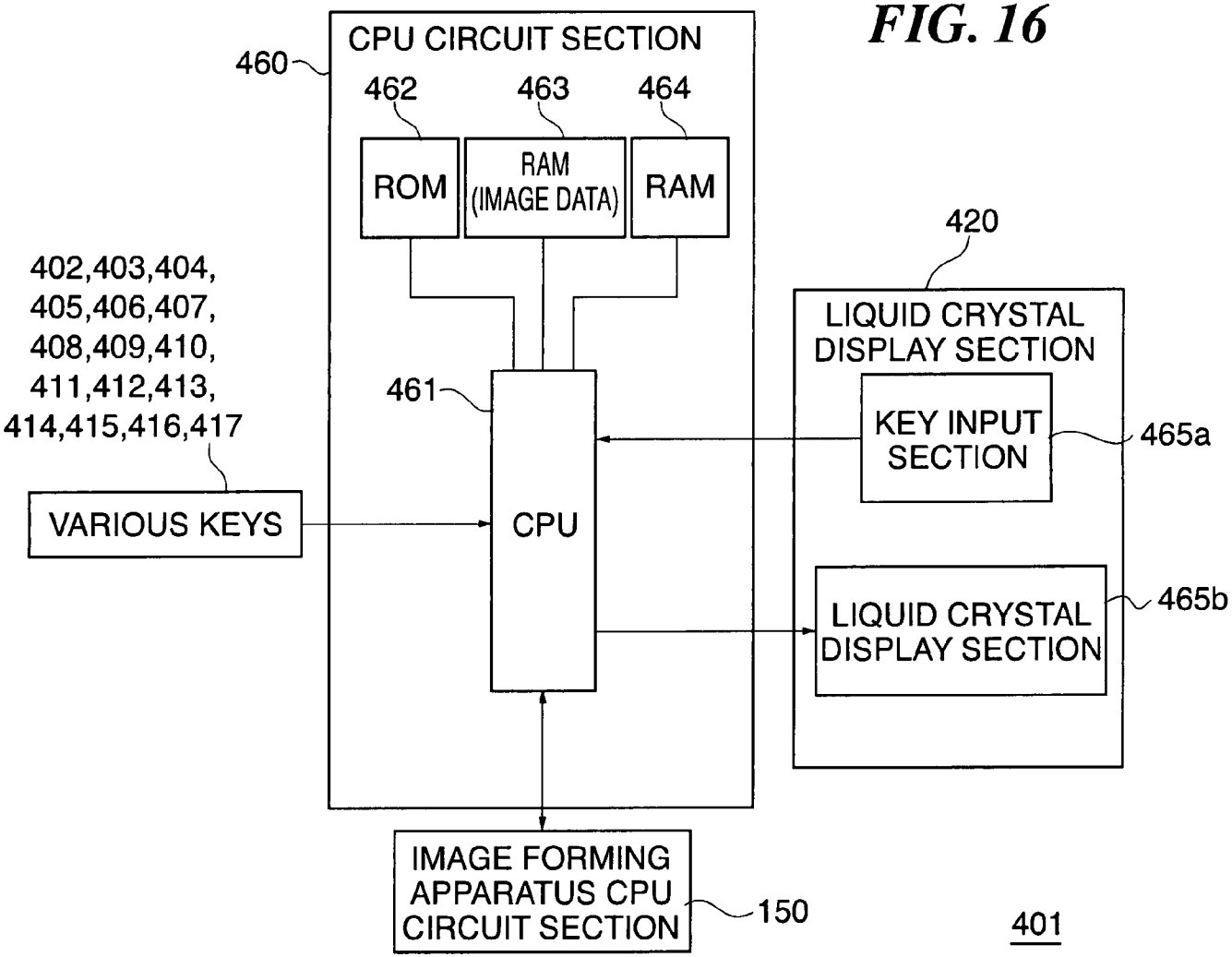
FIG. 16 is a block diagram showing the internal construction of an operation display device controller appearing in FIG. 2.

FIG. 16 is a block diagram showing the internal construction of the operation display device controller 401 shown in FIG. 2.

As shown in FIG. 16, the operation display device controller 401 includes a CPU circuit section 460 comprised of a CPU 461, a ROM 462, RAMs 463, and 464. The RAM 463 stores various data of screens displayed by the liquid crystal display section 420. The RAM 464 is used as a work area of the CPU 461, for example. The liquid crystal display section 420 is comprised of a key input section 465*a* composed of soft keys on a touch panel, and a liquid crystal display section 465*b*.

The CPU circuit section 460 communicates and exchanges data with the CPU circuit section 150 provided in the image forming apparatus main unit 10, executes various programs stored in the ROM 462 in accordance with instructions from the CPU circuit section 150 and operation inputs from the various keys 402 to 417 (see FIG. 13) and the key input section 465*a*, and outputs screen data stored in the RAM 463 to the liquid crystal display section 465*b* to display the screen data.

Figure 17:
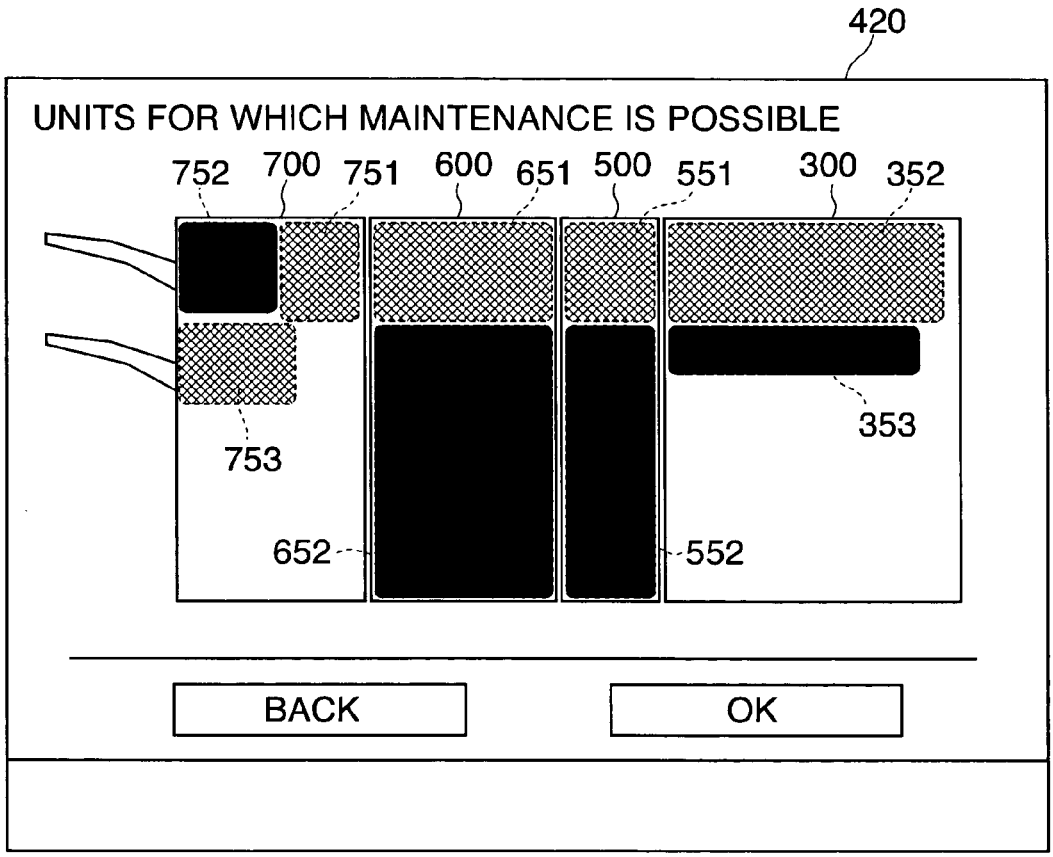
FIG. 17 is a view showing one example of a display screen which shows whether maintenance is possible for an image forming apparatus main unit and respective post-processing apparatuses and is displayed on the liquid crystal display section when a maintenance key of the operation display device has been pressed.

When the maintenance key 417 of the operation display device 400 shown in FIG. 13 has been pressed by the user, the operation display device controller 401 shown in FIG. 16 displays on the liquid crystal display section 420 whether maintenance is possible for the image forming apparatus main unit 10 and the respective post-processing apparatuses 500, 600, and 700 connected to the image forming apparatus main unit 10. FIG. 17 is a view showing one example of the display screen which shows whether maintenance is possible for the image forming apparatus main unit and the respective post-processing apparatuses and is displayed on the liquid crystal display section 420 when the maintenance key 417 of the operation display device 400 has been pressed. In FIG. 17, parts where maintenance is possible are highlighted (colored black in FIG. 17) and parts where maintenance is not possible are crosshatched. This will be described in more detail later with reference to FIG. 17.

Figure 18:
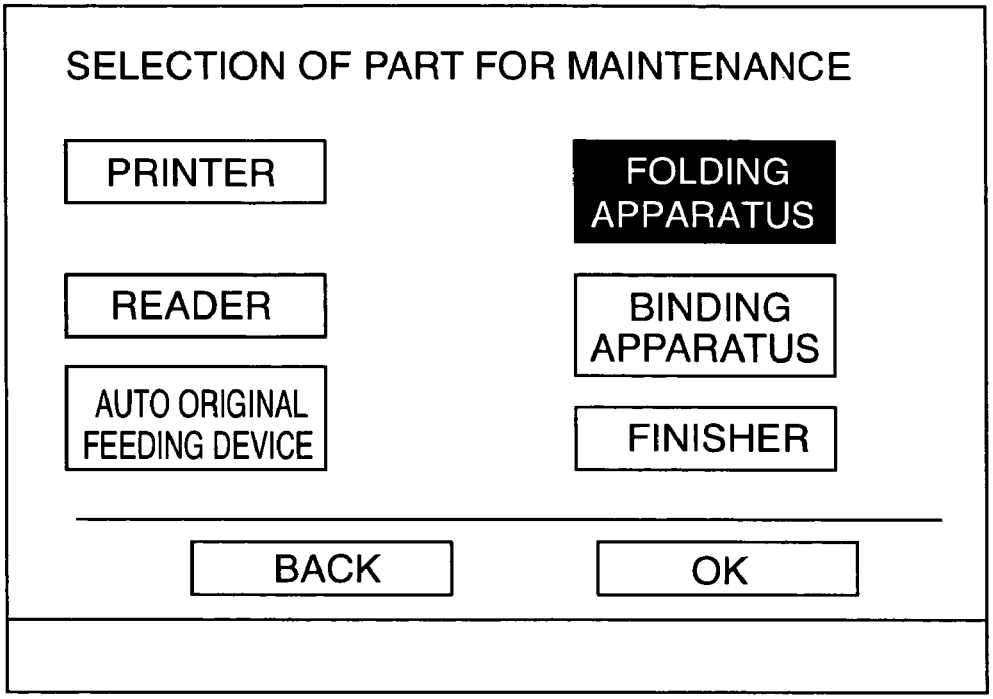
FIG. 18 is a view showing a maintenance selection screen displayed on the liquid crystal display section when an "OK" soft key has been pressed in the display screen shown in FIG. 17.

When the user presses an "OK" soft key on the screen after confirming, from the display screen displayed by the liquid crystal display section 420, which modules of the image forming apparatus main unit 10 and the respective post-processing apparatuses can be subjected to maintenance, a maintenance selection screen shown in FIG. 18 is displayed on the liquid crystal display section 420. All of the apparatuses that require maintenance are displayed as selection menu items in the maintenance selection screen.

Figure 19:
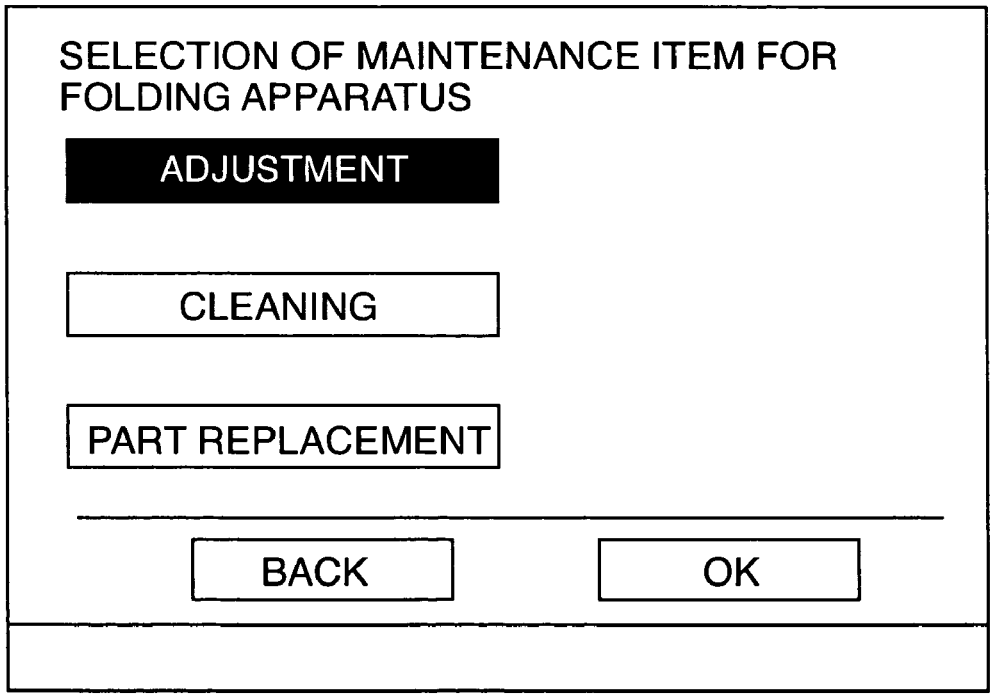
FIG. 19 is a view showing a selection screen for maintenance items displayed on the liquid crystal display section when "FOLDING APPARATUS" has been selected by the user in the maintenance selection screen shown in FIG. 18.

When the user presses the touch panel on the liquid crystal display section 420 in the maintenance selection screen shown in FIG. 18 to select the apparatus for which maintenance is to be performed, a selection screen for maintenance items related to the selected apparatus is displayed on the liquid crystal display section 420. FIG. 19 is a view showing the selection screen for the maintenance items displayed on the liquid crystal display section 420 when the user has selected the "FOLDING APPARATUS" in the maintenance selection screen shown in FIG. 18.

When the user presses the touch panel on the liquid crystal display section 420 to select a maintenance item in the selection screen of the maintenance items shown in FIG. 19, a selection screen for detailed items for the selected maintenance item is displayed on the liquid crystal display section 420. FIG. 20 shows the selection screen for detailed maintenance items displayed on the liquid crystal display section 420 when the user has selected "ADJUSTMENT" in the selection screen of the maintenance items shown in FIG. 19.

When the user presses the touch panel on the liquid crystal display section 420 to select a detailed maintenance item in the selection screen for the detailed maintenance items shown in FIG. 20, a screen for designating settings and execution of maintenance for the selected detailed maintenance item is displayed. FIG. 21 is a view showing one example of a setting/execution screen displayed on the liquid crystal display section 420 when the user has selected "ADJUST FOLDING ROLLER PRESSURE" in the selection screen for detailed maintenance items in FIG. 20.

Figure 22:
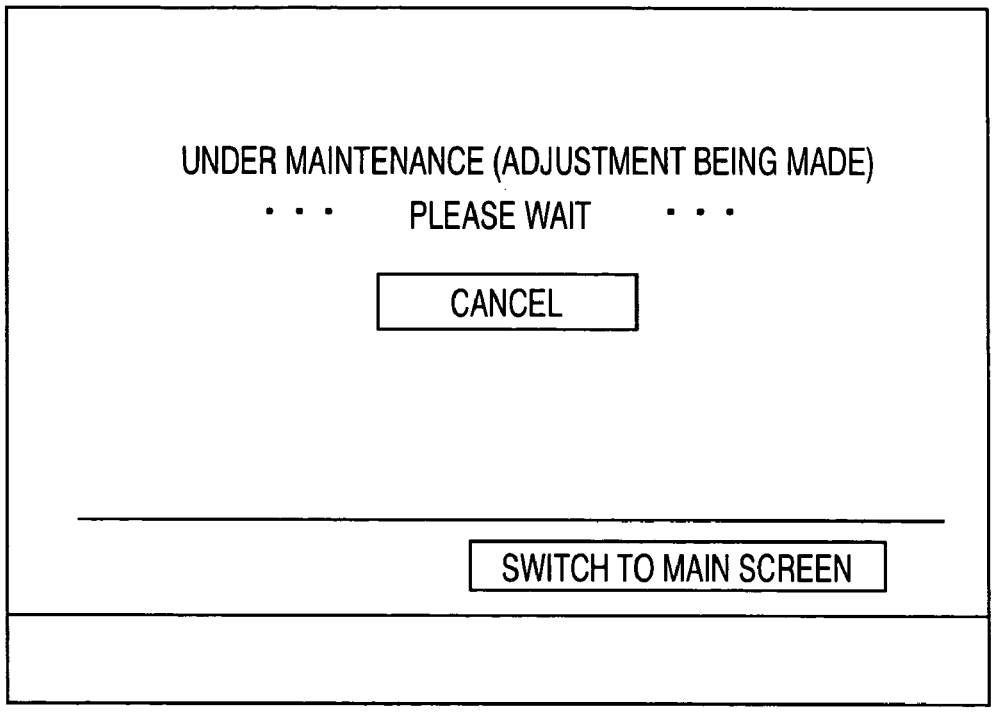
FIG. 22 is a view of a maintenance in-execution screen displayed on the liquid crystal display section when the user has pressed an "OK" soft key in the setting/execution screen shown in FIG. 21.

When the user presses an "OK" soft key in the setting/execution screen shown in FIG. 21 on the liquid crystal display section 420, the maintenance selected by the user is performed and a screen showing that maintenance is being performed is displayed on the liquid crystal display section 420. FIG. 22 is a view of a maintenance in-execution screen displayed on the liquid crystal display section 420 when the user has pressed the soft key "OK" in the setting/execution screen shown in FIG. 21.

Figure 23:
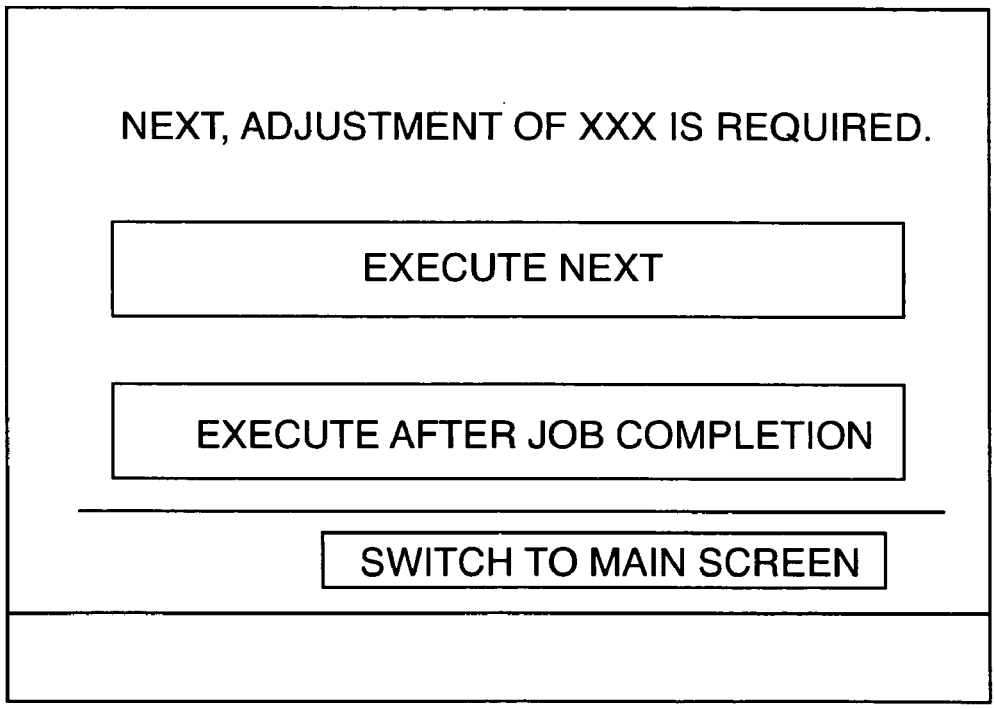
FIG. 23 is a view showing a sub-maintenance continuation selection screen displayed on the liquid crystal display section when maintenance selected by the user has been completed and there is also related sub-maintenance.

When the maintenance selected by the user has been completed and there is also related sub-maintenance, a sub-maintenance continuation selection screen is displayed on the liquid crystal display section 420. FIG. 23 is a view showing the sub-maintenance continuation selection screen displayed on the liquid crystal display section 420 when the maintenance selected by the user has been completed and there is also related sub-maintenance.

Also, when a user input indicating the end of maintenance is required for the selected maintenance, that is, for maintenance such as cleaning or replacement where the user should determine whether the operation is complete and therefore needs to input an indication showing that the maintenance is complete, a maintenance in-execution screen is displayed by the liquid crystal display section 420. FIG. 24 is a view showing the maintenance in-execution screen displayed on the liquid crystal display section 420 when the user needs to input an indication that maintenance is complete for the selected maintenance.

When the user has pressed a "COMPLETE" key in the maintenance in-execution screen shown in FIG. 24, when there is related sub-maintenance for the completed maintenance and a job is being executed, the sub-maintenance continuation selection screen shown in FIG. 23 is displayed on the liquid crystal display section 420.

When the user has selected an "EXECUTE NEXT" key in the sub-maintenance continuation selection screen shown in FIG. 23, a screen for designating settings and the execution of maintenance for the sub-maintenance is displayed on the liquid crystal display section 420. FIG. 25 is a view showing one example of a sub-maintenance setting/execution screen displayed on the liquid crystal display section 420 when the "EXECUTE NEXT" key has been selected in the sub-maintenance continuation selection screen shown in FIG. 23.

When the user has selected an "EXECUTE AFTER JOB COMPLETION" button in the sub-maintenance continuation selection screen shown in FIG. 23, after the job processing has been completed, a screen (see FIG. 25) for designating settings and the execution of maintenance for the sub-maintenance is displayed on the liquid crystal display section 420.

Figure 26:
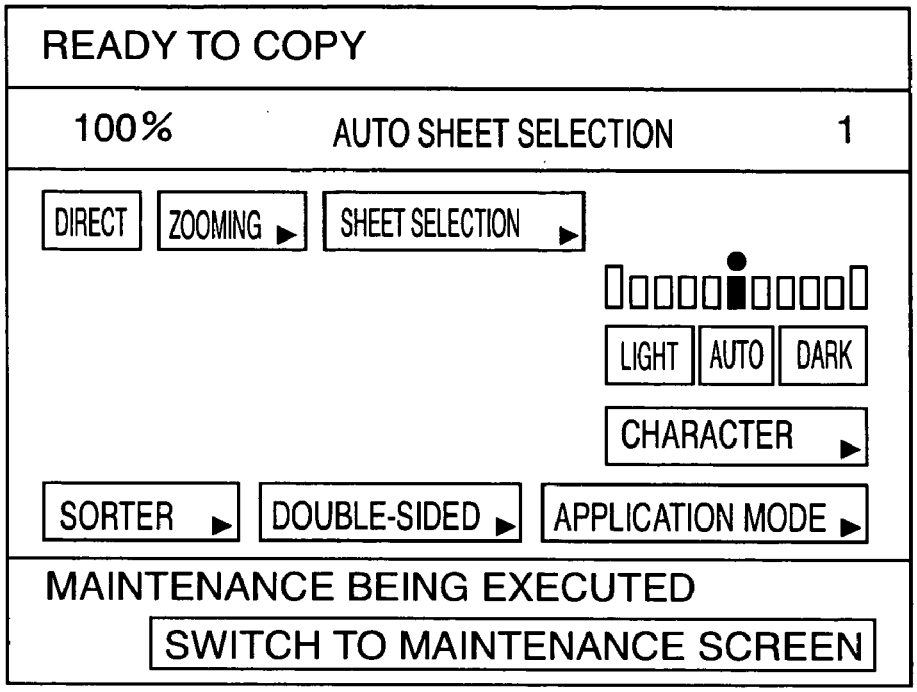
FIG. 26 is a view showing one example of a main screen displayed on the liquid crystal display section when the user has pressed a "SWITCH TO MAIN SCREEN" key in the maintenance in-execution screen shown in FIG. 22 or the maintenance in-execution screen shown in FIG. 24.

Also, when the user has pressed a "SWITCH TO MAIN SCREEN" key in the maintenance in-execution screen shown in FIG. 22 or the maintenance in-execution screen shown in FIG. 24, the main screen showing a state of the job presently being processed is displayed on the liquid crystal display section 420 so that it is possible while maintenance is being performed to confirm the processing state of the job presently being processed and/or to newly set and execute a new job. FIG. 26 is a view showing one example of the main screen displayed on the liquid crystal display section 420 when the user has pressed the "SWITCH TO MAIN SCREEN" key in the maintenance in-execution screen shown in FIG. 22 or the maintenance in-execution screen shown in FIG. 24.

Also, when the user has pressed a "SWITCH TO MAINTENANCE SCREEN" key in the main screen shown in FIG. 26, the maintenance in-execution screen (see FIG. 22 or FIG. 24) displaying the state of the maintenance presently being performed is displayed on the liquid crystal display section 420 so that it is possible to confirm the status of the maintenance presently being performed and/or to designate that the maintenance has been completed.

Figure 27:
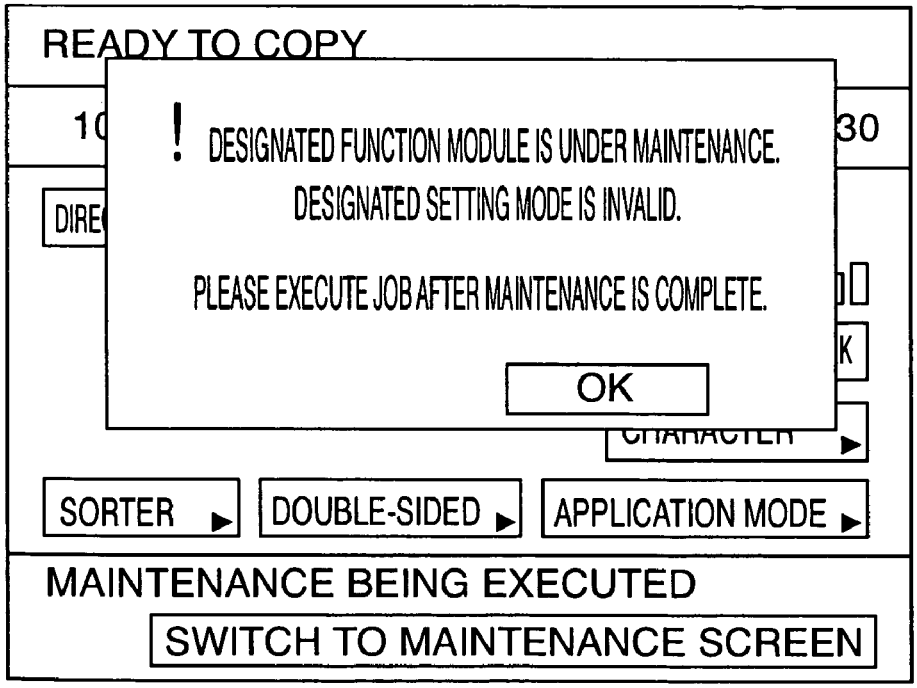
FIG. 27 is a view showing a warning message displayed on the liquid crystal display section in the state where the main screen shown in FIG. 26 is displayed on the liquid crystal display section.
Figure 29:
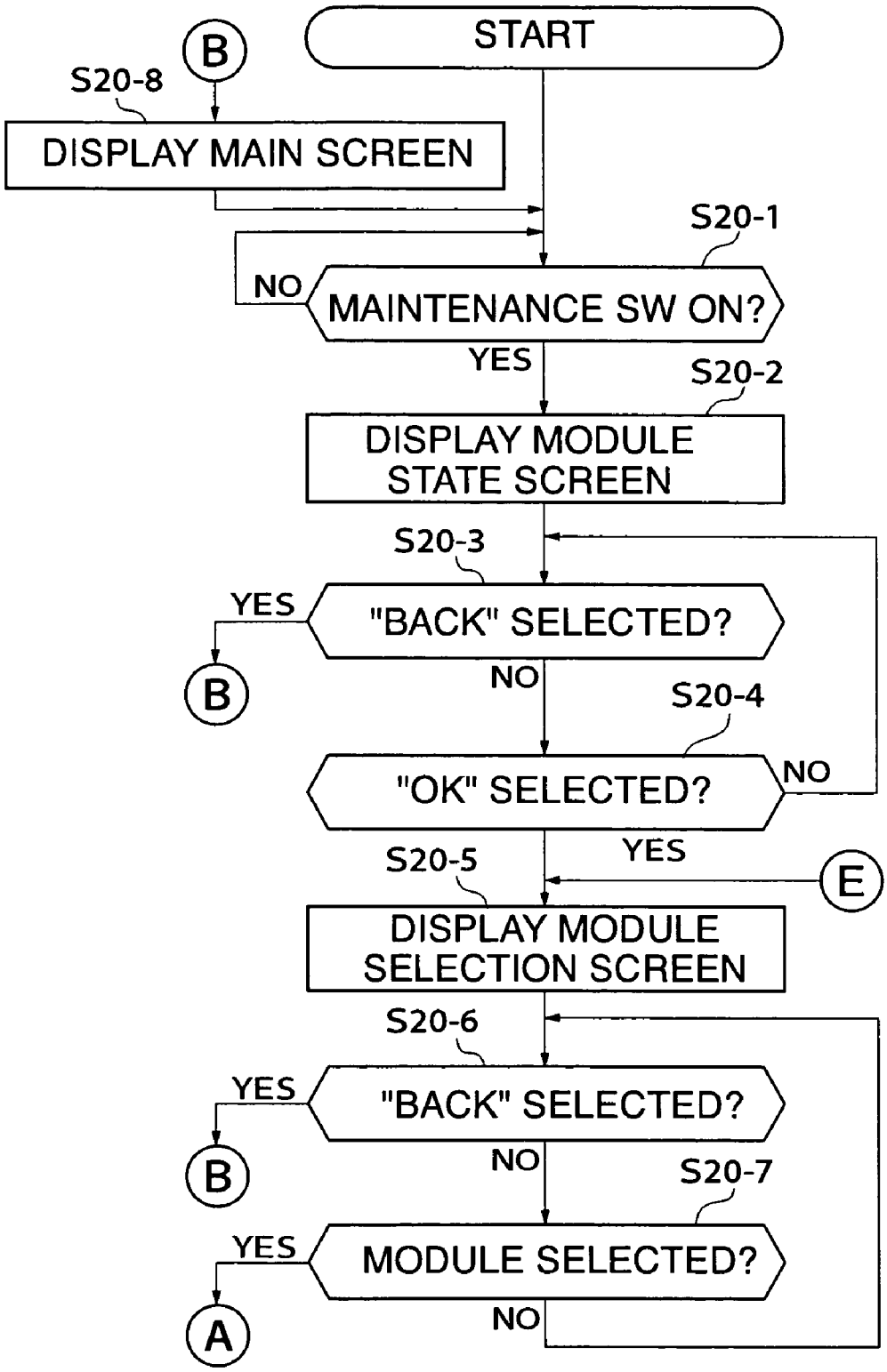
FIG. 29 is a flowchart (a first part out of five) showing the procedure of a display process for displaying operation screens during maintenance executed by a CPU of the operation display device controller.

Also, when a new job is set by the user and executed during the execution of maintenance, if the operation mode set for the new job uses a function that is being subjected to maintenance, execution of the new job is not possible. Then, in a state where the main screen shown in FIG. 26 is displayed on the liquid crystal display section 420, a message warning the user that the new job cannot be accepted is displayed on the liquid crystal display section 420. FIG. 27 is a view showing a warning message displayed on the liquid crystal display section 420 in the state where the main screen shown in FIG. 26 is displayed on the liquid crystal display section 420.

FIG. 28 is a diagram showing one example of the relationship between maintenance items and sub-maintenance items in the folding apparatus 500.

The sub-maintenance items are maintenance items that must be implemented after certain maintenance items have been executed, such as a case where roller pressure must be adjusted after a roller has been replaced and a case where a light amount adjustment must be carried out for a sensor after the sensor has been cleaned.

The display screen shown in FIG. 17 described above displays whether maintenance is possible, that is, whether the covers covering the function modules of the respective apparatuses can be opened and closed. Parts where the cover can be opened are highlighted (colored black in FIG. 17), while parts where the cover cannot be opened are crosshatched. The display screen shown in FIG. 17 is an example where single-sided recording mode is set in the image processing system and the sort process has been selected.

In FIG. 17, since the single-sided recording mode is set, for the printer 300 the cover 353 of a double-sided function module section to which the sheet is not conveyed is highlighted (is colored black in FIG. 17) and the cover 352 of the image forming section is crosshatched (note that the effect of dividing a cover of the printer 300 into the cover 352 and the cover 353 will be described in detail later in a fourth embodiment with reference to FIG. 41).

Also, for the folding apparatus 500 and the binding apparatus 600, the covers 551 and 651 that respectively cover the horizontal paths 502, 612 for conveying sheets on which images have been formed to the finisher 700 are displayed with crosshatching, and the covers 552 and 652 that respectively cover the folding processing section 540 (see FIG. 10) and the binding processing section 640 (see FIG. 9) are highlighted. As shown in FIG. 3, in the finisher 700, since sheets are discharged from the finisher path 711 via the sort path 713 to the intermediate tray 730 and further the stack tray 722, the cover 751 and the cover 753 are crosshatched and the cover 752 which can be opened and closed is highlighted.

FIGS. 29 to 33 are flowcharts showing the procedure of a display process for displaying operation screens during maintenance executed by the CPU 461 of the operation display device controller 401. The steps in the display process will now be described in order.

In a step S20-1, the CPU 461 determines whether the user has pressed the maintenance key 417 of the operation display device 400. If the maintenance key 417 has been pressed, the process proceeds to a step S20-2. In the step S20-2, the CPU 461 displays, on the liquid crystal display section 420, a module state display screen (see FIG. 17) that enables the user to confirm whether maintenance can be performed for the respective modules (the printer 300, the folding apparatus 500, the binding apparatus 600, and the finisher 700).

In a step S20-3, it is determined whether a "BACK" key has been selected in the module state display screen (see FIG. 17), and if the "BACK" key has been selected, the process proceeds to a step S20-8 where the main screen is displayed. On the other hand, if the "BACK" key has not been selected, the process proceeds to a step S20-4.

In the step S20-4, it is determined whether an "OK" key has been selected in the module state display screen (see FIG. 17), and if the "OK" key has been selected, the process proceeds to a step S20-5, while if the "OK" key has not been selected, the process returns to the step S20-3.

In the step S20-5, the CPU 461 displays a module selection screen (see FIG. 18) that enables a module to be selected on the liquid crystal display section 420. Next, in a step S20-6, the CPU 461 determines whether a "BACK" key in the module selection screen (see FIG. 18) has been selected, and if the "BACK" key has been selected, the process proceeds to the step S20-8. On the other hand, if the "BACK" key has not been selected, the process proceeds to a step S20-7.

In the step S20-7, it is determined whether any of the modules has been selected in the module selection screen (see FIG. 18) and if any of the modules has been selected, the process proceeds to a step S21-1, while if no selection has been made, the process returns to the step S20-6.

In the step S21-1, the CPU 461 displays, on the liquid crystal display section 420, a selection screen (see for example FIG. 19) for maintenance items related to the module determined to have been selected by the user in the step S20-7. After this, in a step S21-2, the CPU 461 determines whether a "BACK" key has been selected in the selection screen for maintenance items (see for example FIG. 19), and if the "BACK" key has been selected, the process returns to the step S20-5. On the other hand, if the "BACK" key has not been selected, the process proceeds to a step S21-3.

In the step S21-3, the CPU 461 determines whether an "ADJUSTMENT" item has been selected in the selection screen for maintenance items (see for example FIG. 19), and if the "ADJUSTMENT" item has been selected, the process proceeds to a step S21-6. On the other hand, if the "ADJUSTMENT" item has not been selected, the process proceeds to a step S21-4.

In the step S21-6, the CPU 461 displays an item screen for adjustment maintenance (see for example FIG. 20) related to the module selected by the user on the liquid crystal display section 420. After this, the process proceeds to a step S21-9.

In the step S21-4, the CPU 461 determines whether a "CLEANING" item has been selected in the selection screen for maintenance items (see for example FIG. 19), and if the "CLEANING" item has been selected, the process proceeds to a step S21-7. On the other hand, if the "CLEANING" item has not been selected, the process proceeds to a step S21-5.

In the step S21-7, the CPU 461 displays an item screen (not shown) for cleaning maintenance related to the module selected by the user on the liquid crystal display section 420. After this, the process proceeds to a step S21-9.

In the step S21-5, the CPU 461 determines whether a "PART REPLACEMENT" item has been selected in the selection screen for maintenance items (see for example FIG. 19), and if the "PART REPLACEMENT" item has been selected, the process proceeds to a step S21-8. On the other hand, if the "PART REPLACEMENT" item has not been selected, the process returns to the step S21-2.

In the step S21-8, the CPU 461 displays an item screen (not shown) for part replacement maintenance related to the module selected by the user on the liquid crystal display section 420. After this, the process proceeds to the step S21-9.

In the step S21-9, the CPU 461 determines whether a "BACK" key has been selected in the item screen for adjustment maintenance (see for example FIG. 20), an item screen for cleaning maintenance (not shown), or an item screen for part replacement maintenance (not shown), and if the "BACK" key has been selected, the process returns to the step S21-1. If the "BACK" key has not been selected, the process proceeds to a step S21-10.

In the step S21-10, the CPU 461 determines whether an "OK" key has been selected in the item screen for adjustment maintenance (see for example FIG. 20), the item screen for cleaning maintenance (not shown), or the item screen for part replacement maintenance (not shown), and if the "OK" key has been selected, the process proceeds to a step S21-11. If the "OK" key has not been selected, the process returns to the step S21-9.

In the step S21-11, the CPU 461 displays an input setting/execution screen (see for example FIG. 21) for the maintenance item determined to have been selected in the step S21-10 on the liquid crystal display section 420.

In a step S21-12, the CPU 461 determines whether a "BACK" key has been selected in the input setting/execution screen (see for example FIG. 21), and if the "BACK" key has been selected, the process returns to the step S21-1. If the "BACK" key has not been selected, the process proceeds to a step S21-13.

In the step S21-13, it is determined whether an "OK" key has been selected in the input setting/execution screen (see for example FIG. 21), and if the "OK" key has been selected, the process proceeds to a step S21-14. If the "OK" key has not been selected, the process returns to the step S21-12.

In the step S21-14, maintenance is executed in accordance with the content set in the input setting/execution screen (see for example FIG. 21).

Next, in a step S22-1, the CPU 461 displays an in-execution screen (see FIG. 22 or FIG. 24) relating to the maintenance being executed in the step S21-14 on the liquid crystal display section 420. As stated above, the maintenance in-execution screen shown in FIG. 22 relates to a maintenance item for which the CPU 461 can determine whether the execution of maintenance is complete, while the maintenance in-execution screen shown in FIG. 24 relates to a maintenance item for which the CPU 461 cannot determine whether the execution of maintenance is complete.

In a step S22-13, the CPU 461 determines whether a "SWITCH TO MAIN SCREEN" key in the maintenance in-execution screen (see FIG. 22 or FIG. 24) has been selected, that is, whether the user has designated the displaying of a screen displaying the status of a job presently being processed or a screen in which the setting and execution of a new job can be designated. If as a result, the "SWITCH TO MAIN SCREEN" key has been selected, the process proceeds to a step S22-14, while if the "SWITCH TO MAIN SCREEN" key has not been selected, the process proceeds to a step S22-2.

In the step S22-14, the CPU 461 displays the main screen (see FIG. 26) on the liquid crystal display section 420. Next, in a step S22-15, the CPU 461 determines whether a "SWITCH TO MAINTENANCE SCREEN" key in the main screen (see FIG. 26) has been selected, that is, whether the user has designated the displaying of a screen that displays the status of maintenance presently being performed or a screen in which the completion of maintenance can be inputted. If as a result, the "SWITCH TO MAINTENANCE SCREEN" key has been selected, the process returns to the step S22-1, while if the "SWITCH TO MAINTENANCE SCREEN" key has not been selected, the process proceeds to the step S22-14.

In the step S22-2, the CPU 461 determines whether the maintenance has been completed. Note that when the user selects the "COMPLETE" key while the maintenance execution screen shown in FIG. 24 is being displayed, the CPU 461 determines that the maintenance has been completed. If the maintenance has been completed, the process proceeds to a step S22-3, while if the maintenance has not been completed, the process returns to the step S22-1.

In the step S22-3, the CPU 461 determines whether there is a sub-maintenance item related to the maintenance that has been completed. If there is no sub-maintenance item, the process proceeds to the step S21-1, while if there is a sub-maintenance item, the process proceeds to a step S22-4.

In the step S22-4, the CPU 461 determines whether a job is presently being executed. If a job is being executed, the process proceeds to a step S22-5, while if no job is being executed, the process proceeds to the step S21-11.

In the step S22-5, the CPU 461 displays a selection screen (see FIG. 23) for selecting whether to execute the sub-maintenance item on the liquid crystal display section 420.

In a step S22-6, the CPU 461 determines whether the "EXECUTE NEXT" key has been selected in the selection screen (see FIG. 23), and if the "EXECUTE NEXT" key has been selected, the process proceeds to a step S22-8. If the "EXECUTE NEXT" key has not been selected, the process proceeds to a step S22-7.

In the step S22-7, the CPU 461 registers the sub-maintenance item as a reserved maintenance item and returns to the step S21-1. Maintenance reservation is for registering in advance maintenance to be executed following the completion of a job. Processing related to maintenance reservation will be described later with reference to FIG. 34.

In the step S22-8, the CPU 461 displays an input setting screen for sub-maintenance (see for example FIG. 25) on the liquid crystal display section 420.

In a step S22-9, the CPU 461 stands by until an "OK" key is selected in the input setting screen for sub-maintenance (see for example FIG. 25) and once the "OK" key has been selected, the process proceeds to a step S22-10.

In the step S22-10, processing is executed in accordance with the setting content of the input setting screen for sub-maintenance (see for example FIG. 25). After this, in a step S22-11, the CPU 461 displays the maintenance in-execution screen (see FIG. 22 or FIG. 24) for sub-maintenance on the liquid crystal display section 420.

As stated above, the maintenance in-execution screen shown in FIG. 22 relates to a maintenance item for which the CPU 461 can determine whether the execution of sub-maintenance is complete, while the maintenance execution screen shown in FIG. 24 relates to a maintenance item for which the CPU 461 cannot determine whether the execution of sub-maintenance is complete.

In a step S22-16, the CPU 461 determines whether the "SWITCH TO MAIN SCREEN" key in the maintenance in-execution screen (see FIG. 22 or FIG. 24) has been selected. If as a result, the "SWITCH TO MAIN SCREEN" key has been selected, the process proceeds to a step S22-17, while if the "SWITCH TO MAIN SCREEN" key has not been selected, the process proceeds to a step S22-12.

In the step S22-17, the CPU 461 displays the main screen (see FIG. 26) on the liquid crystal display section 420. Next, in a step S22-18, the CPU 461 determines whether the "SWITCH TO MAINTENANCE SCREEN" key in the main screen (see FIG. 26) has been selected. If as a result, the "SWITCH TO MAINTENANCE SCREEN" key has been selected, the process returns to the step S22-11, while if the "SWITCH TO MAINTENANCE SCREEN" key has not been selected, the process returns to the step S22-17.

In the step S22-12, the CPU 461 determines whether the maintenance has been completed. Note that when the user selects the "COMPLETE" key while the maintenance execution screen shown in FIG. 24 is being displayed, the CPU 461 determines that the maintenance has been completed. If the maintenance has been completed, the process proceeds to the step S21-1, while if the maintenance has not been completed, the process returns to the step S22-11.

Figure 33:
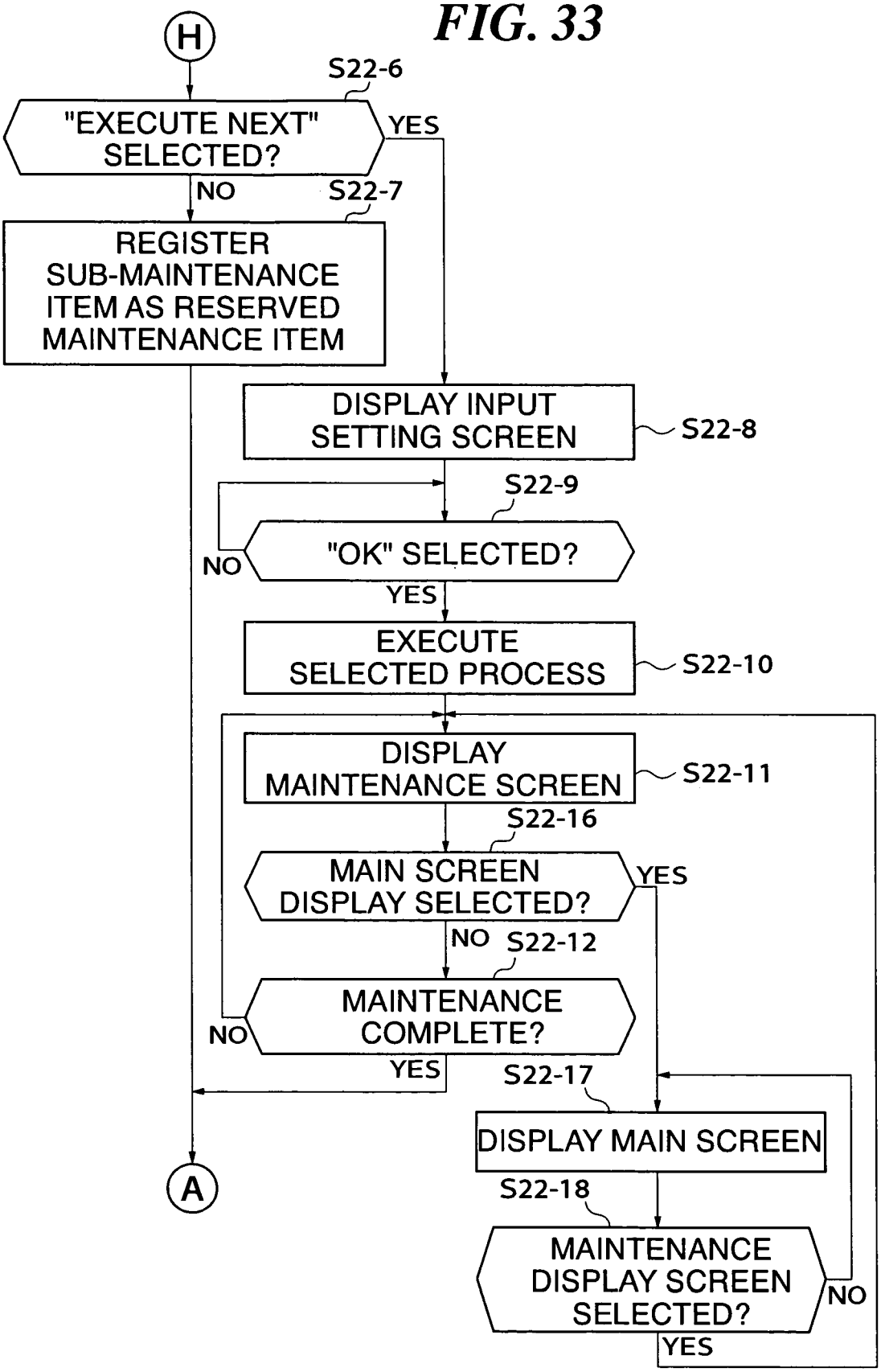
FIG. 33 is a flowchart (a fifth part out of five) showing the procedure of the display process for displaying operation screens during maintenance executed by the CPU of the operation display device controller.

Next, a display process for the operation screen during maintenance when reserved maintenance has been registered in the step S22-7 in FIG. 33 will be described with reference to FIG. 34.

Figure 34:
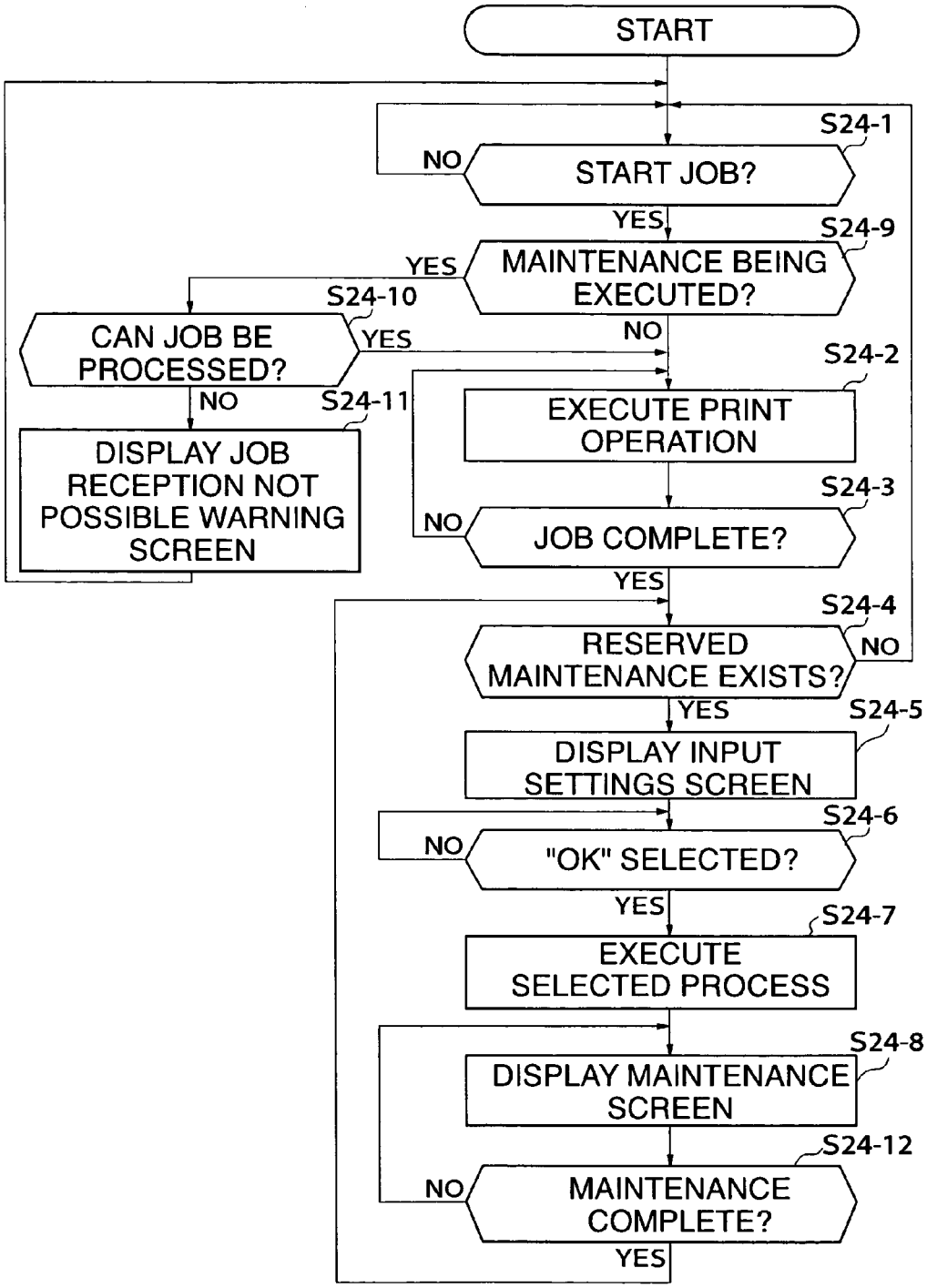
FIG. 34 is a flowchart showing the procedure of a display process for displaying operation screens during maintenance executed by the CPU of the operation display device controller when reserved maintenance has been registered.

FIG. 34 is a flowchart showing the procedure of the display process for displaying operation screens during maintenance executed by the CPU 461 of the operation display device controller 401 when reserved maintenance has been registered.

In a step S24-1, the CPU 461 determines whether the user has pressed the copy start key 402 of the operation display device 400, and if the copy start key 402 has been pressed, the process proceeds to a step S24-9. In the step S24-9, it is determined whether maintenance (sub-maintenance) is presently being performed. If maintenance is being performed, the process proceeds to a step S24-10, while if maintenance is not being performed, the process proceeds to a step S24-2.

In the step S24-10, the CPU 461 determines whether a print job desired by the user can be processed, that is, whether the operation settings of the print job desired by the user do not require the function module that is presently being subjected to maintenance (sub-maintenance). As a result, if it has been determined that the print job desired by the user can be processed (i.e., when the operation settings of the print job desired by the user do not require the function module that is presently being subjected to maintenance (sub-maintenance)), the process proceeds to the step S24-2, while if the print job cannot be processed, the process proceeds to a step S24-11.

In the step S24-11, the CPU 461 invalidates the reception of the job and displays a job reception not possible warning screen (see FIG. 27) on the liquid crystal display section 420. Next, the process returns to the step S24-1.

In the step S24-2, the CPU 461 starts the print job desired by the user in accordance with the set operation mode. Next, in a step S24-3, the CPU 461 determines whether the job has been completed. If the job has been completed, the process proceeds to a step S24-4, otherwise the process returns to the step S24-2.

In the step S24-4, the CPU 461 determines whether reserved maintenance has been registered. If reserved maintenance has been registered, the process proceeds to a step S24-5, while if no maintenance has been registered, the process returns to the step S24-1.

In the step S24-5, the CPU 461 displays the input setting screen for sub-maintenance (see for example FIG. 25) on the liquid crystal display section 420.

Next, in a step S24-6, the CPU 461 stands by until the "OK" key is selected in the input setting screen for sub-maintenance (see for example FIG. 25), and once the "OK" key has been selected, the process proceeds to a step S24-7.

In the step S24-7, processing is executed in accordance with the setting content of the input setting screen for sub-maintenance (see for example FIG. 25). Next, in a step S24-8, the CPU 461 displays the maintenance in-execution screen (see FIG. 22 or FIG. 24) for the sub maintenance on the liquid crystal display section 420.

As stated above, the maintenance in-execution screen shown in FIG. 22 relates to a maintenance item for which the CPU 461 can determine whether the execution of sub-maintenance is complete, while the maintenance execution screen shown in FIG. 24 relates to a maintenance item for which the CPU 461 cannot determine whether the execution of sub-maintenance is complete.

In a step S24-9, the CPU 461 determines whether the maintenance has been completed. Note that when the user selects the "COMPLETE" key while the maintenance execution screen shown in FIG. 24 is being displayed, the CPU 461 determines that the maintenance has been completed. If the maintenance has been completed, the process proceeds to a step S24-4, while if the maintenance has not been completed, the process returns to the step S24-8.

Next, a second embodiment of the present invention will be described.

The construction of the second embodiment is fundamentally the same as that of the first embodiment, and therefore in the description of the second embodiment, elements and parts that are the same as those in the construction of the first embodiment are designated by identical reference numerals, description thereof is omitted, and only different parts will be described.

In the second embodiment, when the main screen shown in FIG. 26 is displayed and a new job is set by the user and executed during the execution of maintenance, if the mode set for the new job uses a function that is presently being subjected to maintenance, a job continuation selection screen (see FIG. 35) is displayed on the liquid crystal display section 420. The job continuation selection screen (see FIG. 35) urges the user to select whether the new job should be executed with only the mode that cannot be used due to the maintenance being invalidated.

If the user presses an "OK" key in the job continuation selection screen (see FIG. 35), the new job is executed with only the mode that cannot be used due to the maintenance being invalidated. Alternatively, if a "CANCEL" key is pressed in the job continuation selection screen (see FIG. 35), the processing of the new job is cancelled, the mode set for the new job is left unchanged, and the main screen (see FIG. 26) is displayed on the liquid crystal display section 420.

Also, in the second embodiment, the display process for displaying operation screens during maintenance when reserved maintenance has been registered partially differs to the display process in the first embodiment shown in FIG. 34.

Figure 36:
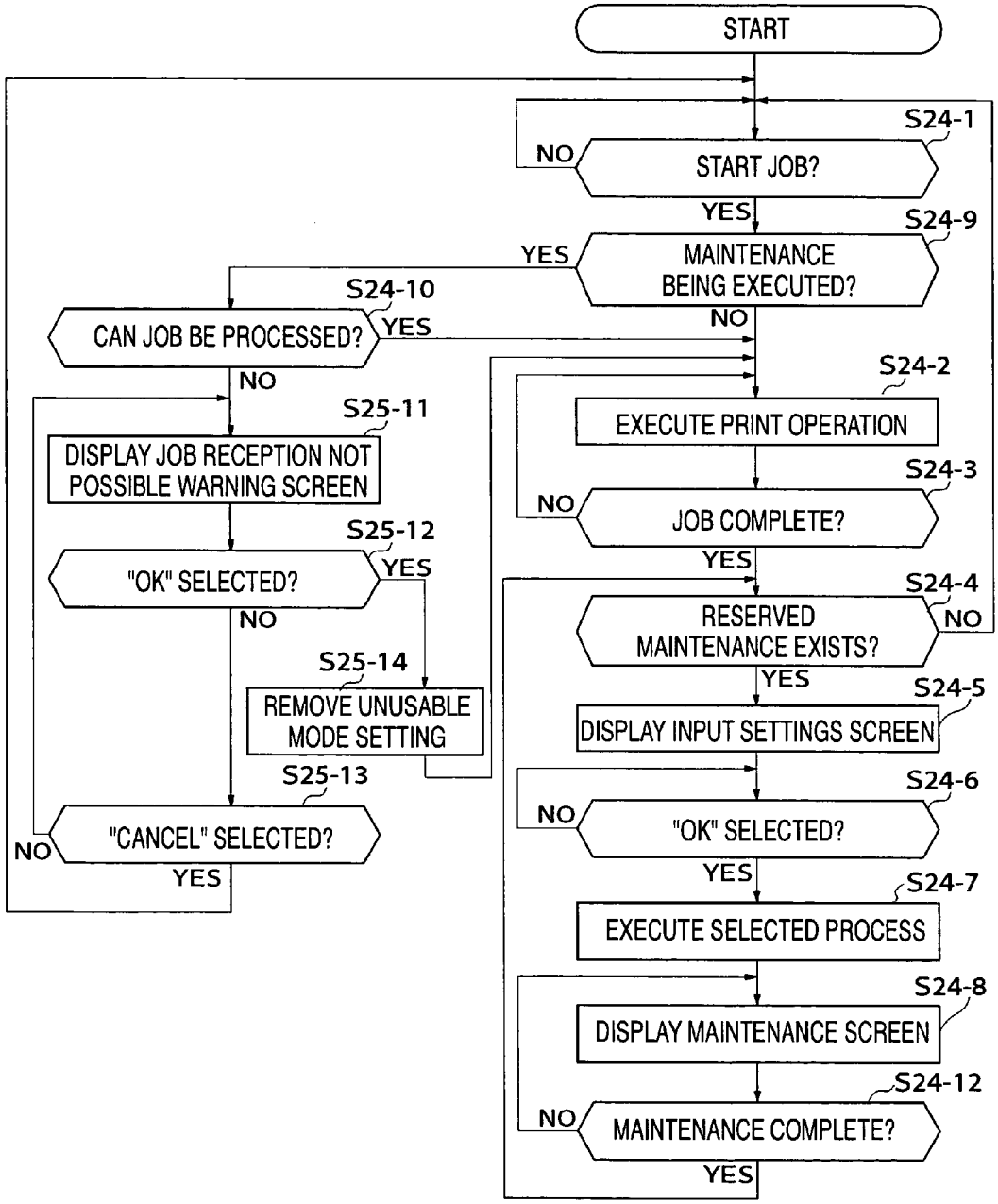
FIG. 36 is a flowchart showing the procedure of a display process for displaying operation screens during maintenance executed by a CPU of an operation display device controller in a second embodiment of the present invention when reserved maintenance has been registered.

FIG. 36 is a flowchart showing the procedure of a display process for displaying operation screens during maintenance executed by the CPU 461 of the operation display device controller 401 in the second embodiment when reserved maintenance has been registered. Note that since part of the display process shown in FIG. 36 is fundamentally the same as part of the display process in the first embodiment shown in FIG. 34, steps with the same content are designated by identical step numbers and description thereof is omitted.

In the second embodiment, in a step S25-11, the CPU 461 invalidates the reception of a job and displays a job reception not possible warning screen (see FIG. 35) on the liquid crystal display section 420.

Figure 35:
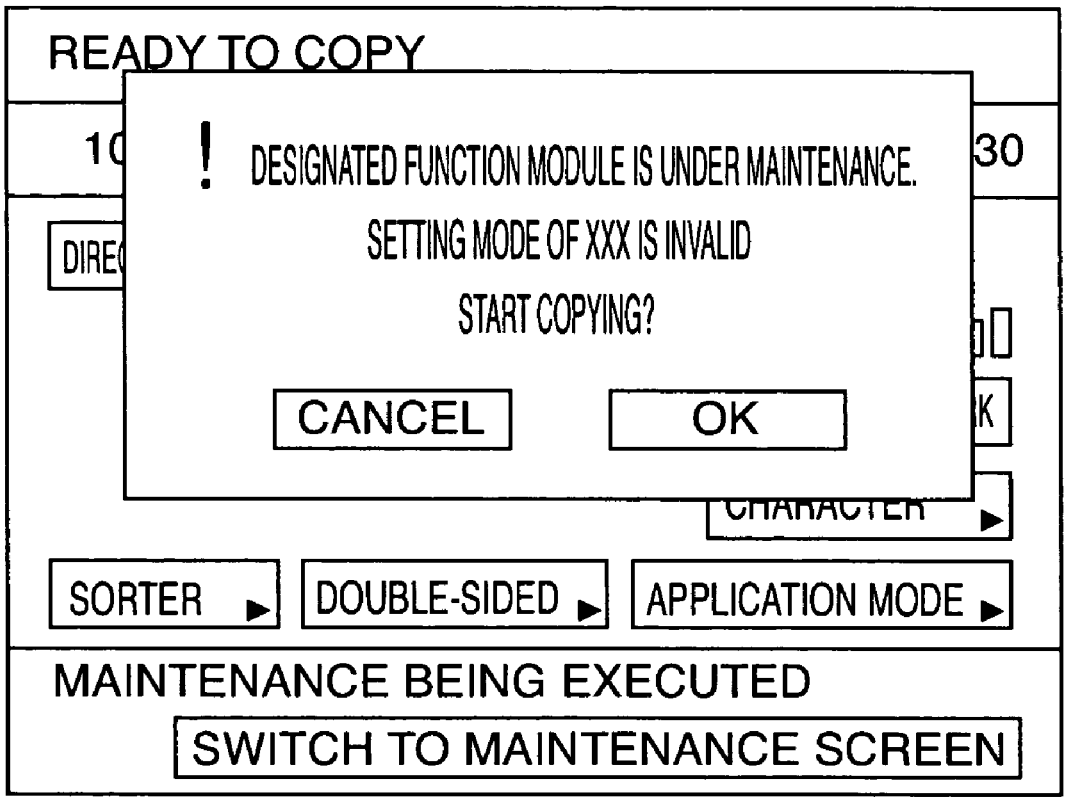
FIG. 35 is a view showing a job continuation selection screen displayed on the liquid crystal display section.

Next, in a step S25-12, the CPU 461 determines whether an "OK" key has been selected in the job reception not possible warning screen (see FIG. 35). If the "OK" key has been selected, the process proceeds to a step S25-14, while if the "OK" key has not been selected, the process proceeds to a step S25-13.

In the step S25-14, the CPU 461 invalidates a mode setting that cannot be used due to maintenance presently being executed, out of the mode settings made by the user, and the process proceeds to the step S24-2, where the print job desired by the user is started.

In the step S25-13, the CPU 461 determines whether a "CANCEL" key has been selected in the job reception not possible warning screen (see FIG. 35). If the "CANCEL" key has been selected, the operation settings made by the user are left unchanged and the process returns to the step S24-1, while if the "CANCEL" key has not been selected, the process returns to the step S25-1.

Next, a third embodiment of the present invention will be described.

The construction of the third embodiment is fundamentally the same as the construction of the first embodiment, and therefore in the description of the third embodiment, elements and parts that are the same as those in the construction of the first embodiment are designated by identical reference numerals, description thereof is omitted, and only different parts will be described.

In the third embodiment, when the user presses the "SWITCH TO MAIN SCREEN" key in the maintenance in-execution screen in FIG. 22 or the maintenance in-execution screen in FIG. 24 to set and execute a new job, the main screen (see FIG. 26) showing the status of the job presently being processed is displayed. Next, for example, when the folding apparatus 500 is being subjected to maintenance and the user selects a "SORTER" key in the main screen (see FIG. 26), a selection screen shown in FIG. 37 is displayed on the liquid crystal display section 420.

Figure 37:
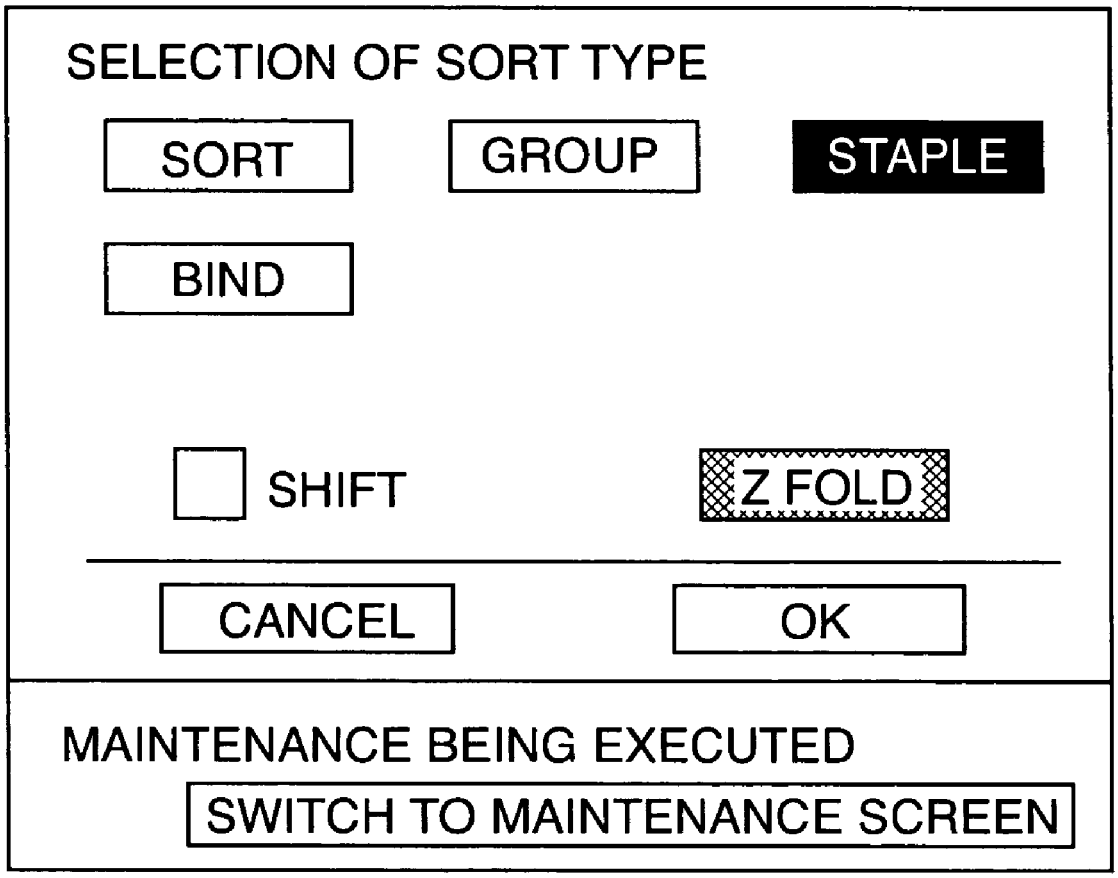
FIG. 37 is a view showing a selection screen displayed on the liquid crystal display section when a "SORTER" key has been selected in the main screen shown in FIG. 26.

In the selection screen shown in FIG. 37, setting keys for processing modes such as the non-sort (group) mode, the sort mode, the staple sort mode (stitching mode), the binding mode, and the folding mode are displayed as the post-processing modes, and out of these, setting keys (such as a "Z-folding" key) of processing modes that cannot be used due to present maintenance are displayed with crosshatching so as to be unselectable.

In the third embodiment, part (corresponding to processes shown in FIGS. 32 and 33) of the display process for displaying operation screens during maintenance executed by the CPU 461 of the operation display device controller 401 differs to the display process in the first embodiment.

Figure 32:
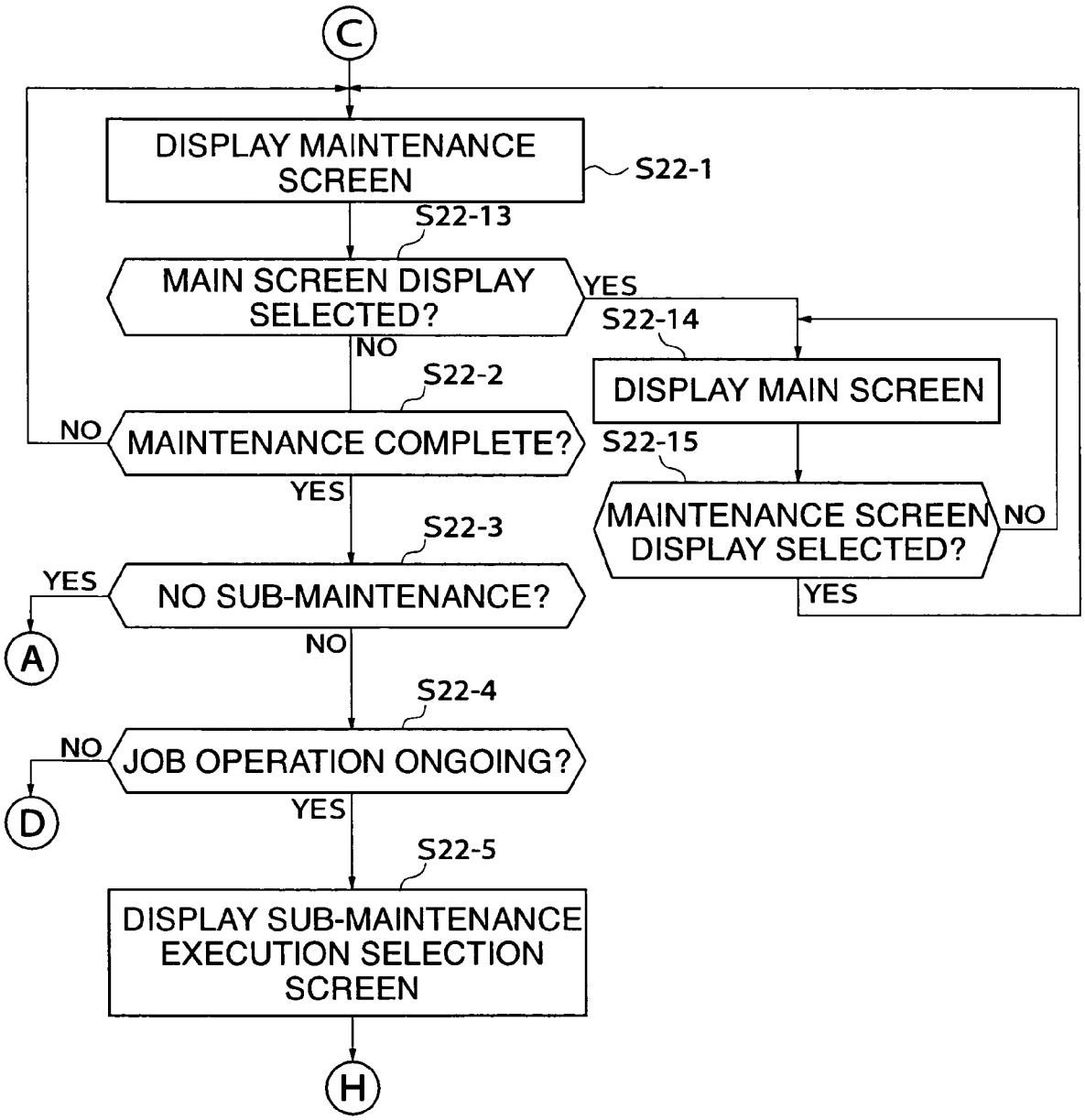
FIG. 32 is a flowchart (a fourth part out of five) showing the procedure of the display process for displaying operation screens during maintenance executed by the CPU of the operation display device controller.
Figure 38:
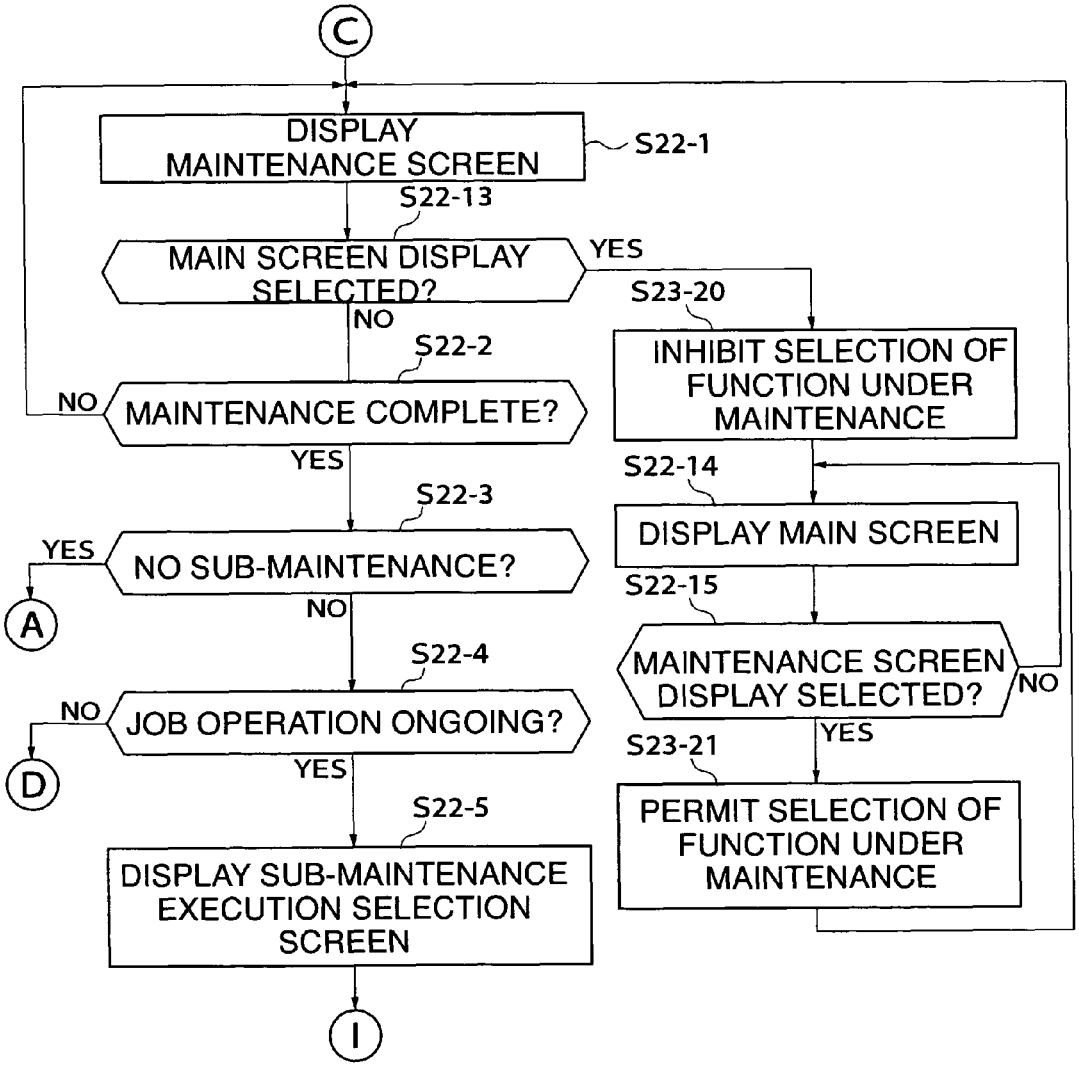
FIG. 38 is a flowchart (a first part out of two) showing the procedure of part of a display process for displaying operation screens during maintenance executed by a CPU of an operation display device controller in a third embodiment of the present invention.
Figure 39:
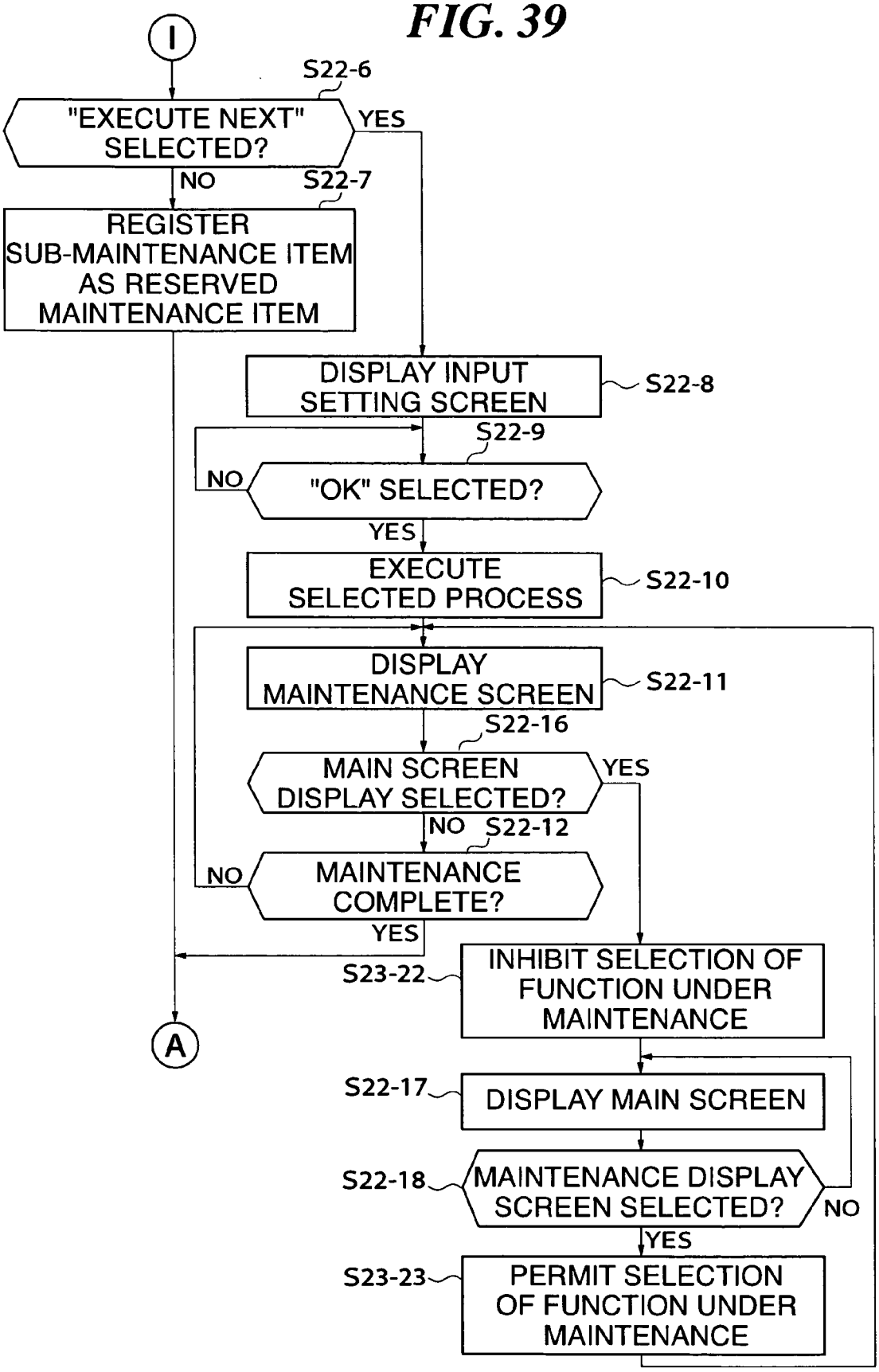
FIG. 39 is a flowchart (a second part out of two) showing the procedure of part of the display process for displaying operation screens during maintenance executed by the CPU of the operation display device controller in the third embodiment.

FIGS. 38 and 39 are flowcharts showing the procedure of part of the display process for displaying operation screens during maintenance executed by the CPU 461 of the operation display device controller 401 in the third embodiment. Note that in FIGS. 38 and 39, steps with the same content as in the display process of the first embodiment shown in FIGS. 32 and 33, are designated by identical step numbers, and description thereof is omitted.

As shown in FIG. 38 in the third embodiment, if in the step S22-13, the "SWITCH TO MAIN SCREEN" key has been selected in the maintenance in-execution screen (see FIG. 22 or FIG. 24), the process proceeds to a step S23-20.

In the step S23-20, the CPU 461 determines which modes cannot be used due to maintenance presently being executed and sets such modes as unselectable (for example, such modes are displayed with crosshatching in FIG. 37). Next, the process proceeds to the step S22-14, where the CPU 461 displays the main screen (see FIG. 26) on the liquid crystal display section 420.

Next, when in the step S22-15, it has been determined that the "SWITCH TO MAINTENANCE SCREEN" key has been selected by the user in the main screen (see FIG. 26), the process proceeds to a step S23-21 where the CPU 461 sets the modes that were set as unselectable due to maintenance in the step S23-20 as selectable by the user (the crosshatching is removed). Next, the process proceeds to the S22-1.

In the third embodiment, as shown in FIG. 39, if the "SWITCH TO MAIN SCREEN" key is selected in the maintenance in-execution screen (see FIG. 22 or FIG. 24) in the step S22-16, the process proceeds to a step S23-22.

In the step S23-22, the CPU 461 determines which modes cannot be used due to sub-maintenance presently being executed and sets such modes as unselectable (for example, such modes are displayed with crosshatching in FIG. 37). Next, the process proceeds to the step S22-17, where the CPU 461 displays the main screen (see FIG. 26) on the liquid crystal display section 420.

Next, when in the step S22-18, it has been determined that the "SWITCH TO MAINTENANCE SCREEN" key has been selected by the user in the main screen (see FIG. 26), the process proceeds to a step S23-23 where the CPU 461 sets the modes that were set as unselectable due to maintenance presently being executed in the step S23-22 as selectable by the user (the crosshatching is removed). Next, the process proceeds to the S22-11.

Next, a fourth embodiment of the present invention will be described.

The construction of the fourth embodiment is fundamentally the same as the construction of the first embodiment, and therefore in the description of the fourth embodiment, elements and parts that are the same as those in the construction of the first embodiment are designated by identical reference numerals, description thereof is omitted, and only different parts will be described. The division of the cover of the printer 300 into the cover 352 and the cover 353 is the same as in the first embodiment, but the effect of such dividing will be described here.

Figure 40:
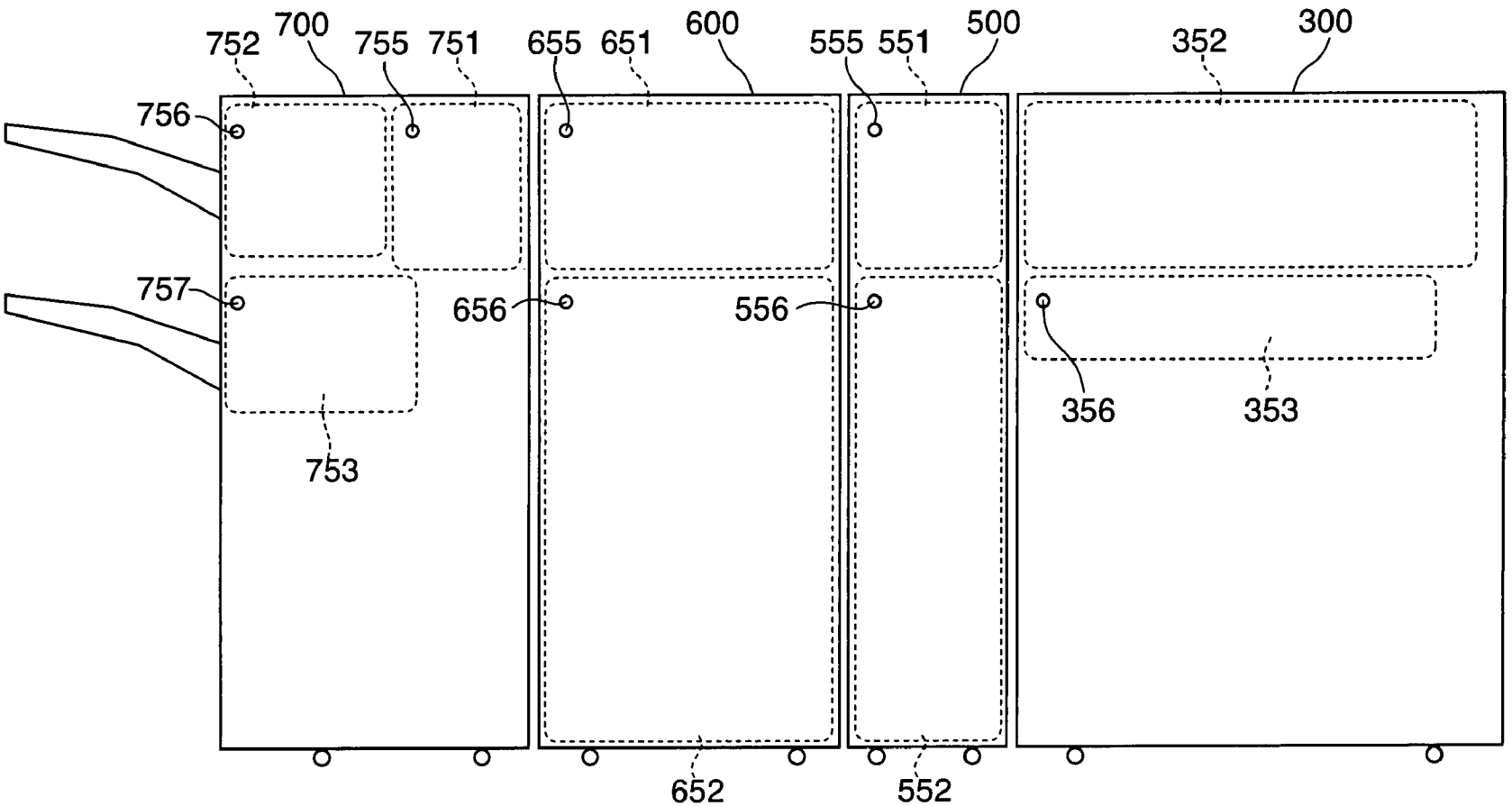
FIG. 40 is a view showing how external covers and state displaying LEDs are respectively disposed on a printer, the folding apparatus, the binding apparatus, and the finisher in a fourth embodiment of the present invention.

FIG. 40 is a view showing how the external covers and state displaying LEDs (Light Emitting Diodes) are respectively disposed on the printer 300, the folding apparatus 500, the binding apparatus 600, and the finisher 700 in the fourth embodiment.

As shown in FIG. 40, a LED 356 is provided on the cover 353 of the printer 300, a LED 555 on the cover 551 of the folding apparatus 500 and a LED 556 on the cover 552 of the same, a LED 655 on the cover 651 of the binding apparatus 600 and a LED 656 on the cover 652 of the same, and a LED 755 on the cover 751 of the finisher 700, a LED 756 on the cover 752 of the same, and a LED 757 on the cover 753 of the same.

These LEDs show whether maintenance can be performed for the parts covered by the corresponding covers, that is, whether the corresponding covers can be opened, during execution of image formation in the image forming system. When maintenance is possible, the corresponding LED is extinguished, while when maintenance is not possible, the corresponding LED is lit.

Note that instead of extinguishing and lighting the LEDs, it is possible to show whether maintenance is possible or not possible by lighting LEDs of different colors.

As shown in FIG. 17, the cover of the printer 300 in the image forming apparatus main unit 10 is divided into the cover 352 and the cover 353 in the fourth embodiment in the same way as in the first embodiment. The division of the cover of the printer 300 will be described in detail below.

Figure 41B:
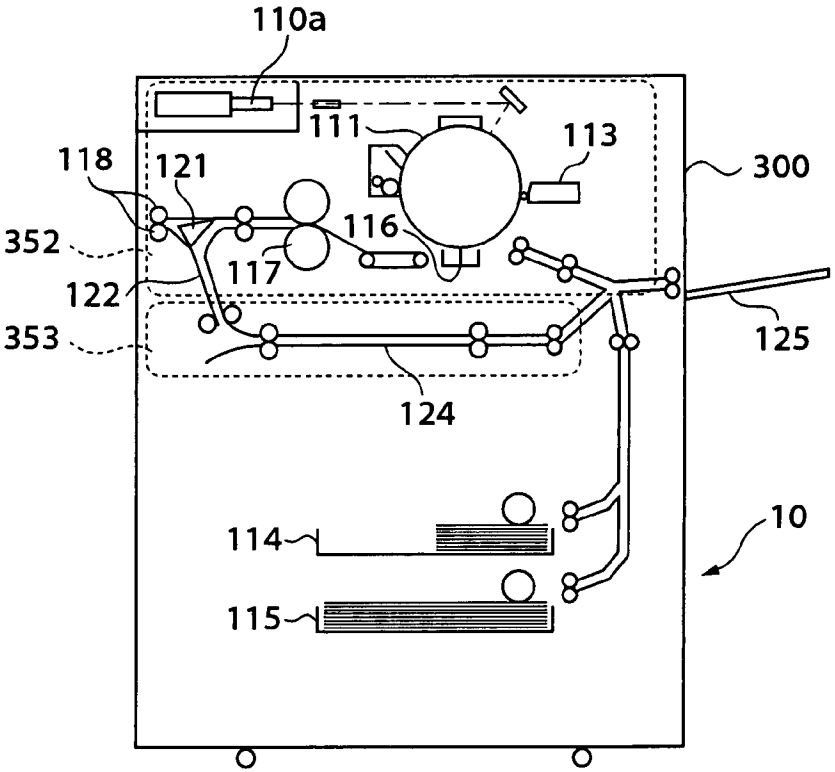
FIG. 41A is a view showing an external cover of a conventional printer (image forming apparatus) and FIG. 41B is a view showing an external cover of the printer (image forming apparatus) in the fourth embodiment.
Figure 41A:
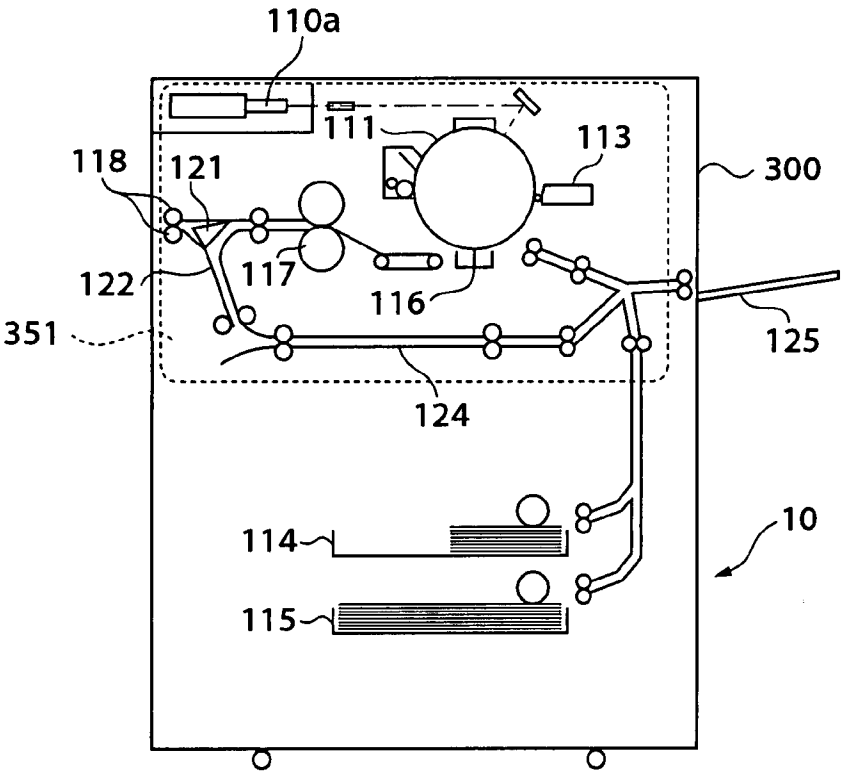

FIG. 41A and FIG. 41B are views showing the external cover of the printer 300 of the image forming apparatus main unit 10, with FIG. 41A showing a cover 351 of a conventional image forming apparatus and FIG. 41B showing the covers 352, 353 of the image forming apparatus main unit 10 in the fourth embodiment.

As shown in FIG. 41B, the cover 352 is provided so as to cover a conveying path composed of the photosensitive drum 111 and the transfer section 116, the fixing section 117 that fixes a developer image transferred onto a sheet by the transfer section 116, and the flapper 121 that switches between discharging the sheet with the fixed image to the folding apparatus 500 or guiding the sheet to the inverting path 122, such parts conveying the sheet regardless of whether single-sided or double-sided image formation has been set for the sheet.

The cover 353 is provided so as to cover the double-sided conveying path 124 that conveys a sheet on one surface of which an image has been formed only when double-sided image formation has been set for the sheet.

The cover 352 and the cover 353 can be opened and closed independently, with such covers being opened and closed when clearing a jam or during maintenance such as replacement of parts, cleaning, or adjustment.

Like the folding apparatus 500, the binding apparatus 600, and the finisher 700, an opening/closing detection sensor and an opening/closing lock mechanism are provided for each cover of the printer 300. Also, a driver that drives the conveying rollers disposed on the double-sided conveying path 124 is controlled in accordance with the opening and closing of the cover 353, and when the cover 353 has been opened, the driver is turned off so that the conveying rollers do not rotate. When the cover 352 has been opened, the entire driving of the printer 300 including driven parts such as the photosensitive drum 111 and the fixing section 117 covered by the cover 352 and driven parts covered by the cover 353 is stopped.

Accordingly, even if the cover 353 has been opened for maintenance such as cleaning of the rollers on the double-sided conveying path 124, image forming operations are not stopped.

In the same way as the finisher 700, as shown in FIG. 40, the state displaying LED 356 is provided on the cover 353 that covers the double-sided path section. Note that since the cover 352 that covers the image forming section normally cannot be opened or closed while an image forming operation is being performed, a state displaying LED is not provided on the cover 352.

Also, in the fourth embodiment, part of the display process for displaying operation screens during maintenance executed by the CPU 461 of the operation display device controller 401 (corresponding to the processes shown in FIG. 31 to FIG. 33) differs to the display process in the first embodiment.

Figure 31:
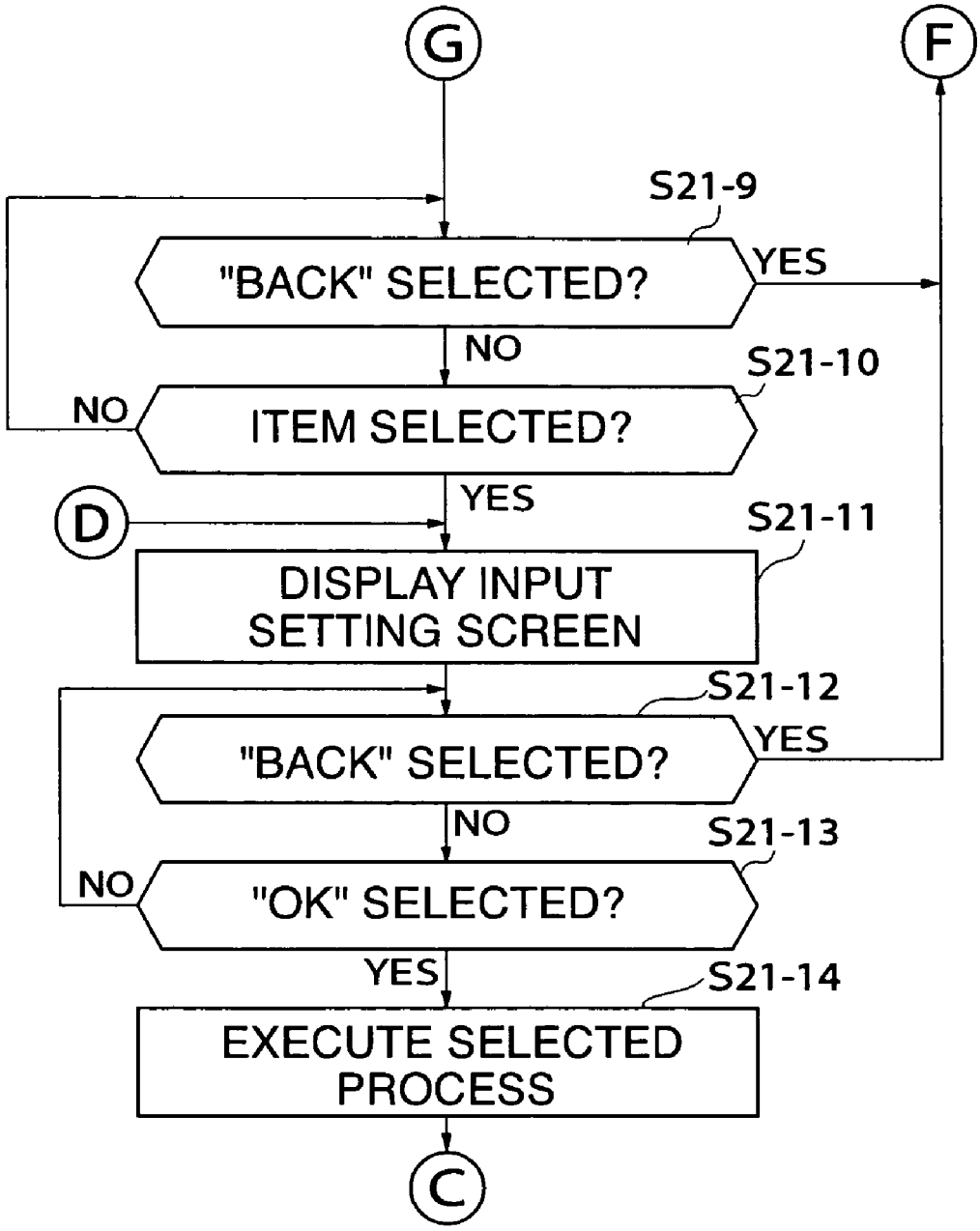
FIG. 31 is a flowchart (a third part out of five) showing the procedure of the display process for displaying operation screens during maintenance executed by the CPU of the operation display device controller.
Figure 42:
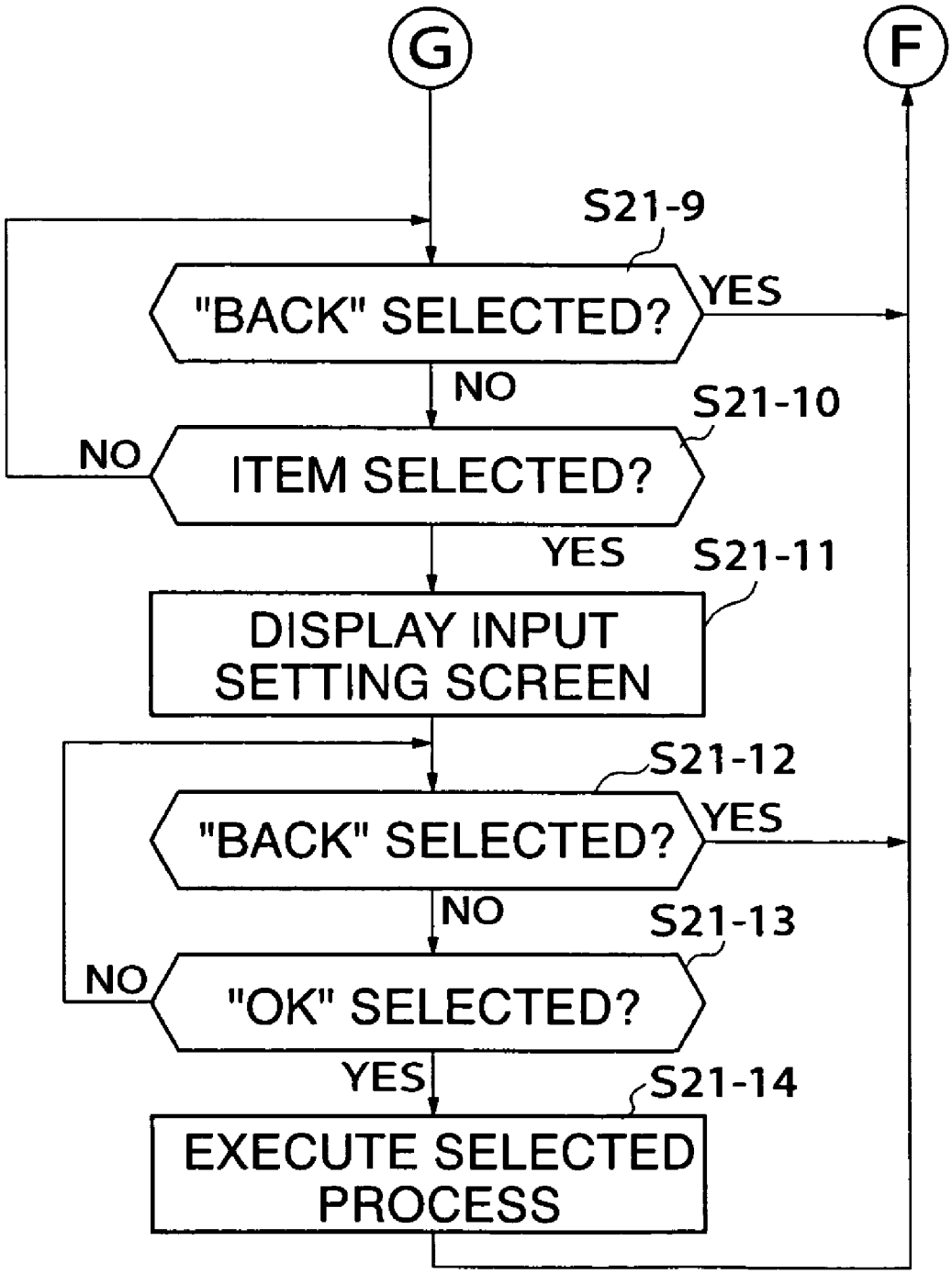
FIG. 42 is a flowchart showing the procedure of part of a display process for displaying operation screens during maintenance executed by a CPU of an operation display device controller in the fourth embodiment.

FIG. 42 is a flowchart showing the procedure of part of the display process for displaying operation screens during maintenance executed by the CPU 461 of the operation display device controller 401 in the fourth embodiment. Note that in FIG. 42, steps with the same content as those in the first embodiment shown in FIG. 31 are designated by identical step numbers, and description thereof is omitted.

Figure 30:
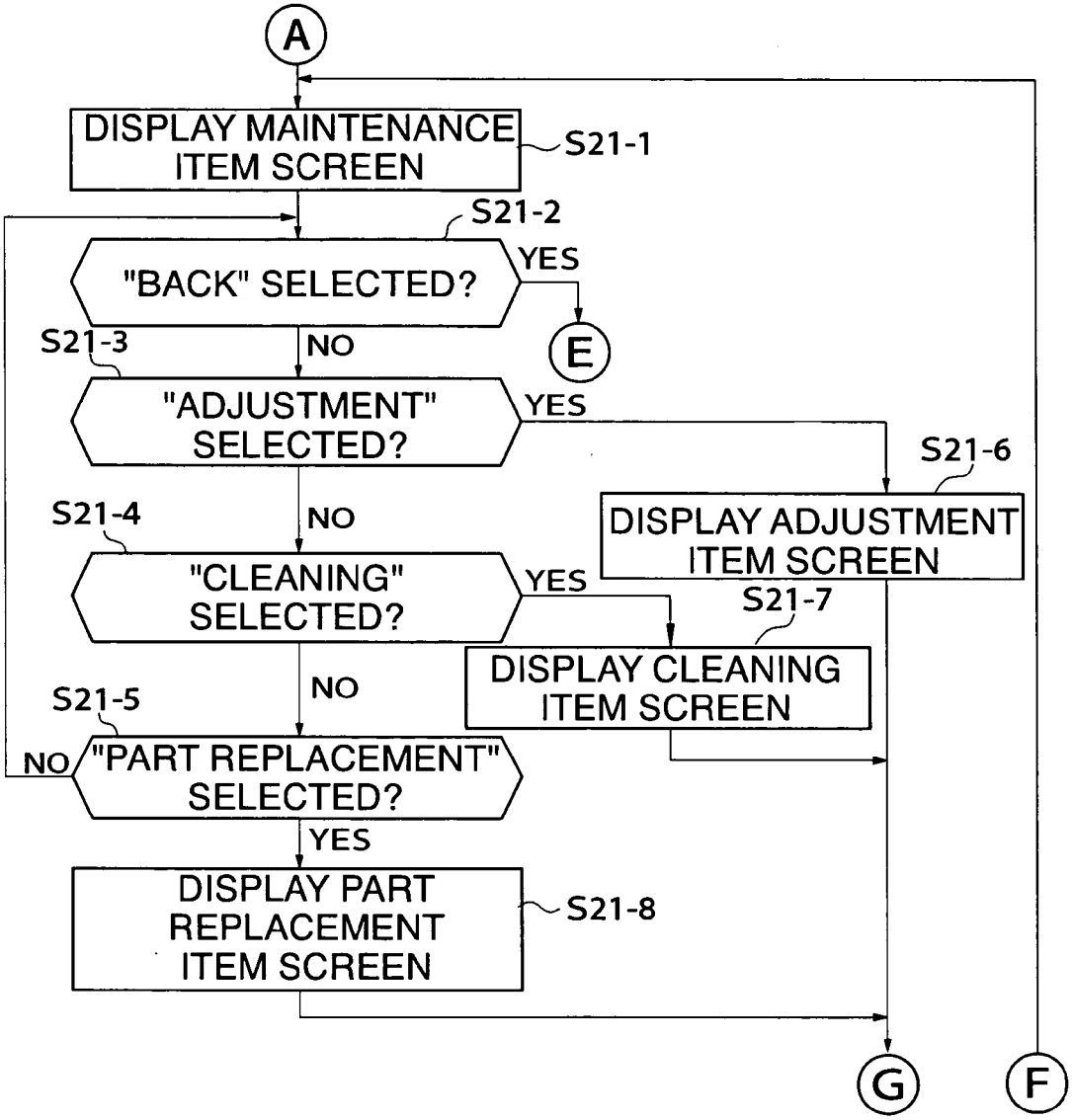
FIG. 30 is a flowchart (a second part out of five) showing the procedure of the display process for displaying operation screens during maintenance executed by the CPU of the operation display device controller.

In the fourth embodiment, after the processing in the step S21-14 has been performed, the process returns to the step S21-1 (see FIG. 30). Accordingly, part of the display process shown in FIG. 32 and FIG. 33 of the first embodiment is deleted in the fourth embodiment.

Next, screens displayed when a jam occurs in the fourth embodiment will be described.

Figure 43:
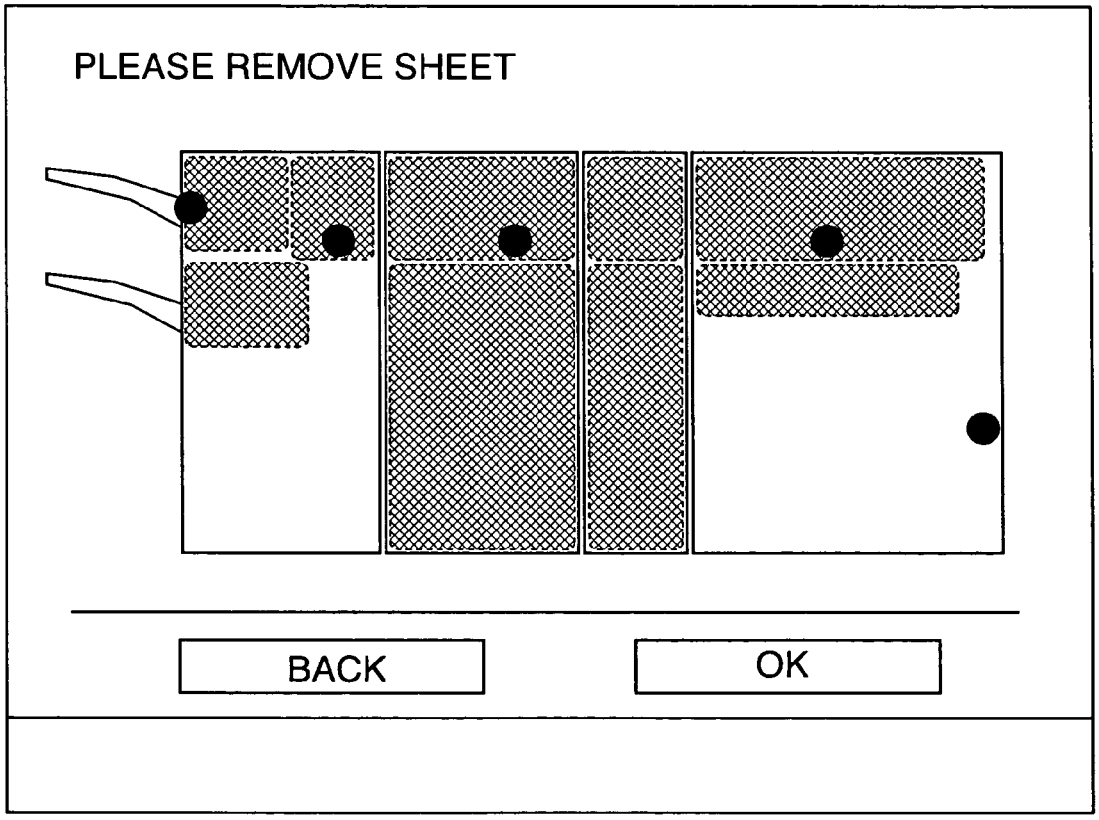
FIG. 43 is a view showing a first operation screen displayed on the liquid crystal display section when a jam occurs.
Figure 44A:
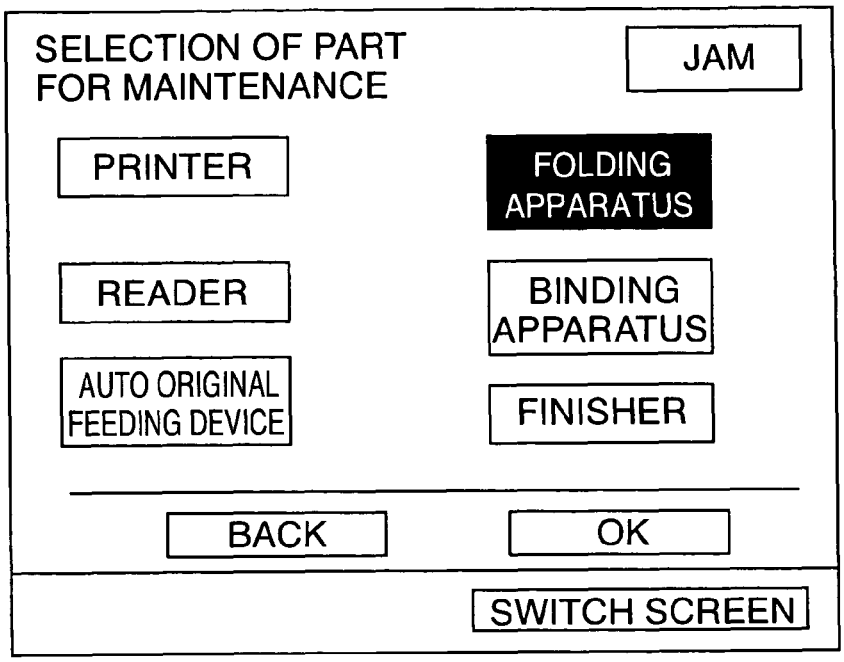
FIGS. 44A to 44D are views showing second operation screens displayed on the liquid crystal display section in place of the maintenance process screens shown in FIGS. 18 to 21.
Figure 44B:
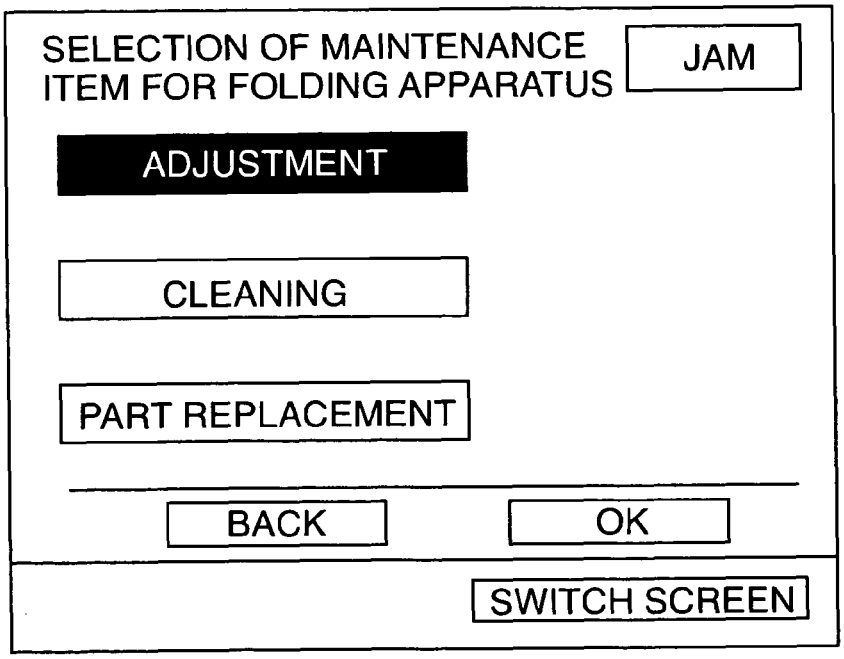
Figure 44C:
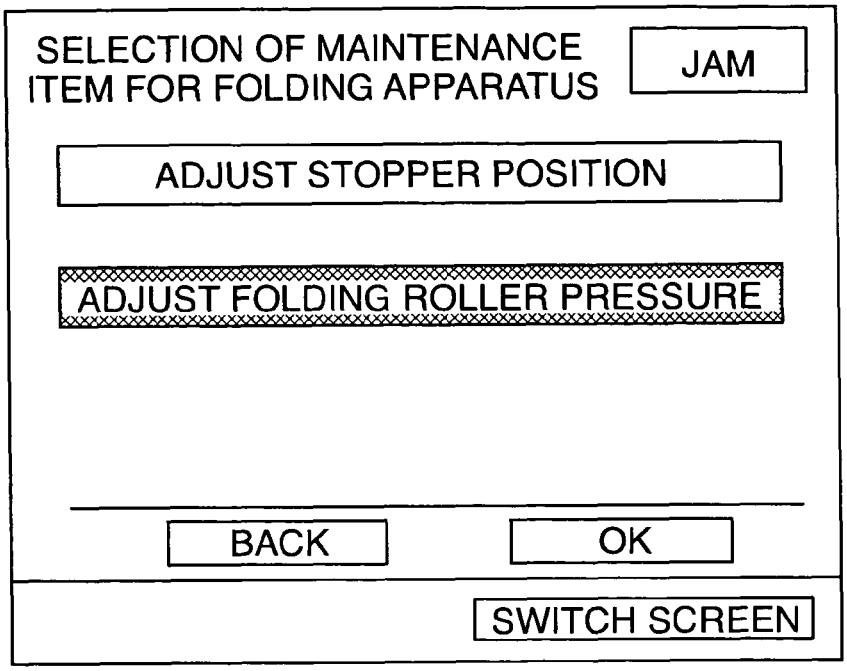
Figure 44D:
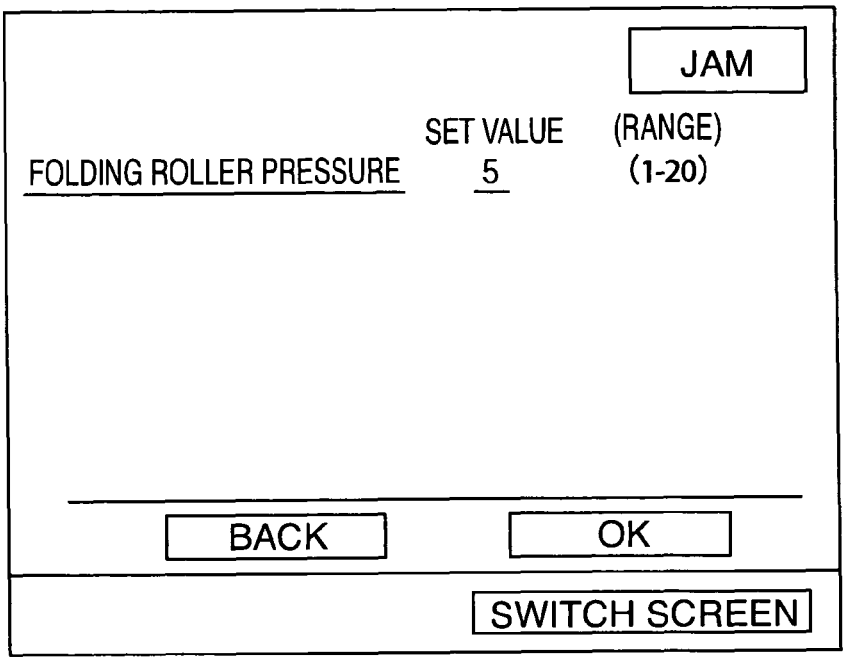

FIG. 43 is a view showing a first operation screen displayed on the liquid crystal display section 420 when a jam occurs.

Jam detecting sections that detect a sheet jam (a delaying or stopping of conveying) are provided on the respective conveying paths in the image forming system, and when any of the jam detecting sections has detected a jam, the position where the jam occurred is displayed using a circle (colored black in FIG. 43) in the first operation screen so that the position of the jam can be identified.

In the fourth embodiment, if a jam has occurred on a sheet conveying path used for image formation or post-processing while maintenance is being performed and any of the maintenance process screens shown in FIG. 18 to FIG. 21 is being displayed on the liquid crystal display section 420, the first operation screen is displayed with priority, in place of the maintenance process screen.

Note that when a jam occurs, a second operation screen may be displayed on the liquid crystal display section 420.

FIGS. 44A to 44D are views showing second operation screens displayed on the liquid crystal display section 420 in place of the maintenance process screens shown in FIGS. 18 to 21.

The second operation screens shown in FIGS. 44A to 44D respectively correspond to the maintenance process screens shown in FIGS. 18 to 21, with a "JAM" display showing that a jam has occurred and a "SWITCH SCREEN" key being respectively added to the maintenance process screens shown in FIGS. 18 to 21. When the user selects the "SWITCH SCREEN" key, the display screen of the liquid crystal display section 420 switches to the first operation screen shown in FIG. 43.

That is, when a jam occurs while any of the maintenance process screens shown in FIGS. 18 to 21 is being displayed on the liquid crystal display section 420, a screen, out of the second operation screens shown in FIGS. 44A to 44D, that corresponds to the screen displayed on the liquid crystal display section 420 when the jam occurred is displayed. Next, if the user presses a "SWITCH SCREEN" key in the second operation screen being displayed, the first operation screen shown in FIG. 43 is displayed on the liquid crystal display section 420.

It is to be understood that the object of the present invention may also be accomplished by supplying a system or an apparatus with a storage medium in which a program code of software which realizes the functions of any of the above described embodiments is stored, and causing a computer (or CPU or MPU) of the system or apparatus to read out and execute the program code stored in the storage medium.

In this case, the program code itself read out from the storage medium realizes the novel functions of any of the embodiments described above, and hence the program code and the storage medium in which the program code is stored constitute the present invention.

Examples of the storage medium for supplying the program code include a flexible disk, a hard disk, a magneto-optical disk, an optical disk including a CD-ROM, a CD-R, a CD-RW, a DVD-ROM, a DVD-RAM, a DVD-RW, and a DVD+RW, a magnetic tape, a nonvolatile memory card, and a ROM. Alternatively, the program may be supplied by downloading from another computer, a database, or the like, not shown, connected to the Internet, a commercial network, a local area network, or the like.

Further, it is to be understood that the functions of any of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

As described above, the image forming system according to the present invention determines, out of a plurality of conveying paths, conveying paths for which parts related to the conveying paths can be subjected to maintenance are determined in accordance with the type of image forming processing or post-processing being executed and are displayed on a display device.

The plurality of conveying paths are respectively covered by a plurality of external covers which are independently controlled as to whether opening and closing thereof is to be permitted.

When maintenance is performed for parts related to a conveying path for which it is determined that parts related to the conveying path can be subjected to maintenance, a screen showing that the maintenance is being carried out is displayed on the display device.

Also, when a jam has been detected by any of a plurality of jam detecting sensors respectively provided on the plurality of conveying paths, a screen notifying the detected jam is displayed on the display device in place of the screen showing that maintenance is being performed.

By doing so, it becomes possible to open the external cover of an apparatus and to perform maintenance on the apparatus even during operation of the image forming system.

That is, by disposing independent external covers on the respective conveying paths, it becomes possible, even when image forming is being executed, to open and close the external cover and perform maintenance on the parts related to the conveying path where a sheet is not being conveyed. As a result, even if maintenance operations are performed in various timings, it is possible to reduce the time during which the image forming system is halted.

Moreover, it is possible to set and execute image forming jobs even during maintenance such as replacement or cleaning of parts related to conveying paths and adjustments. Also, when a job that has been set cannot be executed due to ongoing maintenance, a warning can be displayed to the user, thereby improving operability for the user.

Further, when a jam has occurred, a jam-related screen is given priority over a maintenance-related screen and displayed on the display device. As a result, the user or operator taking part in maintenance can be quickly made aware of the jam and urged to clear the jam, so that it is possible to reduce the time during which the image forming system is halted.

Furthermore, it is configured such that the jam-related screen can be switched to the maintenance-related screen. As a result, the user or operator can proceed without a maintenance operation being interrupted.

CROSS REFERENCE TO RELATED APPLICATION

This application claims priority from Japanese Patent Application No. 2004-169152 filed Jun. 7, 2004, which is hereby incorporated by reference herein.

What is claimed is:

1. An image forming system that includes an image forming apparatus, a post-processing apparatus, and a display device, comprising:

a plurality of conveying paths provided inside the image forming apparatus and the post-processing apparatus, for conveying a sheet;

a plurality of jam detecting sensors provided on respective ones of the plurality of conveying paths;

a determining device that determines, out of said plurality of conveying paths, at least one conveying path capable of being subjected to maintenance of at least part related to the conveying path, in accordance with types of the image forming process and the post-processing being executed;

a display control device that displays the conveying path for which said determining device has determined that the part related to the conveying path is subjectable to the maintenance, on the display device; and a control unit that controls the operation of at least one of the image forming apparatus and the post-processing apparatus to discontinue the utilization of a first conveying path that has been determined to be capable of being subjected to the maintenance by the determining device, while also controlling the operation of at least one of the image forming apparatus and the post-processing apparatus to continue the utilization of a second conveying path that has not been determined to be capable of being subjected to the maintenance;

wherein the maintenance is partially executable on the first conveying path while the second conveying path is being used in an image forming process;

wherein said display control device displays on the display device a maintenance process screen showing that the maintenance is being executed when the maintenance is being executed on a part related to the first conveying path;

wherein said display control device displays on the display a jam-related screen showing that a jam has occurred in place of the maintenance process screen when the maintenance process screen is being displayed and a jam occurs in the second conveying path as detected by any of said jam detecting sensors; and wherein the maintenance includes replacement of parts, cleaning, or adjustment, but not including jam processing.

2. An image forming system as claimed in claim 1, further comprising a plurality of external covers covering respective ones of said plurality of conveying paths, wherein said plurality of external covers are independently controlled as to whether opening and closing thereof is to be permitted.

3. An image forming system as claimed in claim 1, wherein said display control device displays, in the screen showing that the maintenance is being executed, an operation key for switching the screen showing that the maintenance is being executed to a screen showing a processing content of the image forming process or the post-processing.

4. An image forming system as claimed in claim 3, wherein said display control device displays, in the screen showing the processing content of the image forming process or the post-processing, an operation key for switching the screen showing that the maintenance is being executed to a screen showing a processing content of the maintenance.

5. An image forming system as claimed in claim 1, further comprising:

a second determining device operable when execution of a new image forming job has been requested while maintenance is being executed on the part related to the conveying path for which said determining device has determined that the part related to the conveying path is subjectable to maintenance, to determine whether the part related to the conveying path being subjected to maintenance presently being executed is to be used when the new image forming job is executed; and an inhibiting device operable when said second determining device has determined that the part related to the conveying path is to be used, to inhibit the execution of the new image forming job.

6. An image forming system as claimed in claim 5, wherein the display control device displays an indication that the execution of the new image forming job is not possible when the second determining device has determined that the part related to the conveying path is to be subject to maintenance.

7. An image forming system as claimed in claim 1, further comprising:

a second determining device operable when execution of a new image forming job has been requested while maintenance is being executed on the part related to the conveying path for which said determining device has determined that the part related to the conveying path is subjectable to maintenance, to determine whether the part related to the conveying path being subjected to maintenance presently being executed is to be used when the new image forming job is executed; and an inhibiting device operable when said second determining device has determined that the part related to the conveying path is to be used, to inhibit use of the part related to the conveying path determined to be used by said second determining device, out of a plurality of parts related to conveying paths used by at least one of the image forming process and the post-processing.

8. An image forming system as claimed in claim 1, further comprising an inhibiting device operable when maintenance is being executed on the part related to the conveying path for which said determining device has determined that the part related to the conveying path is subjectable to maintenance, to inhibit use of the part related to the conveying path on which maintenance is being executed.

9. A maintenance method applied to an image forming system that includes an image forming apparatus, and a post-processing apparatus, the image forming apparatus and the post-processing apparatus including a plurality of conveying paths that convey a sheet, a display device, and a plurality of jam detecting sensors provided on respective ones of the plurality of conveying paths, the maintenance method comprising:

a determining step of determining, out of the plurality of conveying paths, at least one conveying path capable of being subjected to maintenance of at least part related to the conveying path, in accordance with types of the image forming process and the post-processing being executed;

a displaying step of displaying the conveying path for which it is determined in said determining step that the part related to the conveying path is subjectable to the maintenance, on the display device; and a control step of controlling the operation of at least one of the image forming apparatus and the post-processing apparatus to discontinue the utilization of a first conveying path that has been determined to be capable of being subjected to the maintenance in said determining step, while also controlling the operation of at least one of the image forming apparatus and the post-processing apparatus to continue the utilization of a second conveying path that has not been determined to be capable of being subjected to the maintenance;

wherein the is partially executable on the first conveying path while the second conveying path is being used in an image forming process;

wherein in said displaying step, a maintenance process screen showing that the maintenance is being executed is displayed on the display device when the maintenance is being executed on a part related to the first conveying path;

wherein in said displaying step, a jam-related screen showing that a jam has occurred is displayed on the display in place of the maintenance process screen when the maintenance process screen is being displayed and a jam occurs in the second conveying path as detected by any of the jam detecting sensors; and wherein the maintenance includes replacement of parts, cleaning, or adjustment, but not including jam processing.

10. A non-transitory computer readable a program executable by a computer to execute a maintenance method applied to an image forming system that includes an image forming apparatus, and a post-processing apparatus, the image forming apparatus and the post-processing apparatus including a plurality of conveying paths that convey a sheet, a display device, and a plurality of jam detecting sensors provided on respective ones of the plurality of conveying paths, the maintenance method comprising:

a determining step of determining, out of the plurality of conveying paths, at least one a conveying path capable of being subjected to maintenance of at least part related to the conveying path, in accordance with types of the image forming process and the post-processing being executed;

a displaying step of displaying the conveying path for which it is determined in said determining step that the part related to the conveying path is subjectable to the maintenance, on the display device; and a control step of controlling the operation of at least one of the image forming apparatus and the post-processing apparatus to discontinue the utilization of a first conveying path that has been determined to be capable of being subjected to the maintenance in said determining step, while also controlling the operation of at least one of the image forming apparatus and the post-processing apparatus to continue the utilization of a second conveying path that has not been determined to be capable of being subjected to the maintenance;

wherein the maintenance is partially executable on the first conveying path while the second conveying path is being used in an image forming process;

wherein in said displaying step, a maintenance process screen showing that the maintenance is being executed is displayed on the display device when the maintenance is being executed on a part related to the first conveying path;

wherein in said displaying step, a jam-related screen showing that a jam has occurred is displayed on the display device in place of the maintenance process screen when the maintenance process screen is being displayed and a jam occurs in the second conveying path as detected by any of the jam detecting sensors; and wherein the maintenance includes replacement of parts, cleaning, or adjustment, but not including jam processing.

* * * * *